US009969165B2

(12) United States Patent
Kasai et al.

(10) Patent No.: US 9,969,165 B2
(45) Date of Patent: May 15, 2018

(54) LIQUID DISCHARGE HEAD AND LIQUID DISCHARGE APPARATUS

(71) Applicant: CANON KABUSHIKI KAISHA, Tokyo (JP)

(72) Inventors: Shintaro Kasai, Yokohama (JP); Yoshiyuki Nakagawa, Kawasaki (JP); Akiko Saito, Tokyo (JP); Takatsugu Moriya, Tokyo (JP); Koichi Ishida, Tokyo (JP); Tatsuya Yamada, Kawasaki (JP); Shuzo Iwanaga, Kawasaki (JP); Ayako Tozuka, Yokohama (JP); Tomoki Ishiwata, Kawasaki (JP); Tomohiro Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/394,619

(22) Filed: Dec. 29, 2016

(65) Prior Publication Data

US 2017/0197412 A1 Jul. 13, 2017

(30) Foreign Application Priority Data

Jan. 8, 2016 (JP) ..... 2016-002953
Nov. 29, 2016 (JP) ..... 2016-231038

(51) Int. Cl.
*B41J 2/14* (2006.01)
*B41J 2/18* (2006.01)

(52) U.S. Cl.
CPC ..... *B41J 2/1433* (2013.01); *B41J 2/14016* (2013.01); *B41J 2/18* (2013.01); *B41J 2202/12* (2013.01)

(58) Field of Classification Search
CPC ..... B41J 2202/12
See application file for complete search history.

(56) References Cited

U.S. PATENT DOCUMENTS

2002/0030712 A1* 3/2002 Silverbrook ..... B41J 2/14 347/19
2002/0118256 A1* 8/2002 Dixon ..... B41J 2/04 347/65
2002/0135638 A1* 9/2002 Okuda ..... B41J 2/14201 347/47
2005/0157033 A1 7/2005 Silverbrook
(Continued)

FOREIGN PATENT DOCUMENTS

JP 2014510649 A 5/2014

*Primary Examiner* — Shelby Fidler
(74) *Attorney, Agent, or Firm* — Canon U.S.A., Inc. IP Division

(57) ABSTRACT

Multiple recording elements are disposed on one face of a recording element board, and a groove-shaped liquid supply channel is provided on the other face in common for the recording elements. Multiple supply ports passing through the recording element board and communicating the liquid supply channel with pressure chambers, and supply-side openings serving as supply ports of liquid to the liquid supply channel are further provided. When discharging liquid, the sum of pressure drop of the liquid from any supply-side opening to the supply port at a position farthest removed from that supply-side opening, and the pressure drop of the liquid at the supply port, is 5000 Pa or less.

15 Claims, 42 Drawing Sheets

(56) References Cited

U.S. PATENT DOCUMENTS

| | | | | |
|---|---|---|---|---|
| 2008/0158321 | A1* | 7/2008 | Nitta | B41J 2/175 347/89 |
| 2009/0295888 | A1* | 12/2009 | Nitta | B41J 2/175 347/89 |
| 2012/0038710 | A1* | 2/2012 | Yamamoto | B41J 2/14209 347/47 |
| 2013/0002768 | A1* | 1/2013 | Miyazawa | B41J 2/14209 347/68 |
| 2015/0035910 | A1* | 2/2015 | Kinoshita | B41J 2/14233 347/68 |

* cited by examiner

LIQUID DISCHARGE HEAD AND LIQUID DISCHARGE APPARATUS

BACKGROUND OF THE INVENTION

Field of the Invention

The present invention relates to a liquid discharge head and a liquid discharge apparatus.

Description of the Related Art

Liquid discharge apparatuses that perform recording by discharging liquid onto a recording medium use a liquid discharge head 3 that has a pressure chamber communicating with a discharge orifice, and a recording element that provides energy to discharge liquid within the pressure chamber. The liquid discharged from the discharge orifice, such as ink or the like, has had some sort of component added to a medium. There are cases where the medium component vaporizes and evaporates form the discharge orifice, resulting in increased viscosity of the liquid near the discharge orifice. Increased viscosity near the discharge orifice affects discharge properties, and may deteriorate recording image quality. Accordingly, there is known a technology where the liquid is made to circulate through the pressure chamber where the discharge orifice and the recording element is provided, thereby achieving higher quality recording (PCT Japanese Translation Patent Publication No. 2014-510649). However, complicated channels need to be formed within the liquid discharge head in order to circulate the liquid, so this is a factor increasing the size of the liquid discharge head. On the other hand, there is demand for reduction in size in liquid discharge heads with the same number of recording elements disposed in high density, to perform high-definition recording. Although liquid discharge heads generally have recording elements formed on one surface of a board, there is technology where grooves serving as channels for liquid are provided on the rear surface of the board, and through channels are formed passing through the board and communicating with the grooves, thereby realizing reduction in the size of the liquid discharge head (U.S. Patent Application Publication No. 2005/0157033).

In a case of making a configuration where liquid is circulated for example, there is the need to form complicated channels, so the liquid discharge head tends to become larger in size. On the other hand, the arrangement where grooves serving as channels for liquid are provided on the opposite face of the board as the face where the recording elements are provided, and through channels are formed passing through the board and communicating with the grooves, have the following problem. That is to say, in a case where the board is made smaller, the paths that the liquid passes through (the channels and through channels formed as grooves) become narrower as a matter of course, and viscous resistance increases. Increased viscous resistance increases pressure drop, which tends to deteriorate recording quality, such as replenishing of the liquid to the pressure chamber when discharging becoming slower, the amount of liquid discharged onto the recording medium being insufficient, and so forth. Particularly, in an arrangement where circulation of liquid is performed in the configuration where channels are formed on the other face of the board, the pressure drop tends to be particularly great since liquid is flowing at all times, so there is concern that recording quality may deteriorate.

SUMMARY OF THE INVENTION

It has been found desirable to provide a liquid discharge head 3 where the size of a recording element board is reduced by forming groove-shaped channels on the opposite face form the face of the board where recording elements are formed, and also where replenishing of liquid to the pressure chamber can be speedily performed. It also has been found desirable to provide a liquid discharge apparatus using the liquid discharge head.

A liquid discharge head includes: a recording element board, a plurality of recording elements configured to generate energy to discharge liquid being provided on a first face of the recording element board; partitions disposed between adjacent recording elements; discharge orifices provided corresponding to the recording elements; pressure chambers sectioned off by the partitions and having the recording elements within; a discharge orifice row where a plurality of the discharge orifices are arrayed; a liquid supply channel provided as a groove to a second face that is on the opposite side of the recording element board from the first face, and configured to supply liquid to the plurality of pressure chambers; a plurality of supply ports communicating between the first face and liquid supply channel, and configured to supply liquid to the pressure chambers from the liquid supply channel; and a cover provided on the second face covering the liquid supply channel, and having supply-side openings configured to supply liquid to the liquid supply channel. In a process of liquid being replenished to the pressure chambers after having discharged liquid from the discharge orifices, a sum P1 of pressure drop of liquid on the liquid supply channel from any supply-side opening to a supply port that communicates with the supply-side opening and is at a farthest removed position from the supply-side opening, and pressure drop of liquid at the supply port at the farthest removed position, is 5000 Pa or less.

Further features of the present invention will become apparent from the following description of exemplary embodiments with reference to the attached drawings.

DESCRIPTION OF THE EMBODIMENTS

Configuration examples and embodiments to which the present invention is applicable will be described below with reference to the drawings. It should be understood that the description that follows does not restrict the scope of the present invention. As one example, an example of a so-called thermal system, that discharges liquid from a discharge orifice by generating bubbles by heat in liquid in a pressure chamber, using a heat-generating element as a recording element that generates energy to discharge liquid, will be described below. However, liquid discharge heads to which the present invention can be applied is not restricted to thermal systems, and the present invention can be applied to liquid discharge heads employing the piezoelectric system using piezoelectric elements, and various other types of liquid discharge systems. The liquid discharge head according to the present invention that discharges liquid such as ink, and the liquid discharge apparatus having the liquid discharge head, are applicable to apparatuses such as printers, photocopiers, facsimile devices having communication systems, word processors having printer units, and so forth, and further to industrial recording apparatuses combined in a complex manner with various types of processing devices. For example, the present invention can be used in fabricating biochips, printing electronic circuits, fabricating semiconductor substrates, and other such usages.

Although the description below relates to a liquid discharge head 3 used in a liquid discharge apparatus where a liquid such as recording liquid or the like is circulated between a tank and liquid discharge head, The liquid discharge apparatus using the liquid discharge head according to the present invention is not restricted to this. The present invention may be applied to an arrangement where, instead of circulating liquid, two tanks are provided, one at the upstream side of the liquid discharge head and the other on the downstream side, and liquid within the pressure chamber is caused to flow by running liquid from one tank to the other.

Also, the description below relates to a so-called line (page-wide) head that has a length corresponding to the width of the recording medium, but the present invention can also be applied to a so-called serial liquid discharge head that completes recording on a recording medium by scanning in a main scan direction and sub-scan direction. An example of a serial liquid discharge head is one that has one recording element board each for recording black recording liquid and for recording color recording liquid, but this is not restrictive. An example of a serial liquid discharge head may be an arrangement where short line heads that are shorter than the width of the recording medium are formed, with multiple recording element boards arrayed so that orifices overlap in the discharge orifice row direction, and these being scanned over the recording medium.

Figure 1:
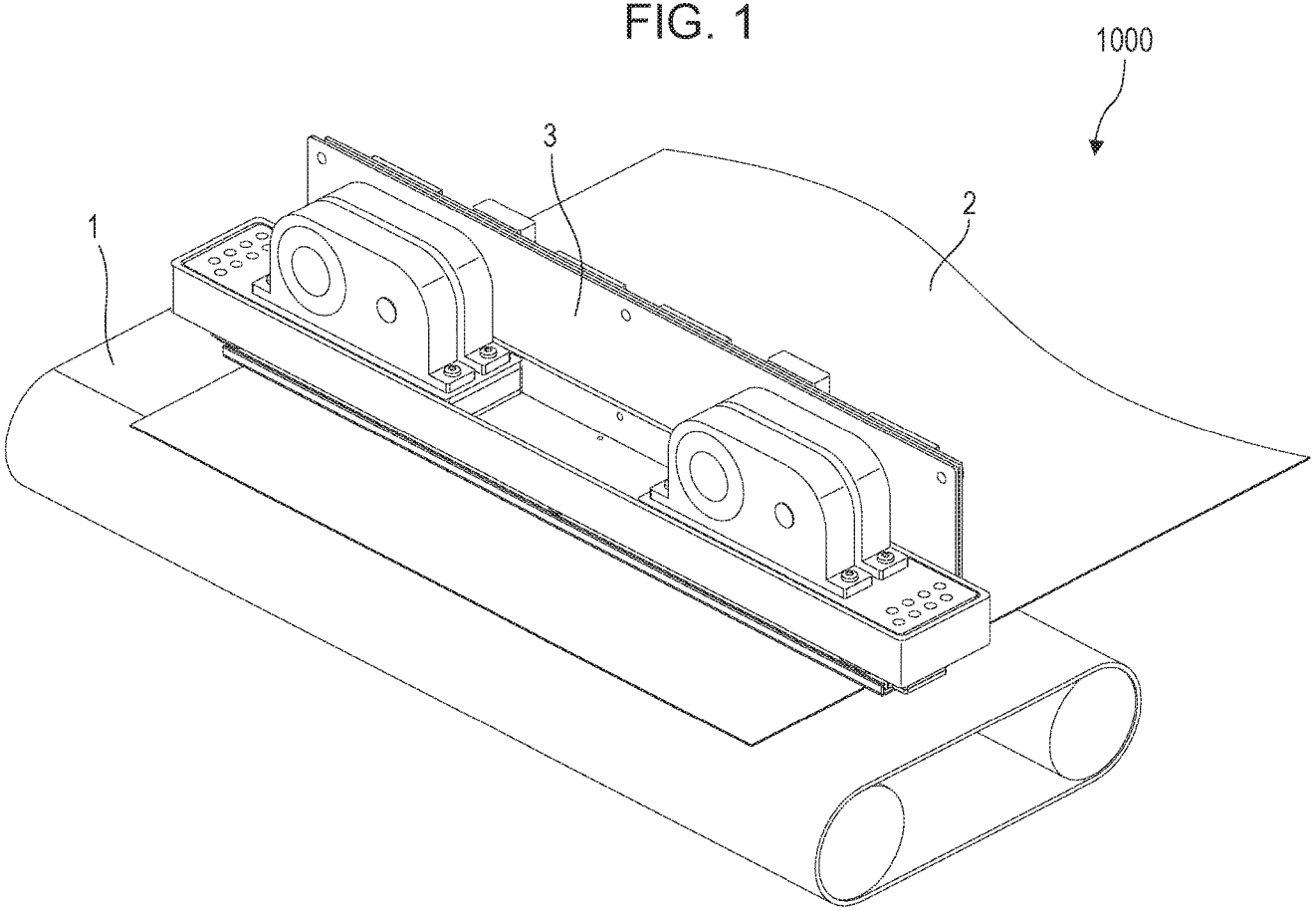
FIG. 1 is a diagram illustrating a schematic configuration of a liquid discharge apparatus according to a first configuration example.
Figure 2:
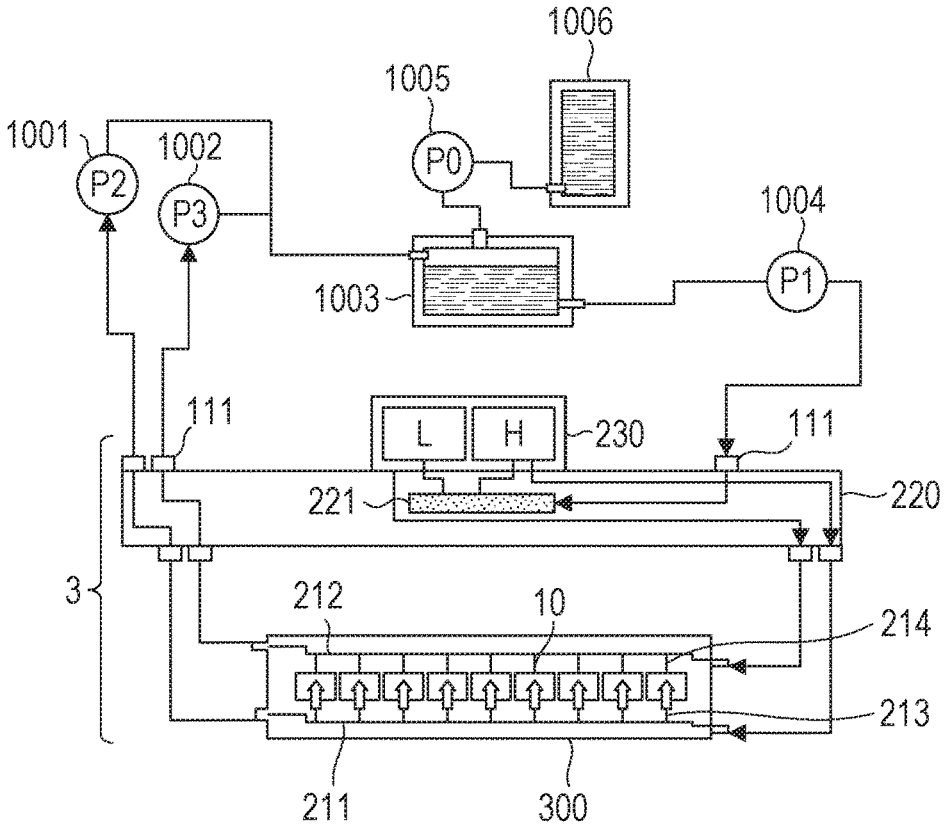
FIG. 2 is a diagram illustrating a first circulation arrangement.

Description of Liquid Discharge Head Apparatus According to First Configuration Example First, description will be made regarding an inkjet recording apparatus 1000 (hereinafter also referred to simply as "recording apparatus") that performs recording by discharging a recording liquid as liquid from discharge orifices onto a recording medium, as an example of a liquid discharge apparatus according to the present invention. FIG. 1 illustrates a schematic configuration of the recording apparatus 1000 as a liquid discharge apparatus according to a first configuration example. The recording apparatus 1000 has a conveyance unit 1 that conveys a recording medium 2, and a line type liquid discharge head 3 disposed generally orthogonal to the conveyance direction of the recording medium 2, and is a line type recording apparatus that performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan (C), magenta (M), yellow (Y), and black (K) color recording liquid (these colors are also referred together as CMYK). The liquid discharge head 3 is connected by fluid connection to a liquid supply arrangement that is a supply path for supplying liquid to the liquid discharge head 3, a main tank, and a buffer tank (see FIG. 2), as described later. The liquid discharge head 3 can be roughly divided into a liquid supply unit 220, a negative pressure control unit 230, and a liquid discharge unit 300, as illustrated in FIG. 2 which will be described later. Multiple recording element boards 10, and a common supply channel 211 and common recovery channel 212 are provided to the liquid discharge unit 300, with multiple recording elements provided to each of the recording element boards 10. In the liquid discharge unit 300, the recording liquid is supplied from the common supply channel 211 to the recording element boards 10 as indicated by arrows in FIG. 2, and this recording liquid is recovered by the common recovery channel 212. The liquid discharge head 3 is also electrically connected to an electric control unit that transmits electric power and discharge control signals to the liquid discharge head 3. Liquid paths and electric signal paths within the discharge head 3 will be described later.

Description of First Circulation Arrangement

FIG. 2 illustrates a first circulation arrangement that is a form of a circulation path configuration applied to the liquid discharge apparatus according to the present invention. In the first circulation arrangement, the liquid discharge head 3 is connected to a high-pressure side first circulation pump 1001, a low-pressure side first circulation pump 1002, and a buffer tank 1003 and the like by fluid connection. Although FIG. 2 only illustrates the paths over which one color recording liquid out of the recording liquids of each of the CMYK colors, for the sake of brevity of description, in reality four colors worth of circulation paths are provided to the liquid discharge head 3 and the recording apparatus main unit. The buffer tank 1003, serving as a sub-tank that is connected to a main tank 1006, functions as a storage unit for storing recording liquid, has an atmosphere communication opening (omitted from illustration) whereby the inside and the outside of the tank communicate, and bubbles within the recording liquid can be discharged externally. The buffer tank 1003 is also connected to a replenishing pump 1005. When liquid is consumed at the liquid discharge head 3, by discharging (ejecting) recording liquid from the discharge orifices of the liquid discharge head 3, to perform recording, suction recovery, or the like, for example, the replenishing pump 1005 acts to send recording liquid of an amount the same as that has been consumed from the main tank 1006 to the buffer tank 1003.

The two first circulation pumps 1001 and 1002 serving as a liquid supply unit act to extract liquid from a fluid connector 111 of the liquid discharge head 3 and flow the liquid to the buffer tank 1003. The first circulation pumps 1001 and 1002 preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow valve and relief valve at the outlet of the pump, for example. When the liquid discharge unit 300 is being driven, the high-pressure side first circulation pump 1001 and low-pressure side first circulation pump 1002 each cause a constant amount of recording liquid to flow through a common supply channel 211 and a common recovery channel 212. The amount of flow is preferably set to a level where temperature difference among recording element boards 10 of the liquid discharge head 3 does not influence recording image quality on the recording medium 2, or higher. On the other hand, if the flow rate is set excessively high, the effects of pressure drop in the channels within a liquid discharge unit 300 causes excessively large difference in negative pressure among the recording element boards 10, resulting in unevenness in density in the recorded image. Accordingly, the flow rate is preferably set taking into consideration temperature difference and negative pressure difference among the recording element boards 10. Of the paths that the recording liquid circulate over, the path including the high-pressure side first circulation pump 1001 makes up a first circulation system in the liquid discharge apparatus, and the path including the low-pressure side first circulation pump 1002 makes up a second circulation system in the liquid discharge apparatus.

A second circulation pump 1004 is provided on the path supplying recording liquid from the buffer tank 1003 toward the liquid discharge head 3. The negative pressure control unit 230 is disposed on the path between the second circulation pump 1004 and the liquid discharge unit 300. The negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. The negative pressure control unit 230 has two pressure adjustment mechanisms each set to different control pressures. Any mechanism may be used as these two pressure adjustment mechanisms, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator as a pressure adjustment mechanism, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 to be suppressed, giving broader freedom in the layout of the buffer tank 1003 in the recording apparatus 1000. It is sufficient that the second circulation pump 1004 have a certain lift pressure or greater, within the range of the circulatory flow pressure of recording liquid used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

Of the two pressure adjustment mechanisms in the negative pressure control unit 230, the relatively high-pressure setting side (denoted by H in FIG. 2) is connected to the common supply channel 211 within the liquid discharge unit 300 via the liquid supply unit 220. In the same way, the relatively low-pressure setting side (denoted by L in FIG. 2) is connected to the common recovery channel 212 within the liquid discharge unit 300 via the liquid supply unit 220. Provided to the liquid discharge unit 300, besides the common supply channel 211 and common recovery channel 212, are individual supply channels 213 and individual recovery channels 214 each communicating with the recording element boards 10. The individual supply channels 213 and individual recovery channels 214 provided to each recording element board are collectively referred to as "individual channels". The individual channels are provided branching from the common supply channel 211 and merging at the common recovery channel 212, and communicating therewith. Accordingly, flows occur where part of the liquid such as recording liquid flows from the common supply channel 211 through inside of the recording element boards 10 and to the common recovery channel 212 (indicated by the outline arrows in FIG. 2). The reason is that the high-pressure side pressure adjustment mechanism H is connected to the common supply channel 211, and the low-pressure side pressure adjustment mechanism L to the common recovery channel 212, so a pressure difference is generated between the two common channels.

Thus, flows occur within the liquid discharge unit 300 where a part of the liquid passes through the recording element boards 10 while liquid flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables recording liquid flows to be generated at discharge orifices and pressure chambers not being used for recording while recording is being performed by the liquid discharge head 3, so higher viscosity of the recording liquid due to evaporation of the medium component of the recording liquid at such portions can be suppressed. Also, thickened recording liquid and foreign substance in the recording liquid can be expelled to the common recovery channel 212. Accordingly, using the above-described liquid discharge head 3 enables recording to be performed at high speed with high image quality.

Description of Second Circulation Arrangement

Figure 3:
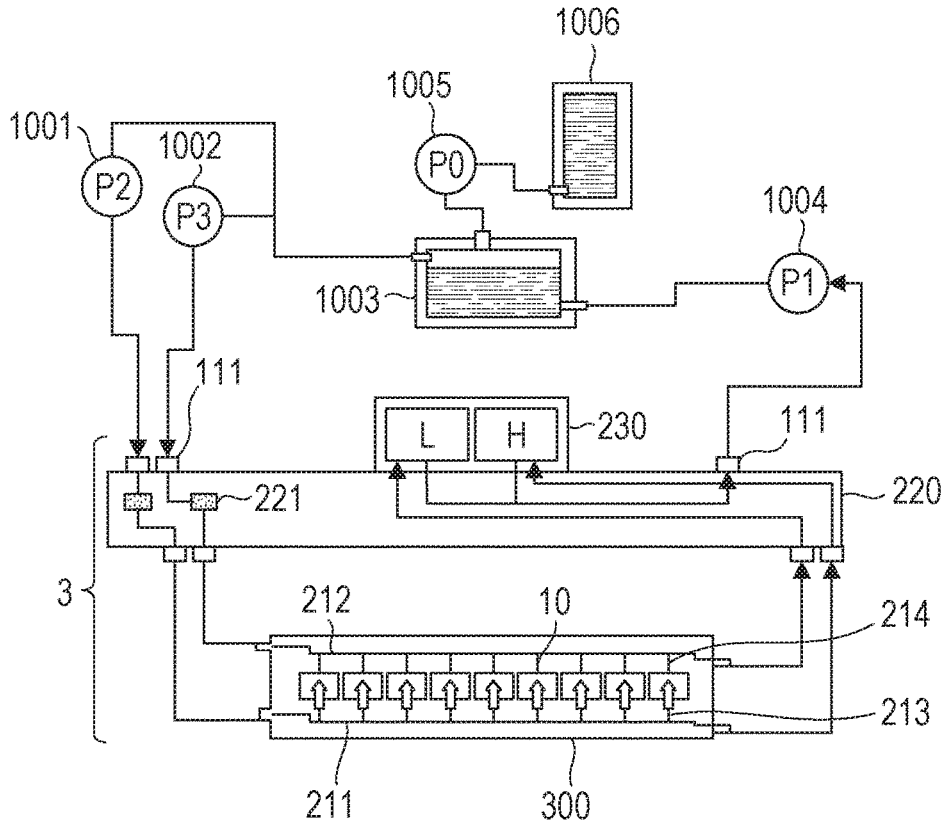
FIG. 3 is a diagram illustrating a second circulation arrangement.

FIG. 3 is a schematic diagram illustrating, of circulation paths applied to the liquid discharge apparatus according to the present invention, a second circulation arrangement that is a different circulation arrangement from the above-described first circulation arrangement. The primary points of difference of the second circulation arrangement as to the above-described first circulation arrangement are that both of the two pressure adjustment mechanisms making up the negative pressure control unit 230 are a mechanism to control pressure at the upstream side from the negative pressure control unit 230 to fluctuation within a constant range that is centered on a desired set pressure. This sort of pressure adjustment mechanism can be configured as a mechanism part having operations the same as a so-called "backpressure regulator". The second circulation pump 1004 acts as a negative pressure source to depressurize the downstream side from the negative pressure control unit 230, and the high-pressure side first circulation pump 1001 and low-pressure side first circulation pump 1002 are disposed on the upstream side of the liquid discharge head 3. Accordingly, the negative pressure control unit 230 is disposed on the downstream side of the liquid discharge head 3.

The negative pressure control unit 230 according to the second circulation arrangement acts to maintain pressure fluctuation on the upstream side of itself within a constant range centered on a preset pressure, even in cases where the flow rate fluctuates due to difference in recording duty when recording with the liquid discharge head 3. The upstream side of the negative pressure control unit 230 here is the liquid discharge unit 300 side. The downstream side of the negative pressure control unit 230 is preferably pressurized by the second circulation pump 1004 via the liquid supply unit 220, as illustrated in FIG. 3. This enables the effects of water head pressure of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 illustrated in FIG. 3 has two pressure adjustment mechanisms, with different control pressure from each other having been set, in the same way as the first circulation arrangement. The high-pressure setting side (denoted by H in FIG. 3) and the low-pressure setting side (denoted by L in FIG. 3) pressure adjustment mechanisms are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two pressure adjustment mechanisms, whereby flows occur where recording liquid flows from the common supply channel 211 through the individual channels and internal channels in the recording element board 10 to the common recovery channel 212. The flows of recording liquid in FIG. 3 are indicated by outline arrows. The second circulation arrangement thus yields a recording liquid flow state the same as that of the first circulation arrangement within the liquid discharge unit 300, but has two advantages that are different from the case of the first circulation arrangement.

One advantage is that, with the second circulation arrangement, the negative pressure control unit 230 is disposed on the downstream side of the liquid discharge head 3, so there is little danger that dust and foreign substances generated at the negative pressure control unit 230 will flow into the liquid discharge head 3.

A second advantage is that the maximum value of the necessary flow rate supplied from the buffer tank 1003 to the liquid discharge head 3 can be smaller in the second circulation path as compared to the case of the first circulation arrangement. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging recording liquid from all discharge orifices of the liquid discharge unit 300 (full discharge) is defined as F. Accordingly, in the case of the first circulation arrangement (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F. On the other hand, in the case of the second circulation arrangement in FIG. 3, the liquid supply amount to the liquid discharge head 3 necessary at the time of recording standby is flow rate A. This means that the supply amount to the liquid discharge head 3 necessary for full discharge is flow rate F. Accordingly, in the case of the second circulation arrangement, the total value of the set flow rate of the high-pressure side and low-pressure side first circulation pumps 1001 and 1002, i.e., the maximum value of the necessary supply amount, is the larger value of A and F. Thus, the maximum value of the necessary supply amount in the second circulation arrangement (A or F) is always smaller than the maximum value of the necessary supply amount in the first circulation arrangement (A+F), as long as the liquid discharge unit 300 of the same configuration is used. Consequently, the degree of freedom regarding circulatory pumps that can be applied is higher in the case of the second circulation arrangement, and low-cost circulatory pumps having simple structure can be used, the load on a cooler (omitted from illustration) disposed on the main unit side path can be reduced, thereby reducing costs of the recording apparatus main unit. This advantage is more pronounced with line heads where the values of A or F are relatively great, and is more useful the longer the length of the line head is in the longitudinal direction.

However, on the other hand, there are points where the first circulation arrangement is more advantageous than the second circulation arrangement. With the second circulation arrangement, the flow rate flowing through the liquid discharge unit 300 at the time of recording standby is maximum, so the lower the recording duty of the image is, the greater a negative pressure is applied to the nozzles. Accordingly, particularly in a case where the channel widths of the common supply channel 211 and common recovery channel 212 is reduced to reduce the head width, high negative pressure may be applied to the nozzles in low-duty images where unevenness is easy to see, which may increase the influence of satellite droplets. Note that the channel width of the common supply channel 211 and common recovery channel 212 is the length in the direction orthogonal to the direction of low of liquid, and the head width is the length in the transverse direction of the liquid discharge head 3. On the other hand, high pressure is applied to the nozzles when forming high-duty images in the case of the first circulation arrangement, so any generated satellite droplets are less conspicuous in the recorded image, which is advantageous in that influence on the image quality is small. Which of these two circulation arrangements is more preferable can be selected in light of the specifications of the liquid discharge head 3 and recording apparatus main unit (discharge flow rate F, smallest circulatory flow rate A, and channel resistance within the liquid discharge head 3).

Description of Third Circulation Arrangement

Figure 31:
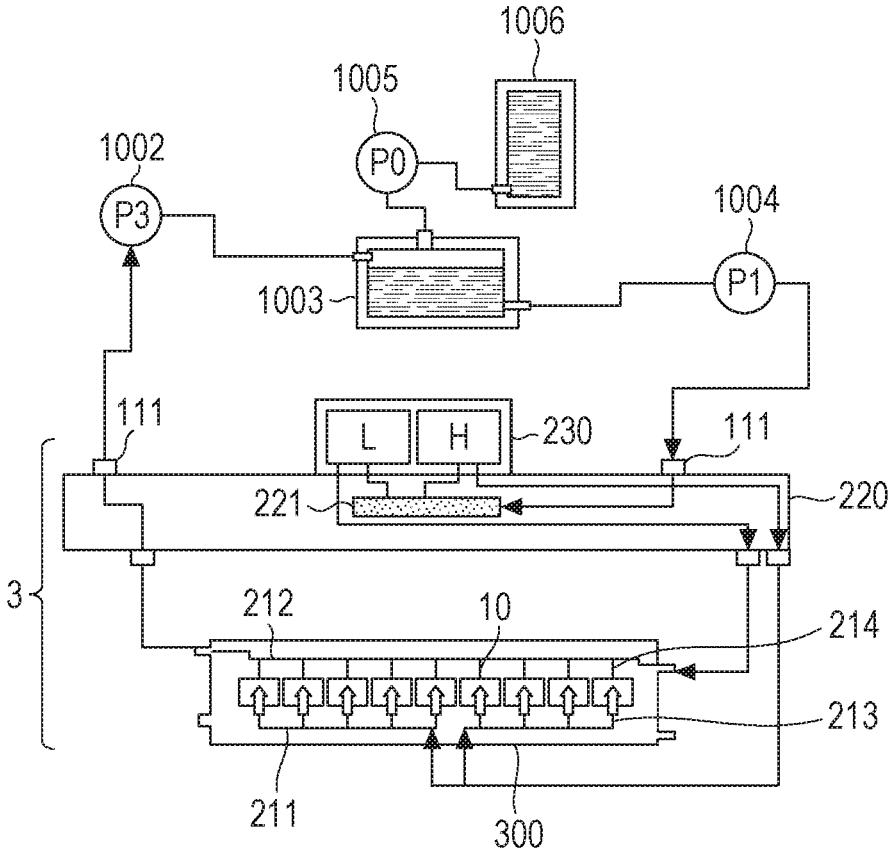
FIG. 31 is a diagram describing a third circulation arrangement.

FIG. 31 is a schematic diagram illustrating a third circulation arrangement that is a first form of a circulation path applied to the recording apparatus according to the present configuration example. Description of functions and configurations the same as the above-described first and second circulation arrangements will be omitted, and description is be made primarily regarding points of difference.

Liquid is supplied to inside of the liquid discharge head 3 from two places at the middle of the liquid discharge head 3, and one end side of the liquid discharge head 3, for a total of three places, the present circulation arrangement. The liquid passes from the common supply channel 211 through pressure chambers 23 then recovered by the common recovery channel 212, and thereafter is externally recovered from a recovery opening at the other end of the liquid discharge head 3. Individual channels 213 and 214 communicate with the common supply channel 211 and common recovery channel 212, with the recording element boards 10 and the pressure chambers 23 disposed within the recording element boards 10 being provided on the paths of the individual channels 213 and 214. Accordingly, flows occur where part of the liquid which the first circulation pump 1002 pumps flows from the common supply channel 211 through pressure chambers 23 in the recording element boards 10 and to the common recovery channel 212 (indicated by the arrows in FIG. 31). The reason is that pressure difference is formed between the pressure adjustment mechanism H connected to the common supply channel 211, and the pressure adjustment mechanism L to the common recovery channel 212, and the first circulation pump 1002 is connected to just the common recovery channel 212.

Thus, a flow of liquid that passes through the common recovery channel 212, and a flow that passes from the common supply channel 211 through the pressure chambers 23 in the recording element boards 10 and flows to the common recovery channel 212, are formed in the liquid discharge unit 300. Accordingly, heat generated at the recording element boards 10 can be externally discharged from the recording element boards 10 by the flow from the common supply channel 211 to the common recovery channel 212, while suppressing increase of pressure loss. Also, according to the present circulation arrangement, the number of pumps serving as liquid conveyance units can be reduced as compared with the first and second circulation arrangement described above.

Description of Configuration of Liquid Discharge Head

Figure 4A:
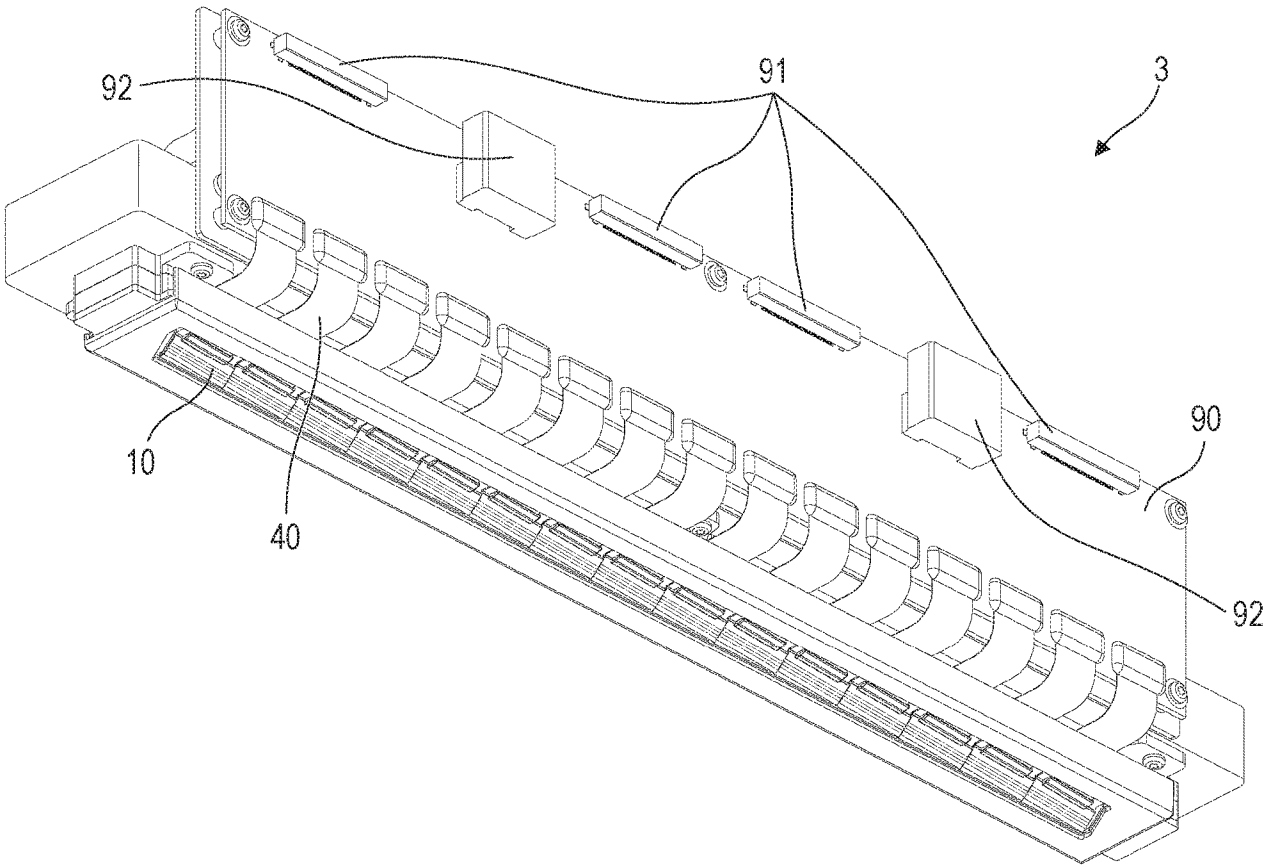
FIGS. 4A and 4B are perspective diagrams of a liquid discharge head.
Figure 4B:
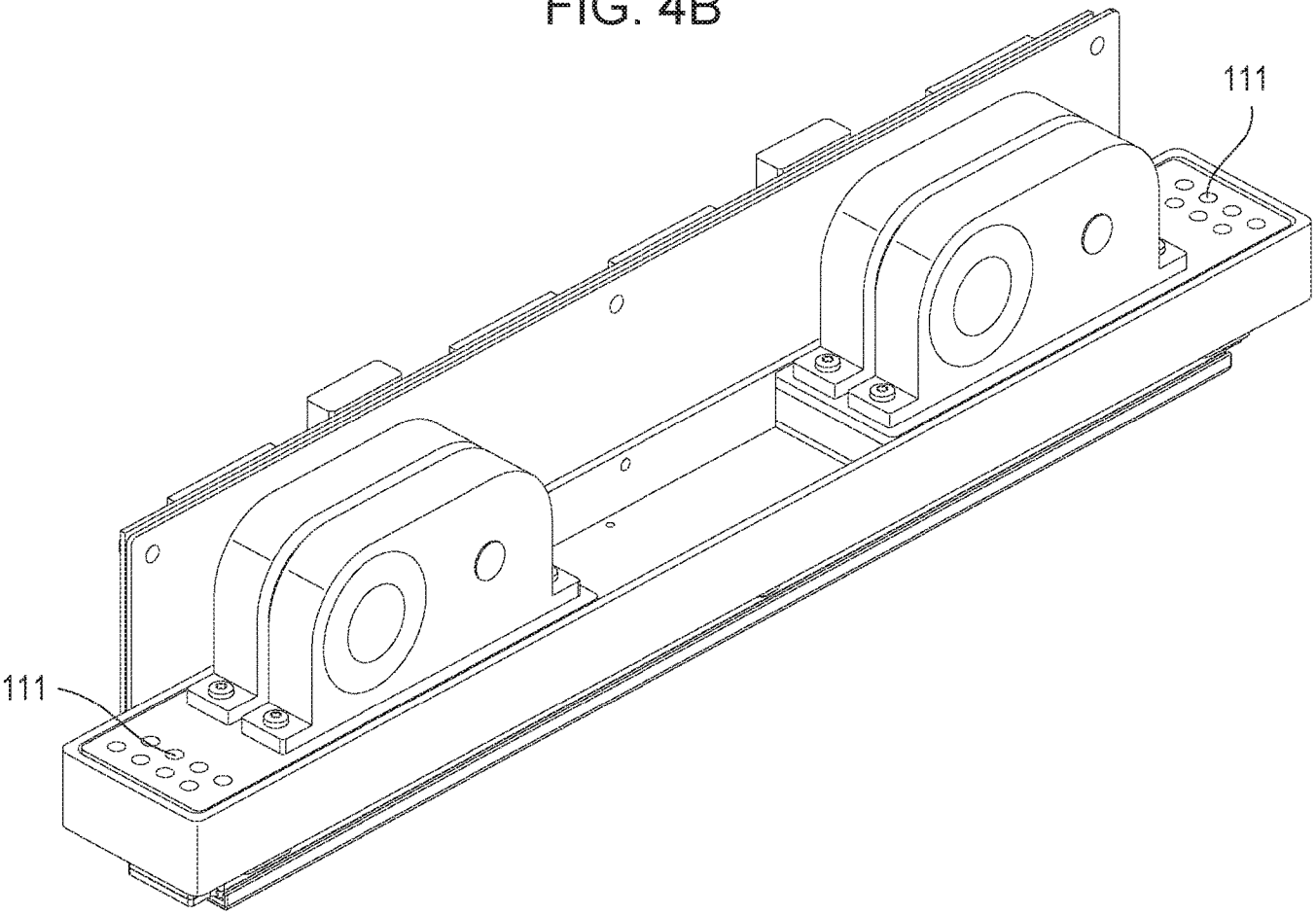

The configuration of the liquid discharge head 3 will be described next with reference to FIGS. 4A and 4B. FIG. 4A is a perspective view of the liquid discharge head 3 as viewed from the side of the face where the discharge orifices 13 are formed, and FIG. 4B is a perspective view from the opposite side from FIG. 4A. The liquid discharge head 3 is a line-type liquid discharge head where fifteen recording element boards 10 capable of discharging recording liquid of the four colors of cyan (C), magenta (M), yellow (Y), and black (K) are arrayed on a straight line (inline layout). The liquid discharge head 3 includes 15 recording element boards 10, flexible printed circuit boards 40, and an electric wiring board 90, as illustrated in FIG. 4A. The electric wiring board 90 is provided with input terminals 91 and power supply terminals 92, the input terminals 91 and power supply terminals 92 being electrically connected to the recording element boards 10 via the electric wiring board 90 and flexible printed circuit boards 40. The input terminals 91 and power supply terminals 92 are electrically connected to a control circuit of the recording apparatus 1000, and respectively supply discharge drive signals and electric power necessary for discharging to the recording element boards 10. Consolidating the wiring by electric circuits in the electric wiring board 90 enables the number of the input terminals 91 and power supply terminals 92 to be reduced as compared with the number of recording element boards 10. This enables reducing the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 4B. Thus, recording liquid of the four colors of CMYK is supplied form the supply system of the recording apparatus 1000 to the liquid discharge head 3, and recording liquid that has passed through the liquid discharge head 3 is recovered to the supply system of the recording apparatus 1000 such as illustrated in FIG. 2 or 3. In this way, recording liquid of each color can circulate over the path of the recording apparatus 1000 and the path of the liquid discharge head 3.

Figure 5:
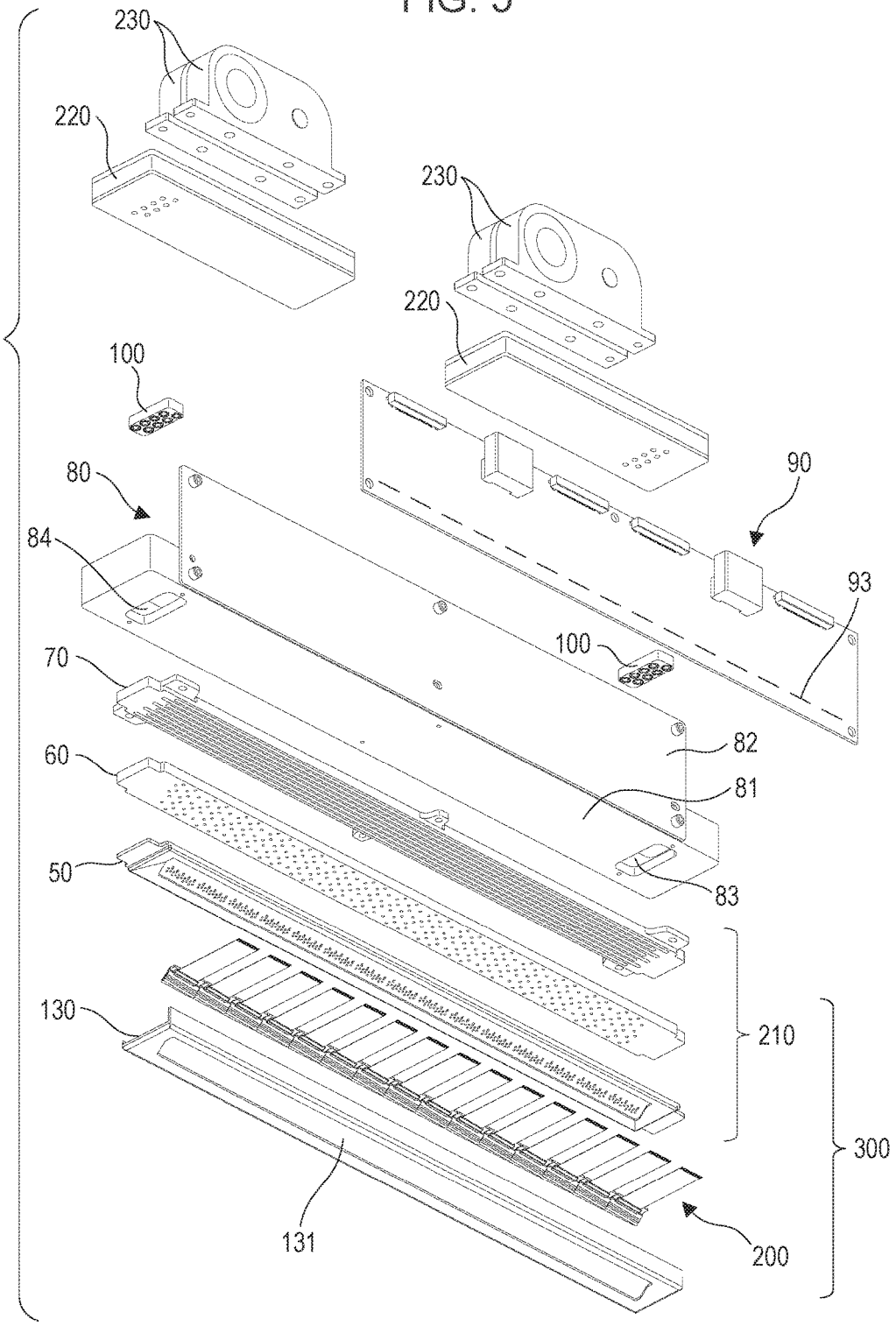
FIG. 5 is a disassembled perspective view of the liquid discharge head.

FIG. 5 illustrates a disassembled perspective view of parts and units making up the liquid discharge head 3, according to the functions thereof. The liquid discharge head 3 has a case 80, and the liquid discharge unit 300, liquid supply units 220, and electric wiring board 90 are attached to this case 80. The liquid connection portions 111 (see FIGS. 2 through 4B) are provided to the liquid supply unit 220, and filters 221 (see FIGS. 2 and 3) for each color, that communicate with each opening of the liquid connection portions 111 to remove foreign substances in the supplied recording liquid, are provided inside the liquid supply units 220. Two liquid supply units 220 and two negative pressure control units 230 are provided to one liquid discharge head 3 in the arrangement illustrated in FIG. 5. Two liquid supply units 220 are each provided with filters 221 for two colors, in the liquid discharge head 3 illustrated in FIGS. 2 and 3. The recording liquids that have passed through the filters 221 are supplied to the respective negative pressure control units 230 provided on the corresponding liquid supply units 220. Each negative pressure control unit 230 has a pressure adjustment mechanism, and markedly attenuates change in pressure drop in the supply system of the recording apparatus 1000 (supply system on the upstream side of the liquid discharge head 3) occurring due to fluctuation in the flow rate of liquid, by the operations of valve and spring members and the like provided in the pressure adjustment mechanism. Accordingly, the negative pressure control units 230 are capable of stabilizing change of negative pressure at the downstream side from themselves (liquid discharge unit 300 side) within a certain range. Each negative pressure control unit 230 for each color has two pressure adjustment valves built in, as described above, these pressure adjustment valves each being set to different control pressures. The high-pressure side pressure adjustment mechanism communicates with the common supply channel 211, and the low-pressure side pressure adjustment mechanism communicates with the common recovery channel 212.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus serves to secure relative positional accuracy of the multiple recording element boards 10, thereby suppressing unevenness in the recorded article. Accordingly, the liquid discharge unit support member 81 preferably has sufficient rigidity. Examples of suitable materials include metal materials such as stainless steel and aluminum, ceramics such as alumina, and so forth. The liquid discharge unit support member 81 has openings 83 and 84, at both ends thereof in the longitudinal direction, into which joint rubber members 100 are inserted. Liquid such as recording liquid supplied from a liquid supply unit 220 passes through a joint rubber member 100 and is guided to a third channel member 70 which is a part making up the liquid discharge unit 300.

The liquid discharge unit 300 is made up of multiple discharge modules 200 and a channel-forming member 210 supporting the multiple discharge modules 200, and a cover member 130 is attached to the face of the liquid discharge unit 300 that faces the recording medium. The cover member 130 is a member having a frame-shaped surface where a long opening 131 is provided as illustrated in FIG. 5, with the recording element boards 10 included in the discharge module 200 and a sealing member 110 (FIG. 9A) being exposed from the opening 131. The frame portion on the perimeter of the opening 131 functions as a contact surface for a cap member that caps off the liquid discharge head 3 when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel-forming member 210 included in the liquid discharge unit 300. The channel-forming member 210 distributes the liquid such as recording liquid supplied from the liquid supply unit 220 to each of the discharge modules 200, and returns liquid recirculating from the discharge modules 200 to the liquid supply unit 220. The channel-forming member 210 is an article formed by laminating a first channel member 50, a second channel member 60, and the third channel member 70, in that order, as illustrated in FIG. 5, and is fixed to the liquid discharge unit support member 81 by screws. This suppresses warping and deformation of the channel-forming member 210.

Figure 6A:
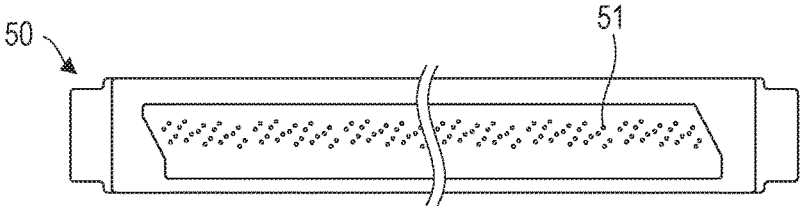
FIGS. 6A through 6F are diagrams illustrating the configuration of the front face and rear face of channel members.
Figure 6B:
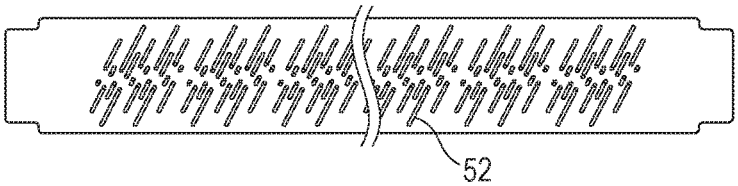
Figure 6C:
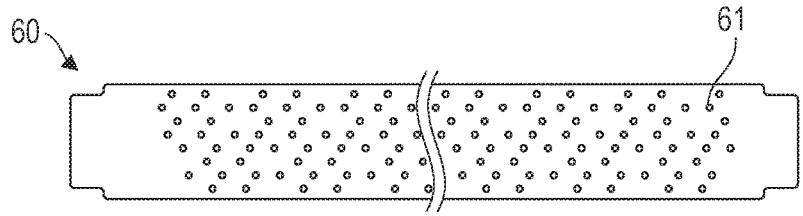
Figure 6D:
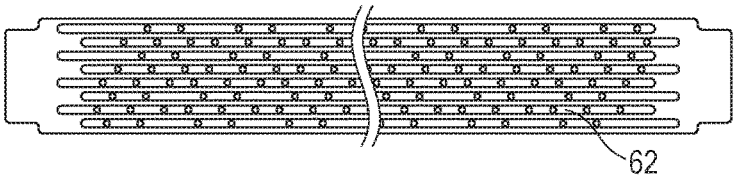
Figure 6E:
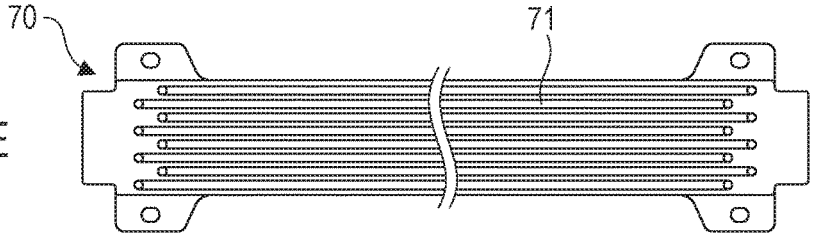
Figure 6F:
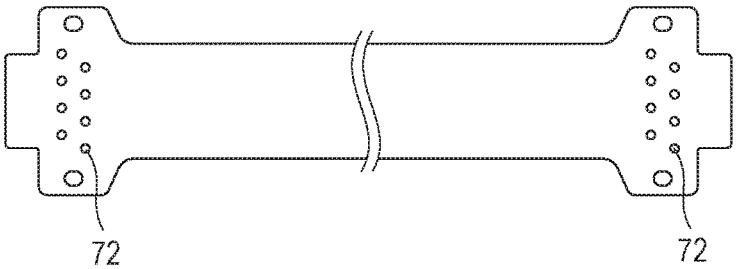
Figure 7:
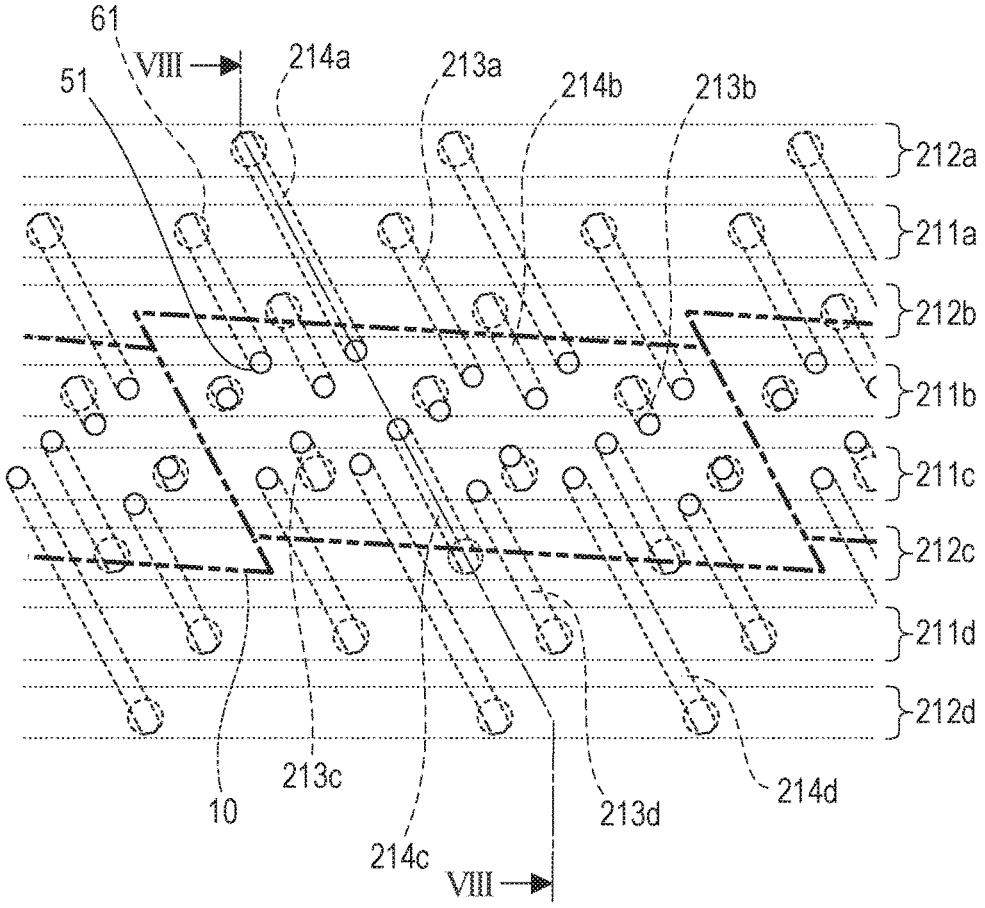
FIG. 7 is a transparent view illustrating relationships between channels.

FIGS. 6A through 6F are diagrams illustrating the front and rear sides of the channel members making up the first through third channel members 50, 60, and 70. FIG. 6A illustrates the side of the first channel member 50 on which the discharge modules 200 are mounted, and FIG. 6F illustrates the face of the third channel member 70 that comes in contact with the liquid discharge unit support member 81. FIG. 6B illustrates the contact face of the first channel member 50 as to the second channel member 60, while FIG. 6C illustrates the contact face of the second channel member 60 as to the first channel member 50. In the same way, FIG. 6D illustrates the contact face of the second channel member 60 as to the third channel member 70, and FIG. 6E illustrates the contact face of the third channel member 70 as to the second channel member 60. By adjoining the faces of the second channel member 60 and third channel member 70 illustrated in FIGS. 6D and 6E with each other form eight common channels extending in the longitudinal direction of the channel members, by common channel grooves 62 and 71 formed thereon. This forms a set of common supply channels 211 and common recovery channels 212 for each of the CMYK colors within the channel-forming member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member in the transverse direction of the first channel member 50. In the following description, When common supply channels 211 of individual colors of recording liquid are to be indicated, reference numerals 211*a* through 211*d* will be used instead of reference numeral 211, and when common recovery channels 212 of individual colors of recording liquid are to be indicated, reference numerals 212*a* through 212*d* will be used instead of reference numeral 212. In the same way, when individual supply channels 213 of individual colors of recording liquid are to be indicated, reference numerals 213*a* through 213*d* will be used instead of reference numeral 213, and when individual recovery channels 214 of individual colors of recording liquid are to be indicated, reference numerals 214*a* through 214*d* will be used instead of reference numeral 214.

The first through third channel members 50, 60, and 70, making up the channel-forming member 210, preferably are corrosion-resistant as to the recording liquid, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS), polysulfone (PSF), or denatured polyphenylene ether (PPE). The channel-forming member 210 may be formed by laminating the three channel members 50, 60, and 70 and adhering to each other using an adhesive agent, or in a case of selecting a composite material for the material, the three channel members may be joined by fusing.

Next, the connection relationship of the channels within the channel-forming member 210 will be described with reference to FIG. 7. FIG. 7 is a partially enlarged transparent view of channels within the channel-forming member 210 formed by joining the first through third channel members 50, 60, and 70, as viewed from the side of the first channel member 50 on which the discharge modules 200 are mounted. The regions in FIG. 7 surrounded by the single-dot dashed line corresponds to the regions where the recording element boards 10 are disposed. The channel-forming member 210 has, for each color, common supply channels 211*a* through 211*d* and common recovery channels 212*a* through 212*d* extending in the longitudinal direction of the liquid discharge head 3. Multiple individual supply channels 213*a* through 213*d* of each color formed of the individual channel grooves 52 are connected to the common supply channels 211*a* through 211*d* via the communication ports 61. Multiple individual recovery channels 214*a* through 214*d* of each color formed of the individual channel grooves 52 are connected to the common recovery channels 212*a* through 212*d* via the communication ports 61. This channel configuration enables recording liquid to be consolidated at the recording element boards 10 situated at the middle of the channel-forming member 210, from the common supply channels 211 via the individual supply channels 213. Recording liquid can also be recovered from the recording element boards 10 to the common recovery channels 212 via the individual recovery channels 214.

Figure 8:
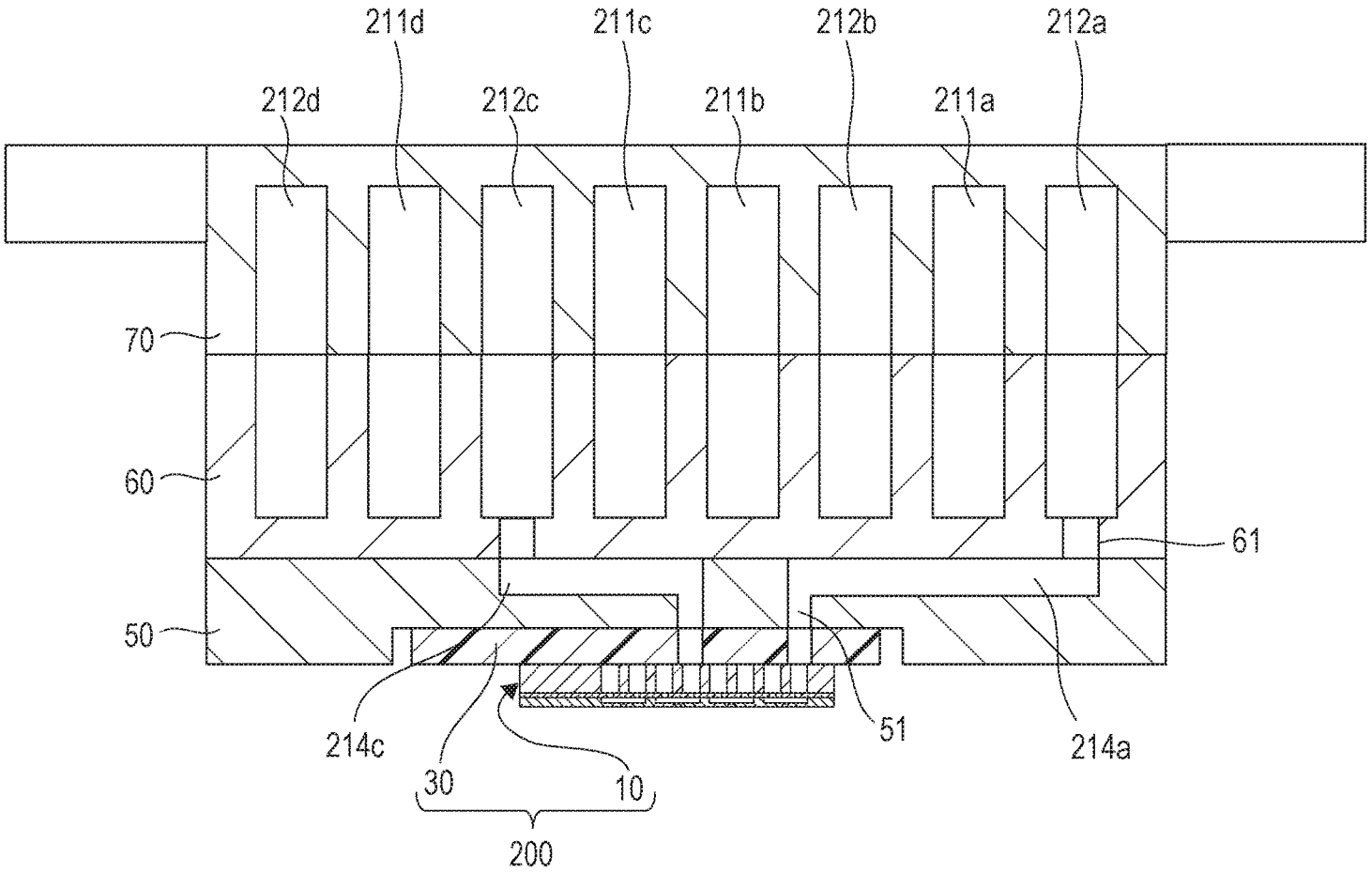
FIG. 8 is a cross-sectional view illustrating channel members and a discharge module.

FIG. 8 illustrates the cross-sectional configuration of the channel-forming member 210 and discharge module 200 along line VIII-VIII in FIG. 7. FIG. 8 illustrates that individual recovery channels 214*a* and 214*c* communicate with the discharge module 200 via the communication ports 51. Although FIG. 8 only illustrates the individual recovery channels 214*a* and 214*c*, the individual supply channels 213 and the discharge module 200 communicate at a different cross-section, as illustrated in FIG. 7. Channels for supplying recording liquid from the first channel member 50 to recording elements 15 (FIG. 10B), provided to the recording element board 10, are formed in a support member 30 included in the discharge module 200 and the recording element boards 10. Further, channels for recovering (recirculating) part or all of the liquid supplied to the recording elements 15 to the first channel member 50 are formed in the support member 30 and recording element boards 10. The common supply channels 211 of each color are connected to the high-pressure side pressure adjustment mechanism of the negative pressure control unit 230 of the corresponding color via its liquid supply unit 220. In the same way, the common recovery channels 212 are connected to the low-pressure side pressure adjustment mechanism of the negative pressure control units 230 of the corresponding color, via the liquid supply units 220. Pressure difference is generated between the common supply channels 211 and common recovery channels 212 by these pressure adjustment mechanisms in the negative pressure control units 230. Accordingly, a flow occurs for each color in the liquid discharge head 3 where the channels are connected as illustrated in FIGS. 7 and 8, in the order of common supply channel 211→individual supply channels 213→recording element board 10→individual recovery channels 214→common recovery channel 212.

Description of Discharge Module

Figure 9A:
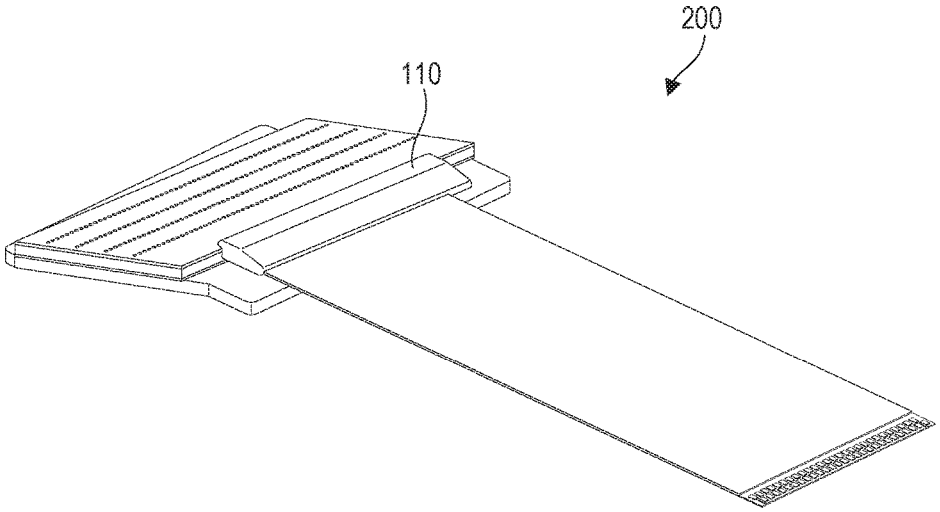
FIGS. 9A and 9B are diagrams describing a discharge module.
Figure 9B:
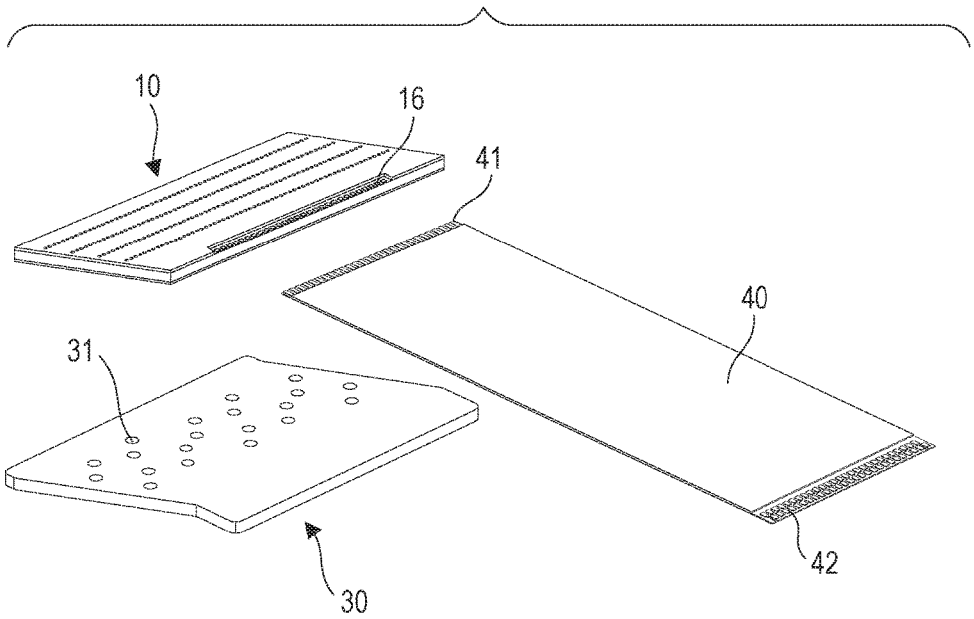

Next, the discharge module 200 will be described. FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 in which liquid communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered by a sealant 110 to seal off. Terminals 42 at the other end of the flexible printed circuit board 40 from the recording element board 10 are electrically connected to connection terminals 93 (FIG. 5) of the electric wiring board 90. The support member 30 is a support member that supports the recording element board 10, and also is a channel member communicating between the recording element board 10 and the channel-forming member 210 by fluid connection, and accordingly should have a high degree of flatness, and also should be able to be joined to the recording element board 10 with a high degree of reliability. Examples of suitable materials of the support member 30 include alumina and resin materials.

Description of Structure of Recording Element Board

Figure 10A:
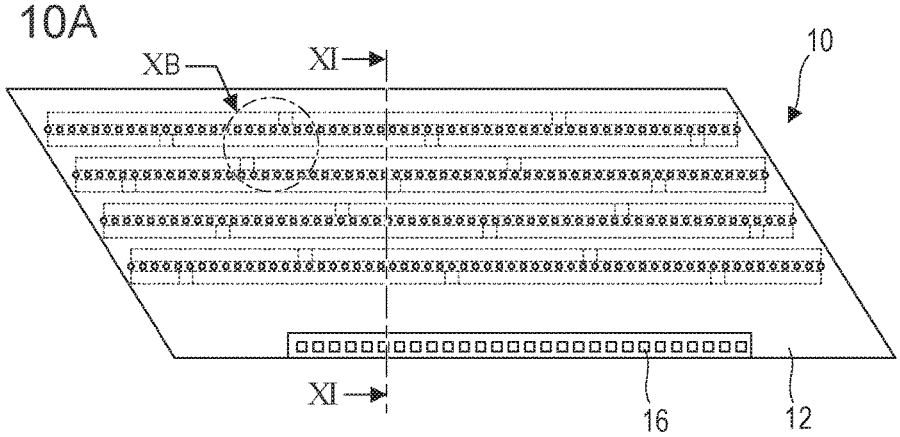
FIGS. 10A through 10C are diagrams illustrating the configuration of a recording element board.
Figure 10B:
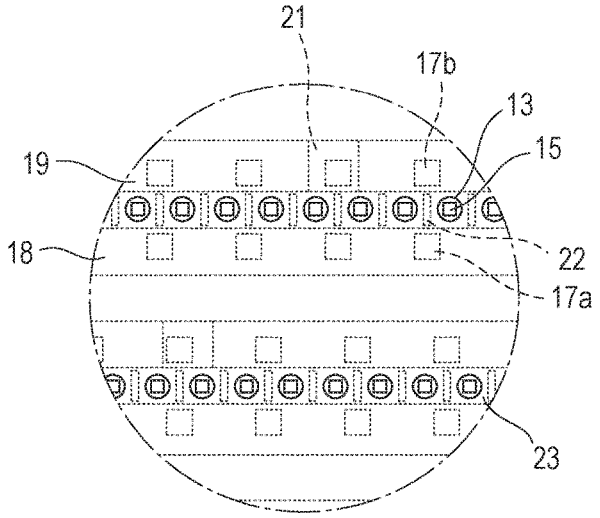
Figure 10C:
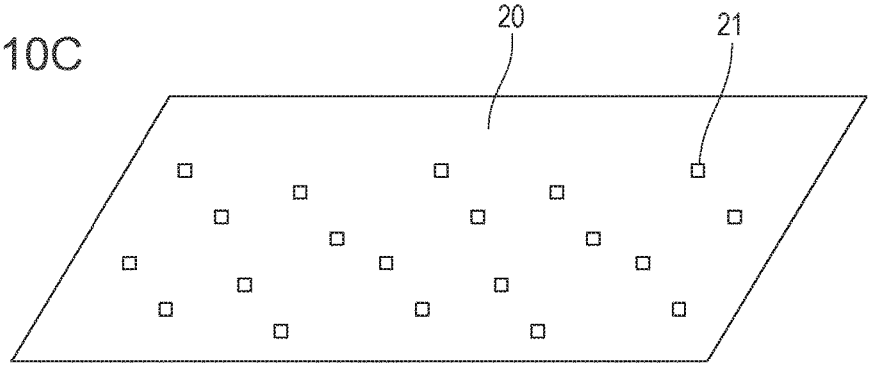

The configuration of the recording element board 10 will be described next. FIG. 10A is a plan view of the side of the recording element board 10 on which discharge orifices 13 have been formed, FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where multiple discharge orifices 13 for rows, as illustrated in FIG. 10A. Four discharge orifice rows corresponding to the four colors CMYK that are the colors of the recording liquid are formed on the discharge orifice forming member 12. Note that hereinafter, the direction in which the discharge orifice rows, where multiple discharge orifices 13 are arrayed, extend, will be referred to as "discharge orifice row direction". The recording elements 15 that are heat-generating elements to cause the liquid to bubble by thermal energy are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the liquid to boil, based on pulse signals input from a control circuit of the recording apparatus 1000, via the electric wiring board 90 (FIG. 5) and flexible printed circuit board 40 (FIG. 9B), causing the liquid in the pressure chambers 23 to boil. The force of bubbling due to this boiling discharges liquid from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively. The supply ports 17*a* and recovery ports 17*b* are provided passing through the substrate 11, and accordingly will collectively be referred to as "through ports".

Figure 11:
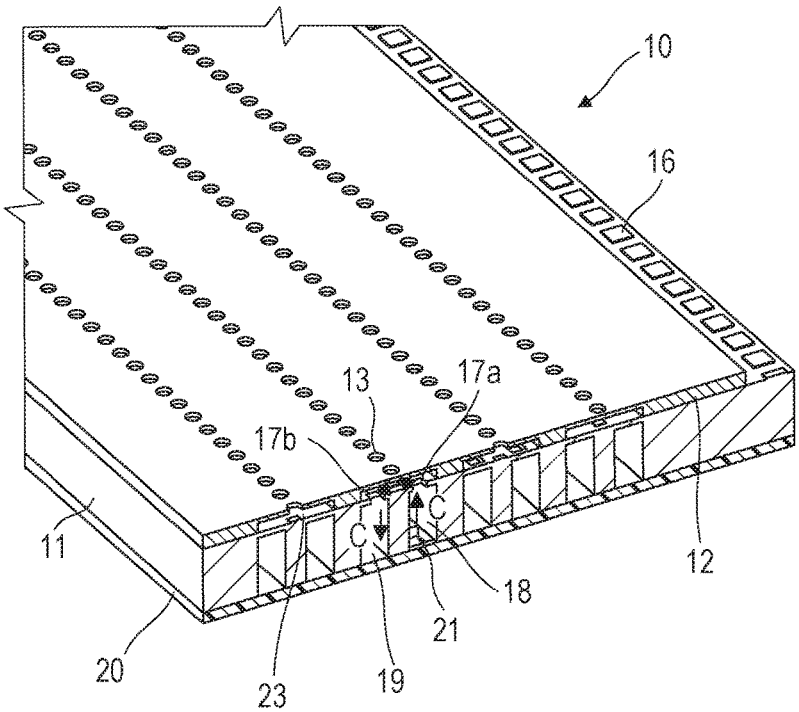
FIG. 11 is a partial cutaway perspective view illustrating the configuration recording element board.

A sheet-shaped cover 20 is laminated on the rear face from the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. In the example described here, three openings 21 are provided in the cover 20 for each liquid supply channel 18, and two openings 21 are provided for each liquid recovery channel 19. The openings 21 of the cover 20 communicate with the multiple communication ports 51 illustrated in FIG. 6A, as illustrated in FIG. 10B. The cover 20 functions as a lid making up part of the liquid supply channel 18 and liquid recovery channel 19, formed on the substrate 11 of the recording element board 10, as illustrated in FIG. 11. The cover 20 preferably is sufficiently corrosion-resistant as to liquid such as the recording liquid, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21, and the cover 20 preferably is thin, taking into consideration pressure drop, and preferably is formed of a photosensitive resin film material, particularly a photosensitive resin film.

Next, the flow of liquid within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (see FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel-forming member 210, and there is differential pressure between the liquid supply channels 18 and liquid recovery channels 19. Individual supply channels 213 and individual recovery channels 214 are formed in the first channel member 50. The individual supply channels 213 connect to the liquid supply channel 18 and common supply channel 211, and the individual recovery channels 214 connect to the liquid recovery channel 19 and common recovery channel 212. When multiple discharge orifices 13 of the liquid discharge head 3 are discharging liquid and recording, at discharge orifices not performing discharge operations this differential pressure causes the liquid in the liquid supply channel 18 to flow in the order of supply port 17*a*→pressure chamber 23→recovery port 17*b* and to the liquid recovery channel 19. This flow is indicated by arrows C in FIG. 11. This flow enables recording liquid that has thickened due to vaporization of the medium from the discharge orifices 13, bubbles, foreign substance, and so forth, to be recovered to the liquid recovery channel 19 from the discharge orifices 13 and pressure chambers 23 where recording is not being performed. This also enables thickening of recording liquid at the discharge orifices 13 and pressure chambers 23 to be suppressed. Liquid such as recording liquid recovered to the liquid recovery channels 19 is recovered in the order of the communication ports 51 in the channel-forming member 210, the individual recovery channels 214, and the common recovery channel 212, via the openings 21 of the cover 20 and the liquid communication ports 31 of the support member (see FIG. 9B). This recovered liquid is ultimately recovered to the supply path of the recording apparatus 1000.

That is to say, liquid such as recording liquid supplied from the main unit of the recording apparatus 1000 to the liquid discharge head 3 is supplied and recovered by flowing in the order described below. First, the liquid flows from the liquid connection portions 111 of the liquid supply unit 220 into the liquid discharge head 3. This liquid then is supplied to the joint rubber members 100, communication ports 72 and common channel grooves 71 provided to the third channel member 70, common channel grooves 62 and communication ports 61 provided to the second channel member 60, and individual channel grooves 52 and communication ports 51 provided to the first channel member 50. Thereafter, the liquid is supplied to the pressure chambers 23 in the order of the communication ports 31 provided to the support member 30, the openings 21 provided to the cover 20, and the liquid supply channels 18 and supply ports 17*a* provided to the substrate 11. Liquid that has been supplied to the pressure chambers 23 but not discharged from the discharge orifices 13 flows in the order of the recovery ports 17*b* and liquid recovery channels 19 provided to the substrate 11, the openings 21 provided to the cover 20, and the communication ports 31 provided to the support member 30. Thereafter, the liquid flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 100. The liquid further flows outside of the liquid discharge head 3 from the liquid connection portions 111 provided to the liquid supply unit 220. In a case where the first circulation path illustrated in FIG. 2 has been employed, liquid that has flowed in from the liquid connection portions 111 passes through the negative pressure control unit 230 and then is supplied to the joint rubber members 100. On the other hand, in a case where the second circulation path illustrated in FIG. 3 has been employed, liquid recovered from the pressure chambers 23 passes through the joint rubber members 100, and then flows out of the liquid discharge head 3 from the liquid connection portions 111 via the negative pressure control unit 230.

Also, not all liquid flowing in from one end of the common supply channel 211 of the liquid discharge unit 300 is supplied to the pressure chamber 23 via the individual supply channels 213*a*, as illustrated in FIGS. 2 and 3. There is liquid that flows from the other end of the common supply channel 211 and through the liquid supply unit 220 without ever entering the individual supply channels 213*a*. Thus, providing channels where liquid flows without going through the recording element board 10 enables backflow in the circulatory flow of liquid to be suppressed, even in a case where the recording element board 10 has fine channels where the flow resistance is great. Accordingly, the liquid discharge head 3 is capable of suppressing thickening of liquid in pressure chambers and nearby the discharge orifices, thereby suppressing deviation of discharge and non-discharge, so high image quality recording can be performed as a result.

Description of Positional Relationship Among Recording Element Boards

Figure 12:
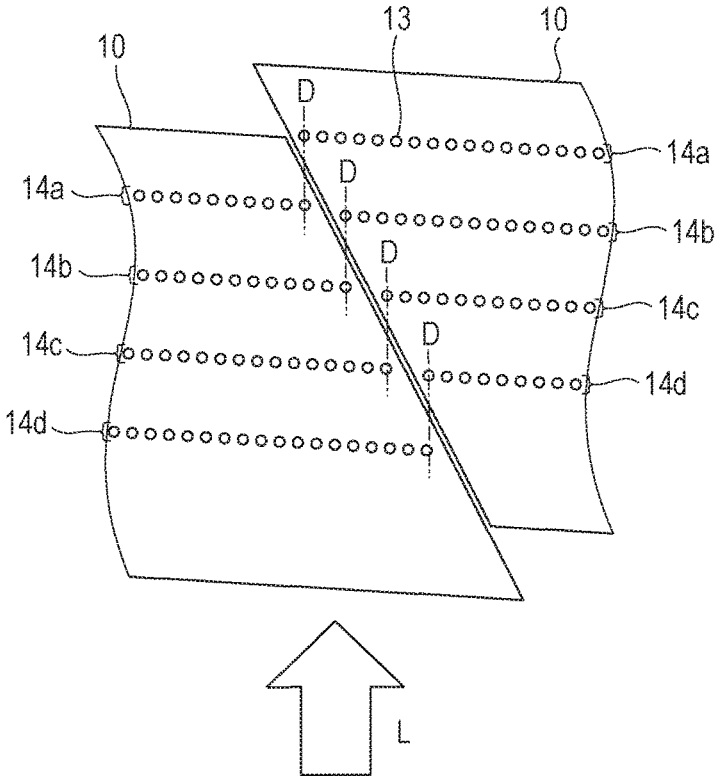
FIG. 12 is a plan view illustrating adjacent recording element boards.

The liquid discharge head 3 has multiple discharge modules 200, as described above. FIG. 12 is a partial enlargement of adjacent portions of recording element boards 10 in two adjacent discharge modules 200. The recording element boards 10 here are shaped as parallelograms, as illustrated in FIGS. 10A through 10C. The discharge orifice rows 14*a* through 14*d* where discharge orifices 13 are arrayed on the recording element boards 10 are disposed inclined to the conveyance direction L of the recording medium by a certain angle, as illustrated in FIG. 12. At least one discharge orifice of discharge orifice rows at adjacent portions of the recording element board 10 is made to overlap in the conveyance direction L of the recording medium thereby. In FIG. 12, two discharge orifices 13 on the lines D are in a mutually overlapping relationship. This layout enables black streaks and blank portions in the recorded image to be made less conspicuous by driving control of the mutually overlapping discharge orifices 13, even in a case where the positions of the recording element board 10 are somewhat deviated from the predetermined position. The configuration illustrated in FIG. 12 can be used even in a case where the multiple recording element boards 10 are laid out in a straight line (inline) instead of in a staggered arrangement. Thus, black streaks and blank portions at overlapping portions between the recording element boards 10 can be handled while suppressing increased length of the liquid discharge head 3 in the conveyance direction of the recording medium. Although the shape of the primary face of the recording element board 10 according to the present discharge orifice row is a parallelogram, this is not restrictive. The configuration of the present invention can be suitably applied even in cases where of using recording element boards 10 of which the shape is a rectangle, a trapezoid, or another shape.

Figure 30:
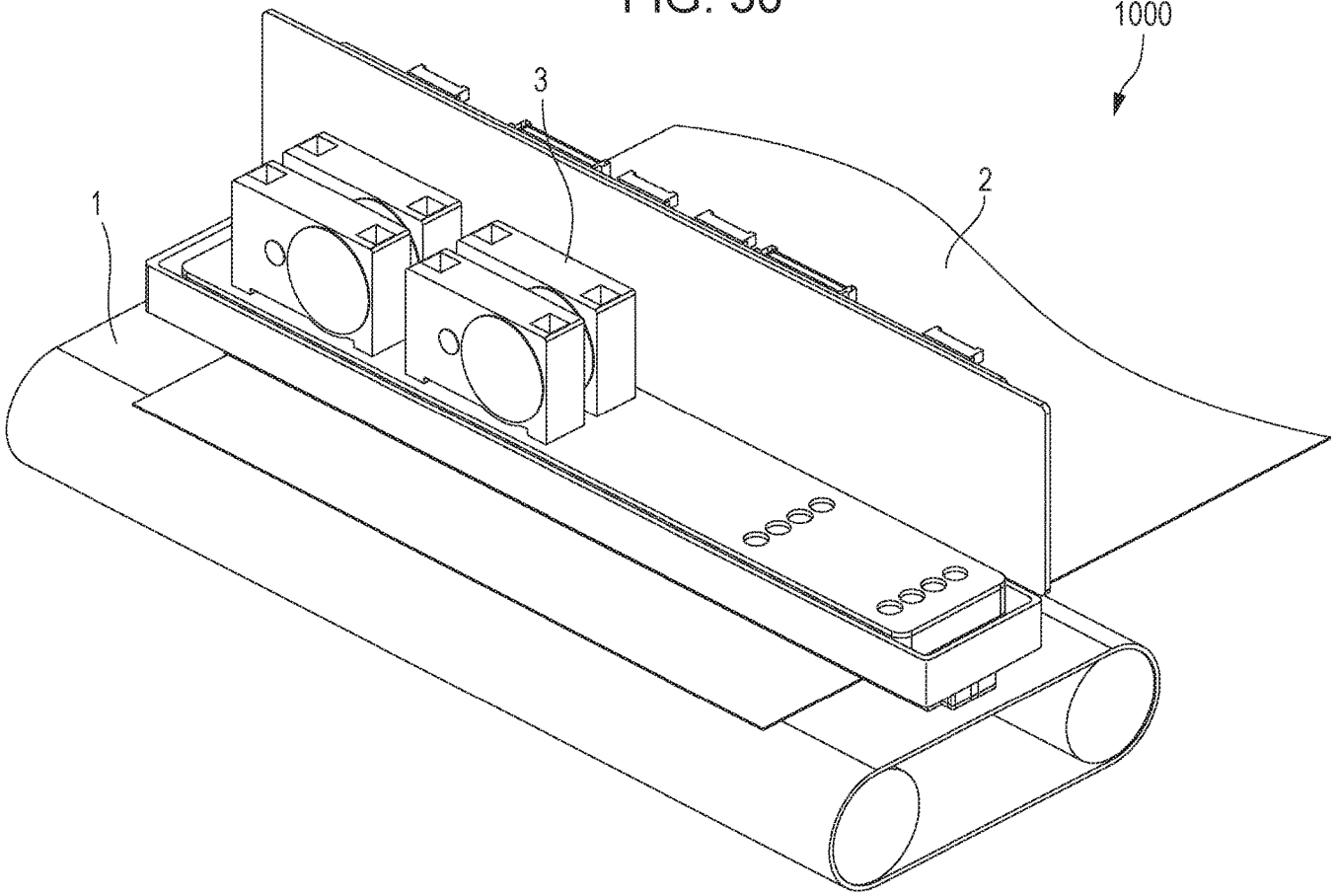
FIG. 30 is a diagram describing the liquid discharge apparatus according to the first configuration example.
Figure 32A:
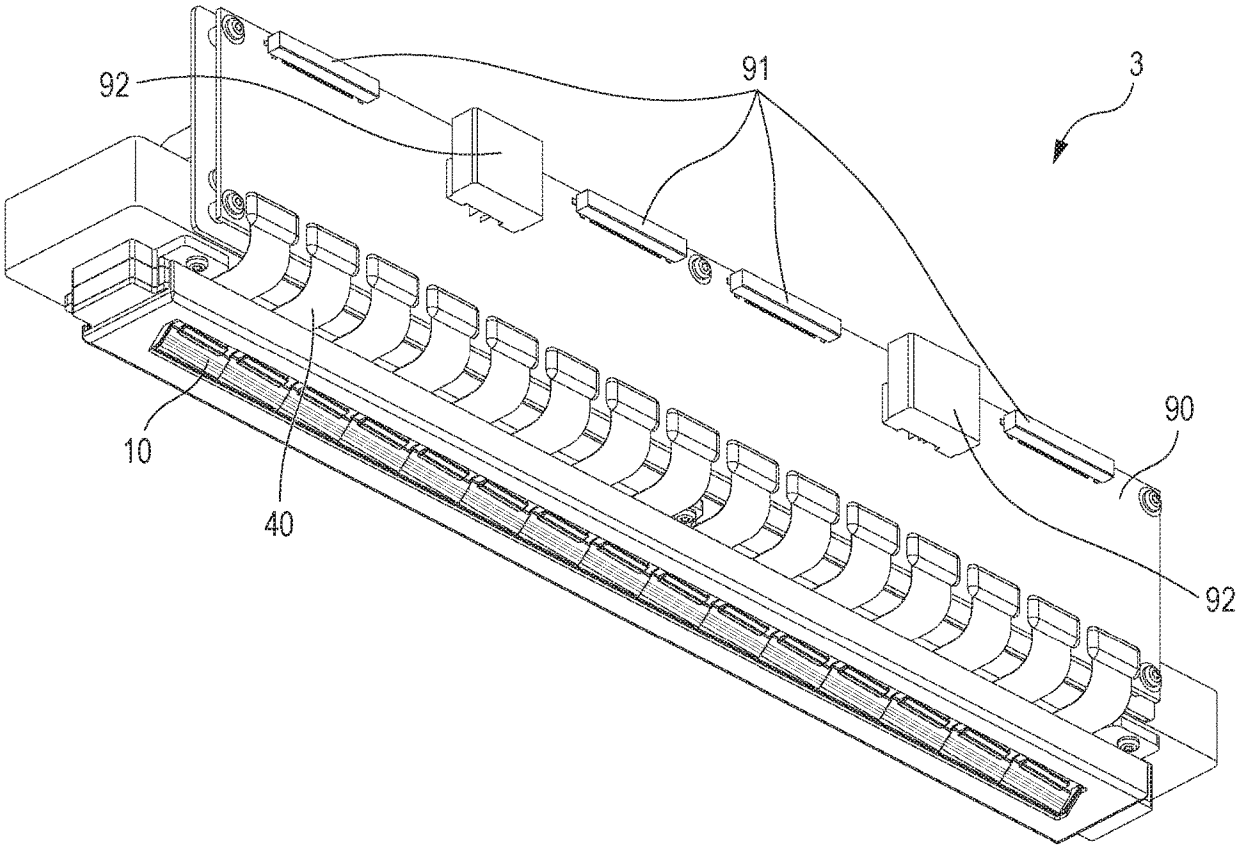
FIGS. 32A and 32B are diagrams describing a modification of the liquid discharge head according to the first configuration example.
Figure 32B:
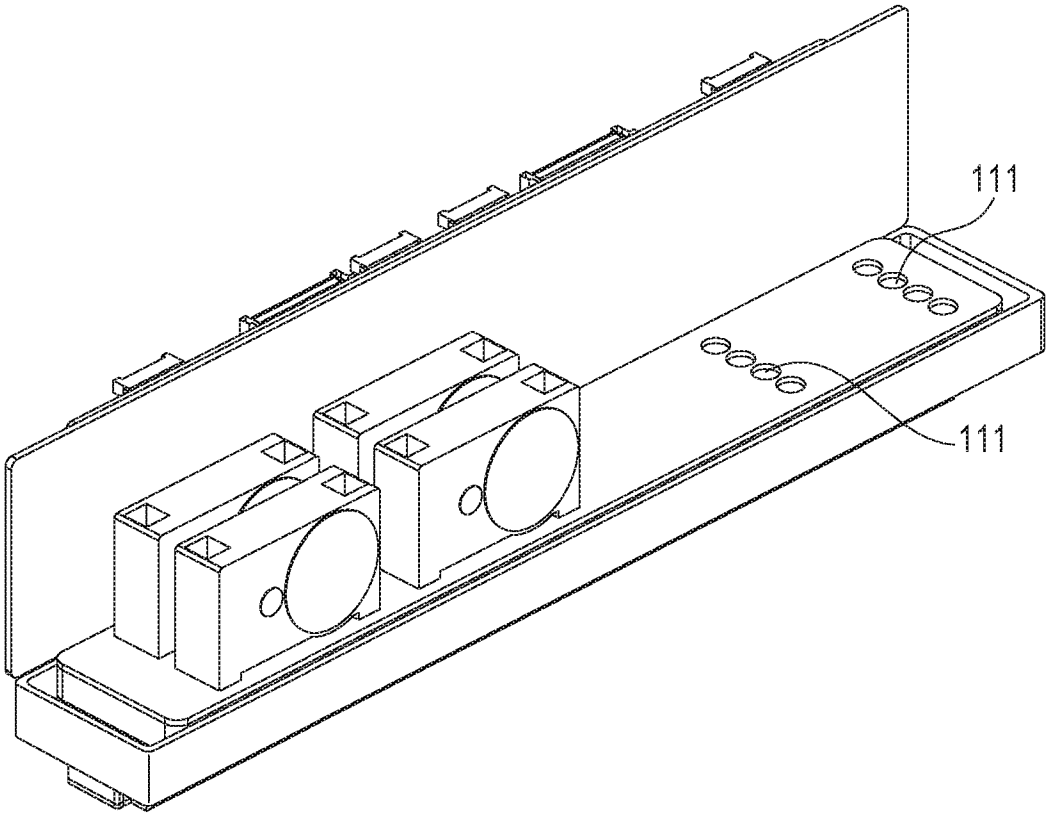
Figure 33:
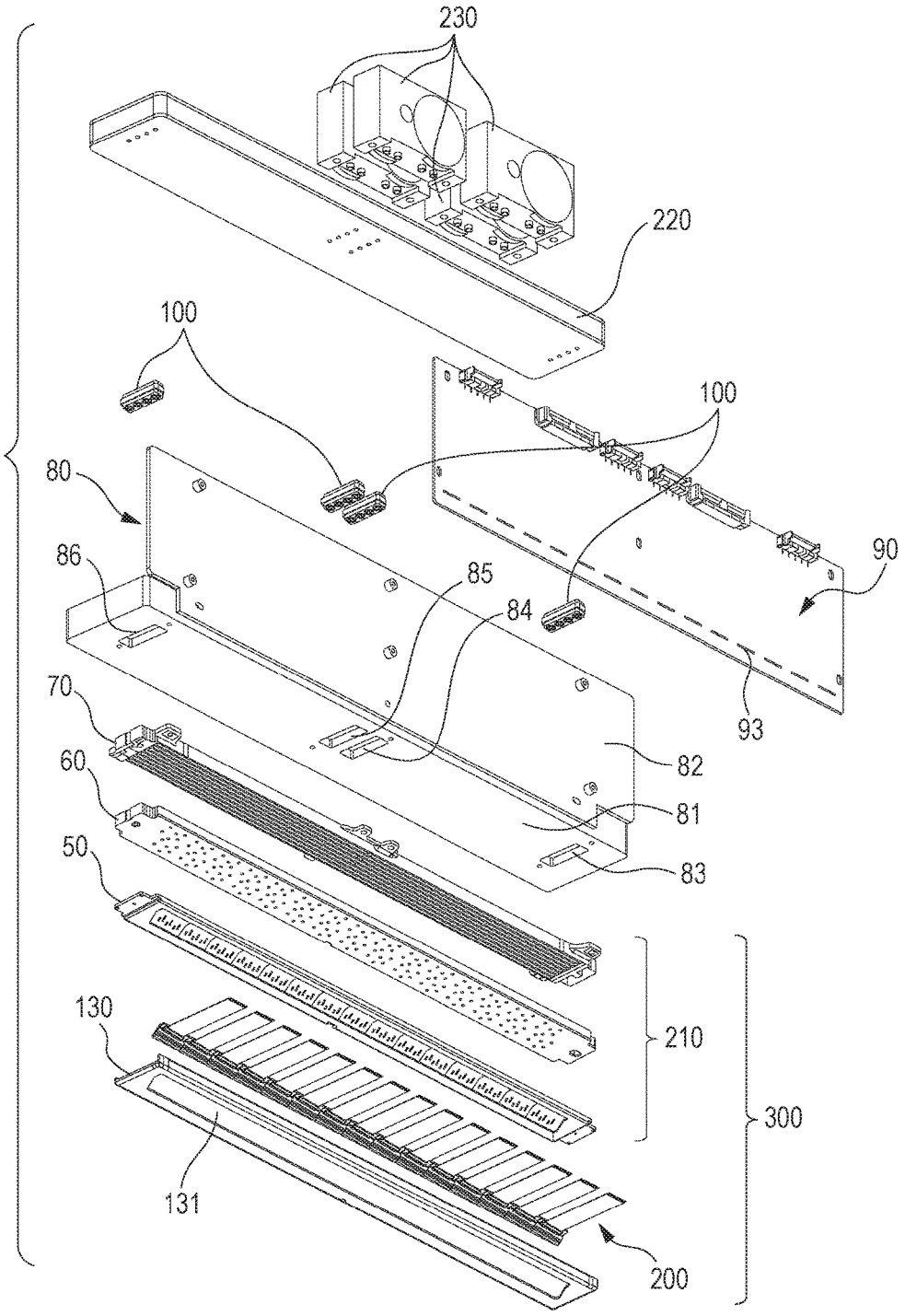
FIG. 33 is a diagram describing a modification of the liquid discharge head according to the first configuration example.

Description of Modification of Liquid Discharge Head According to First Configuration Example A modification of the above-described liquid discharge head configuration will be described with reference to FIGS. 30 and 32A through 34. Configurations and functions that are the same as the above-described example will be omitted from description, and points of difference will primarily be described. In this modification, the multiple liquid connection portions 111 that are connection portions between the outside of the liquid discharge head 3 and the liquid are disposed in a consolidated manner at one end side of the liquid discharge head 3 in the longitudinal direction, as illustrated in FIGS. 30, 32A, and 32B. Multiple negative pressure control units 230 are disposed in a consolidated manner at the other end side of the liquid discharge head 3 (FIG. 33). The liquid supply unit 220 included in the liquid discharge head 3 is configured as a long and slender unit corresponding to the length of the liquid discharge head 3, and has channels and filters 221 corresponding to the liquid of the four colors being supplied. The positions of the openings 83 through 86 provided on the liquid discharge unit support member 81 also are at different positions from the liquid discharge head 3 described above, as illustrated in FIG. 33.

Figure 34:
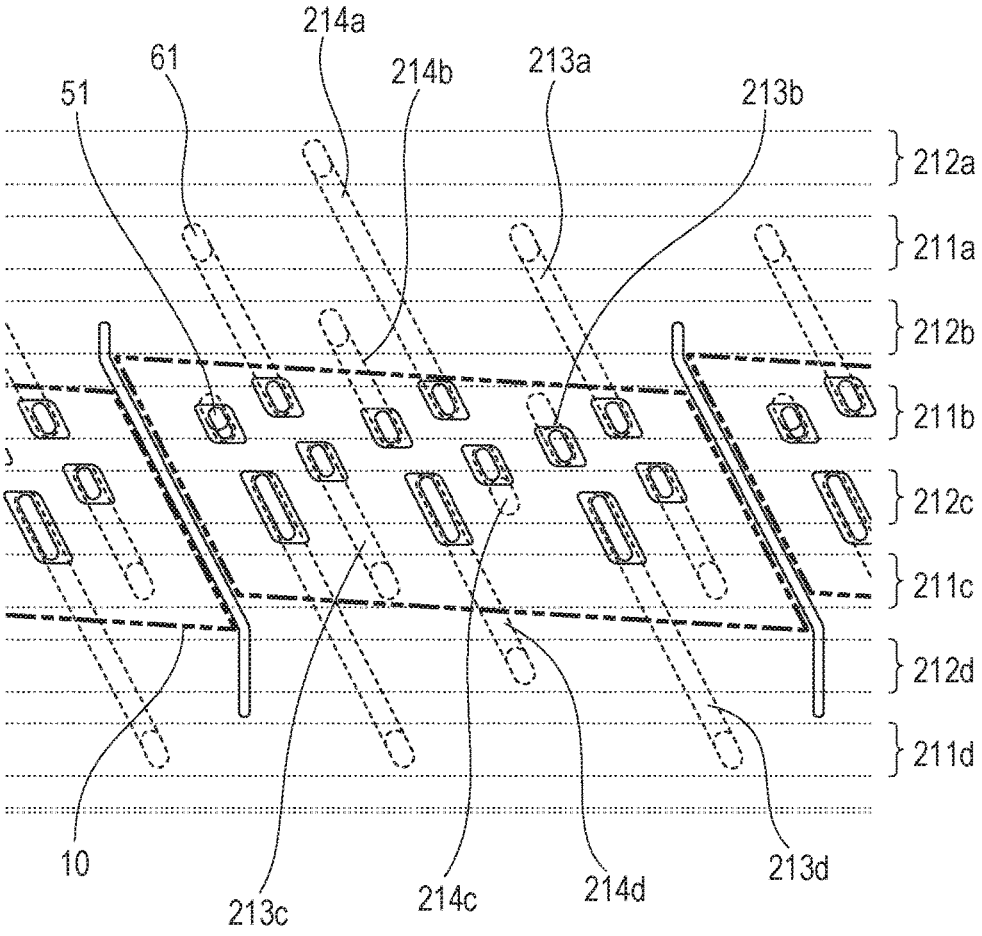
FIG. 34 is a diagram describing a modification of the liquid discharge head according to the first configuration example.

FIG. 34 illustrates the laminated states of the channel members 50, 60, and 70. Multiple recording element boards 10 are arrayed in a straight line on the upper face of the first channel member 50 that is the highest layer of the multiple channel members 50, 60, and 70. There are two individual supply channels 213 and one individual recovery channel 214 for each liquid color, as channels communicating with the openings 21 (FIG. 20C) formed on the rear side of each recording element board 10. Corresponding to this, there also are two supply openings 21 and one recovery opening 21 for each liquid color, with regard to the openings 21 formed on the cover 20 provided to the rear face of the recording element boards 10. The common supply channels 211 and common recovery channels 212 extending in the longitudinal direction of the liquid discharge head 3 are arrayed in parallel alternatingly, as illustrated in FIG. 34.

Figure 13:
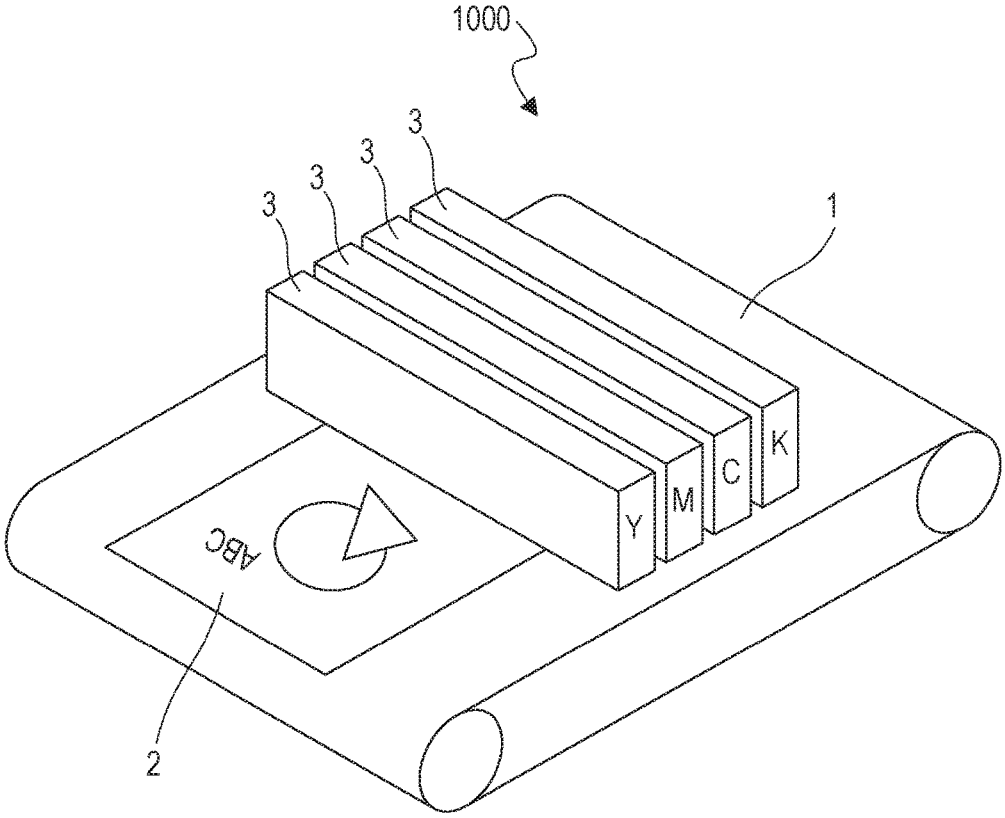
FIG. 13 is a diagram illustrating a schematic configuration of a liquid discharge apparatus according to a second configuration example.

Description of Liquid Discharge Apparatus According to Second Configuration Example The liquid discharge apparatus to which the present invention can be applied is not restricted to that in the above-described first configuration example. The configuration of an inkjet recording apparatus 1000 (hereinafter, also referred to as "recording apparatus") of a second configuration example according to the present invention will be described below. FIG. 13 illustrates a schematic configuration of the recording apparatus 1000 that is the liquid discharge apparatus according to the second configuration example. Note that portions that differ from the first configuration example will primarily be described, and portions that are the same as the first configuration example will be omitted from description.

The recording apparatus 1000 illustrated in FIG. 13 differs from the first configuration example with regard to the point that full-color recording is performed on the recording medium 2 by arraying in parallel four monochrome liquid discharge heads 3, each corresponding to one of the CMYK colors. Although the number of discharge orifice rows usable per color in the first configuration example was one row, the number of discharge orifice rows usable per color in the second configuration example is multiple (20 rows in FIG. 20A described later). This enables extremely high-speed recording to be performed, by allocating recording data to multiple discharge orifice rows. Even if there are discharge orifices that exhibit non-discharge, reliability is improved by a discharge orifice at a corresponding position in the conveyance direction L of the recording medium in another row performing discharge in a complementary manner. Accordingly, the recording apparatus 1000 according to the second configuration example is suitable for industrial printing. The supply system of the recording apparatus 1000, the buffer tank 1003, and the main tank 1006 are connected to the liquid discharge heads 3 by fluid connection, in the same way as in the first configuration example. Each liquid discharge head 3 is also electrically connected to an electric control unit that transmits electric power and discharge control signals to the liquid discharge head 3. Either of the first and second circulation arrangements illustrated in FIGS. 2 and 3 respectively, may be used in the second configuration example, in the same way as in the first configuration example.

Description of Structure of Liquid Discharge Head

Figure 14A:
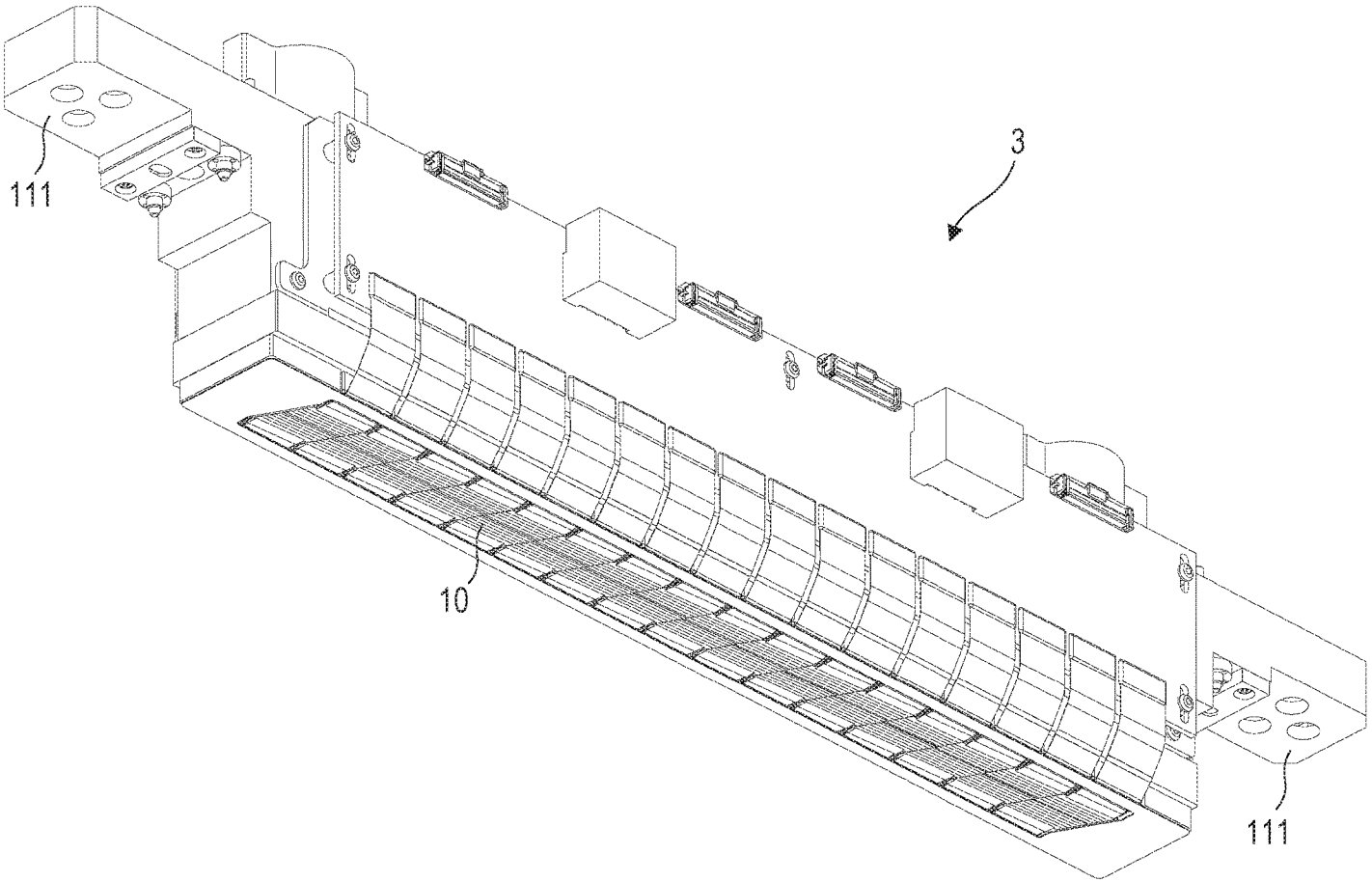
FIGS. 14A and 14B are perspective views of the liquid discharge head.
Figure 14B:
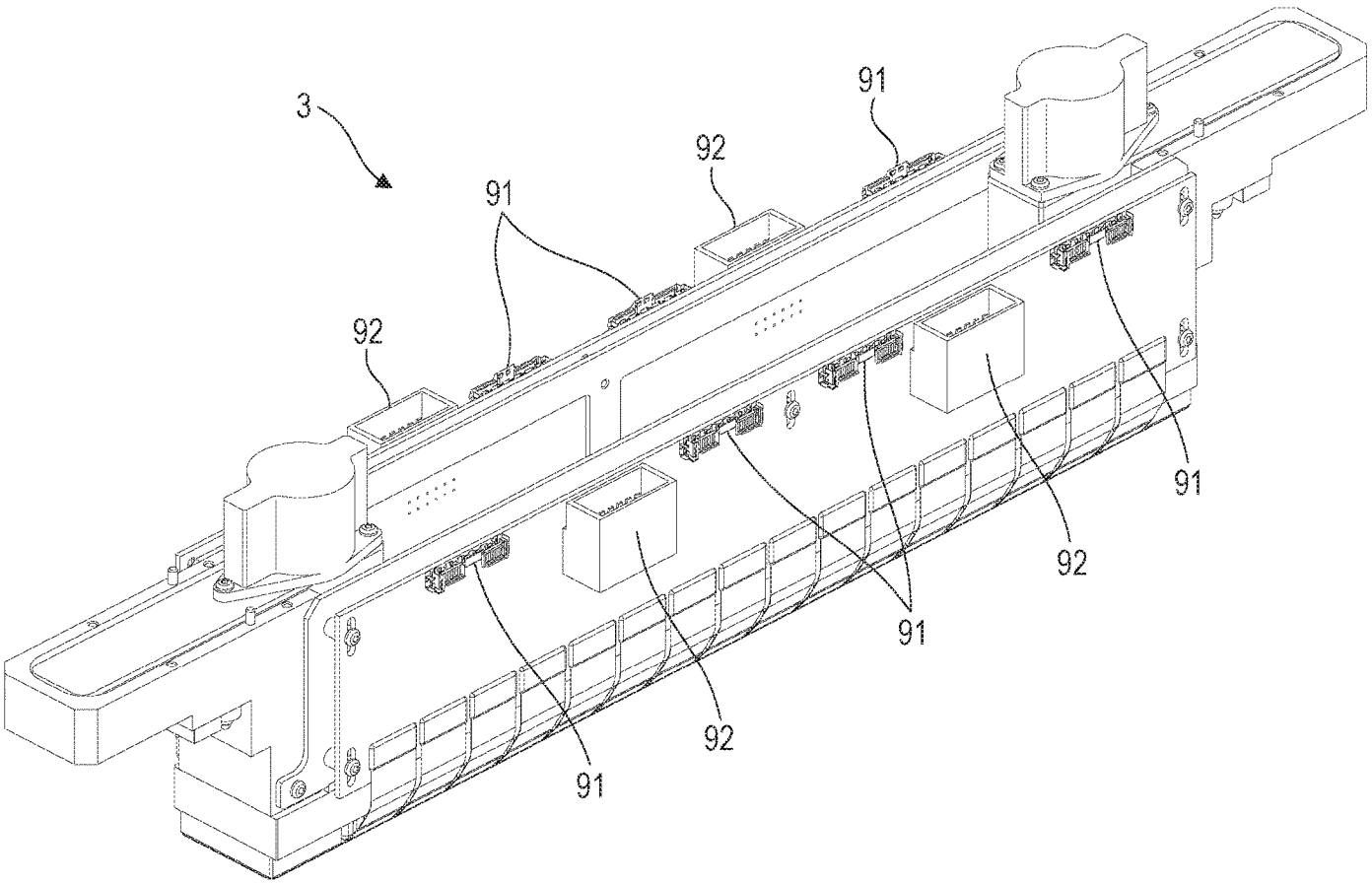

Description will be made regarding the structure of the liquid discharge head 3 according to the second configuration example with reference to FIGS. 14A and 14B. FIG. 14A is a perspective diagram of the liquid discharge head 3 as viewed from the side of the face where discharge orifices are formed. FIG. 14B is a perspective view from the opposite side from FIG. 14A. The liquid discharge head 3 has 16 recording element boards 10 arrayed in a straight line in the longitudinal direction thereof, and is an inkjet line liquid discharge head that can record with recording liquid of one color. The liquid discharge head 3 has the liquid connection portions 111, signal input terminals 91, and power supply terminals 92 in the same way as the first configuration example. However, the input terminals 91 and power supply terminals 92 are disposed on both sides of the liquid discharge head 3, since the number of discharge orifice rows is greater than that in the first configuration example. This is to reduce voltage drop and signal transmission delay that occurs at wiring portions provided to the recording element boards 10.

Figure 15:
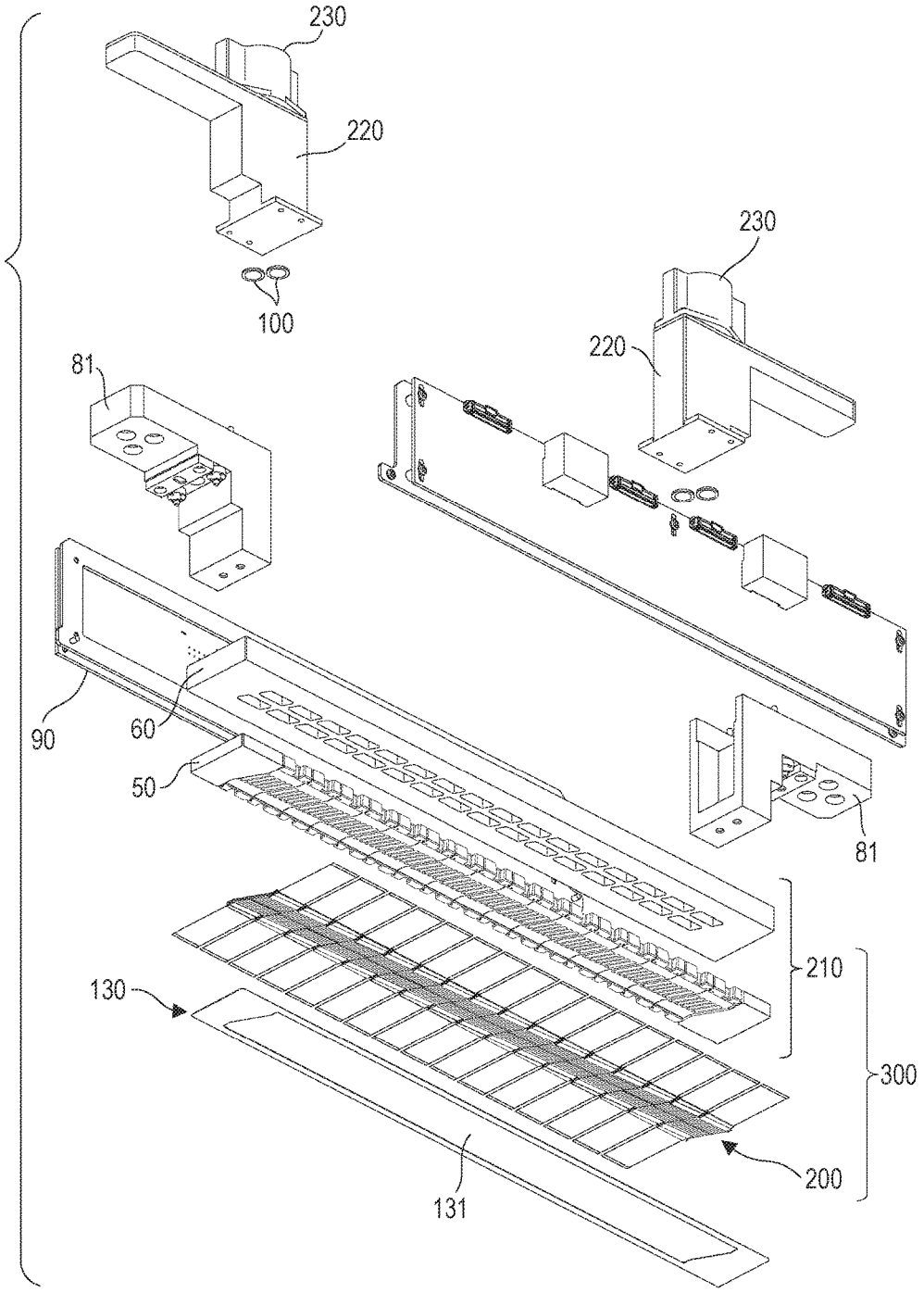
FIG. 15 is a disassembled perspective view of the liquid discharge head.

FIG. 15 is a disassembled perspective view of the liquid discharge head 3 according to the second configuration example, illustrating each part or unit making up the liquid discharge head 3 disassembled according to function. The roles of the units and members, and the order of liquid flow through the liquid discharge head 3, are basically the same as in the first configuration example, but the function by which the rigidity of the liquid discharge head is guaranteed is different. The rigidity of the liquid discharge head was primarily guaranteed in the first configuration example by the liquid discharge unit support member 81 in the second configuration example, but the rigidity of the liquid discharge head is guaranteed in the second configuration example by the second channel member 60 included in the liquid discharge unit 300. There are liquid discharge unit support members 81 connected to both ends of the second channel member 60 in the present second configuration example. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The second configuration example is not arranged for each negative pressure control unit 230 to perform two types of pressure control. One of the two negative pressure control units 230 is set to control pressure at a relatively high negative pressure, serving as a high-pressure side negative pressure control unit, and the other is set to control pressure at a relatively low negative pressure, serving as a low-pressure side negative pressure control unit. When the high-pressure side and low-pressure side negative pressure control units 230 are disposed on both ends in the longitudinal direction of the liquid discharge head 3 as illustrated in FIG. 15, the flow of liquid on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common supply channel 211 and common recovery channel 212, and accordingly unevenness in recording due to temperature difference does not readily occur.

The channel-forming member 210 of the liquid discharge unit 300 will be described in detail next. The channel-forming member 210 is the first channel member 50 and second channel member 60 that have been laminated as illustrated in FIG. 15, and distributes liquid such as recording liquid supplied from the liquid supply unit 220 to the discharge modules 200. The channel-forming member 210 also serves as a recovery channel member for returning liquid recirculating from the discharge modules 200 to the liquid supply unit 220. The second channel member 60 of the channel-forming member 210 is a member in which the common supply channel 211 and common recovery channel 212 have been formed, and also primary undertakes the rigidity of the liquid discharge head 3. Accordingly, the material of the second channel member 60 preferably is sufficiently corrosion-resistant as to the liquid such as recording liquid and has high mechanical strength. Examples of suitably-used materials include stainless steel, titanium (Ti), alumina, or the like.

Figure 16A:
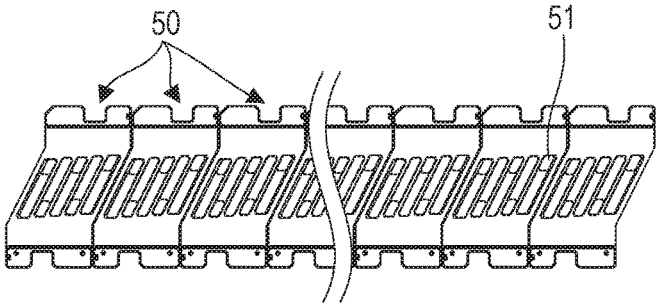
FIGS. 16A through 16E are diagrams illustrating the configuration of channel members.
Figure 16B:
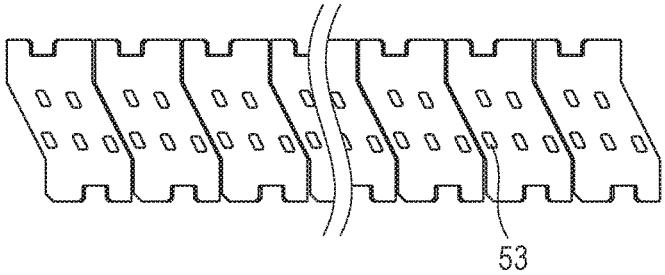
Figure 16C:
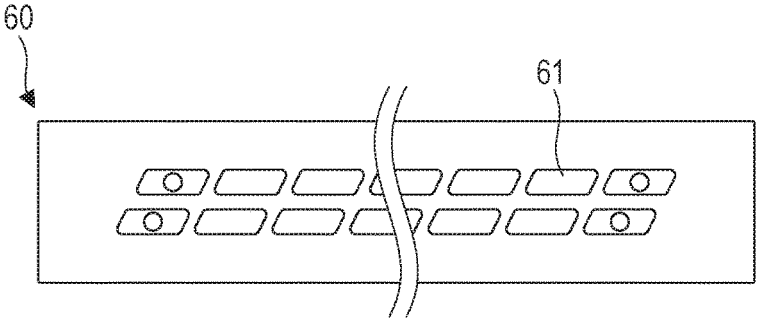
Figure 16D:
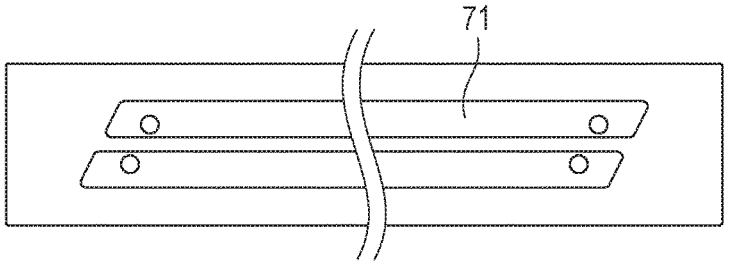
Figure 16E:
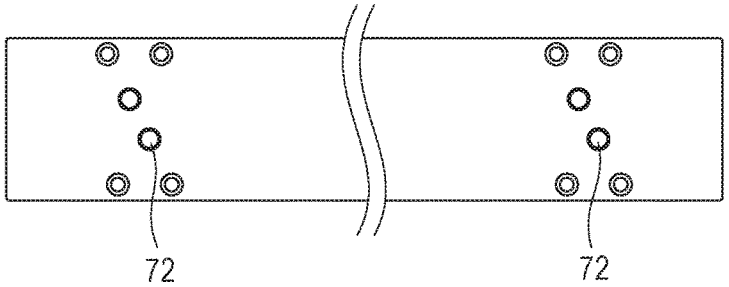

Next, details of the first channel member 50 and second channel member 60 will be described. FIG. 16A illustrates the face of the first channel member 50 on the side where the discharge modules 200 are attached, and FIG. 16B is a diagram illustrating the reverse face therefrom, that comes into contact with the second channel member 60. Unlike the case in the first configuration example, the first channel member 50 according to the second configuration example is an arrangement where multiple members corresponding to the discharge modules 200 are arrayed adjacently. Employing this divided structure enables a length corresponding to the length required for the liquid discharge head 3 to be realized, by arraying multiple such modules. This configuration can particularly be suitably used in relatively long-scale liquid discharge heads corresponding to sheets of JIS (Japanese Industrial Standards) B2 size and even larger dimensions, for example. The communication ports 51 of the first channel member 50 communicate with the discharge modules 200 by fluid connection as illustrated in FIG. 16A, and individual communication ports 53 of the first channel member 50 communicate with the communication ports 61 of the second channel member 60 by fluid connection as illustrated in FIG. 16B. FIG. 16C illustrates the face of the second channel member 60 that comes in contact with the first channel member 50, FIG. 16D illustrates a cross-section of the middle portion of the second channel member 60 taken in the thickness direction, and FIG. 16E is a diagram illustrating the face of the second channel member 60 that comes into contact with the liquid supply unit 220. The functions of the channels and communication ports of the second channel member 60 are the same as in with one color worth of recording liquid in the first configuration example. One of the common channel grooves 71 of the second channel member 60 is the common supply channel 211 illustrated in FIG. 17 and the other is the common recovery channel 212, each being supplied with liquid from one end side to the other end side in the longitudinal direction of the liquid discharge head 3. Unlike the case in the first configuration example, the longitudinal directions of the flow or liquid for the common supply channel 211 and common recovery channel 212 are mutually opposite directions in the longitudinal direction of the liquid discharge head 3 in this configuration example.

Figure 17:
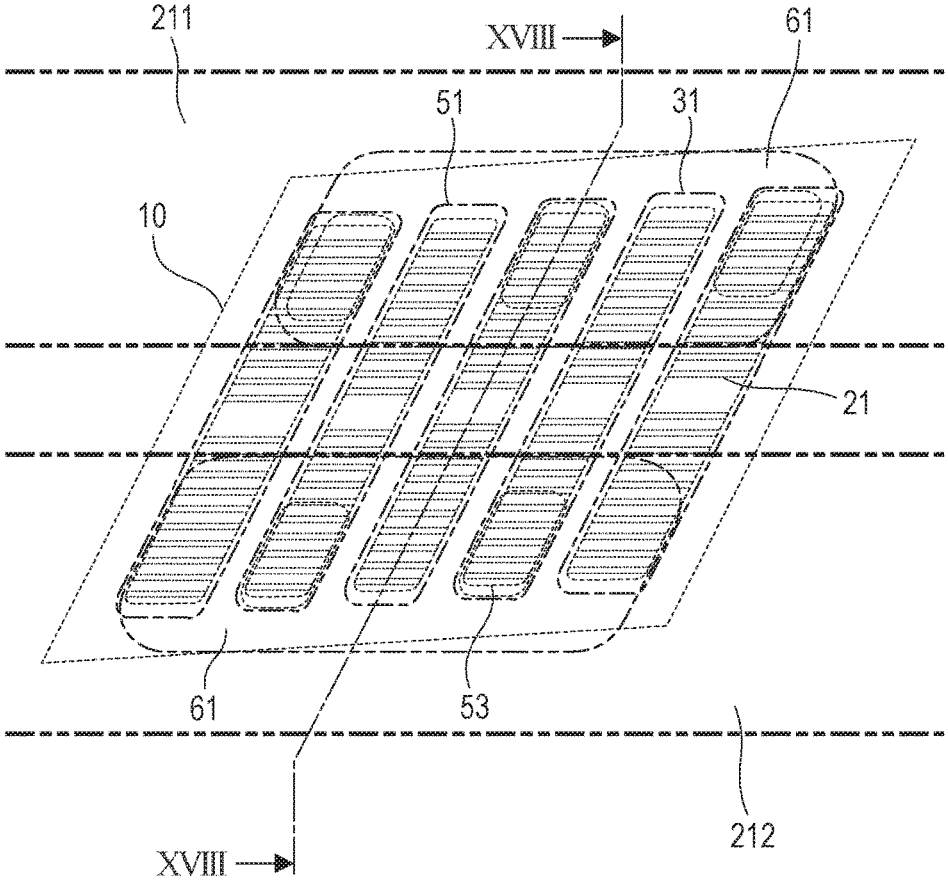
FIG. 17 is a perspective view illustrating connection relationships in the channel members.

FIG. 17 illustrates the connection relationship regarding the channels between the recording element boards 10 and the channel-forming member 210. The set of the common supply channel 211 and common recovery channel 212 extending in the longitudinal direction of the liquid discharge head 3 is provided within the channel-forming member 210, as illustrated in FIG. 17. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 18:
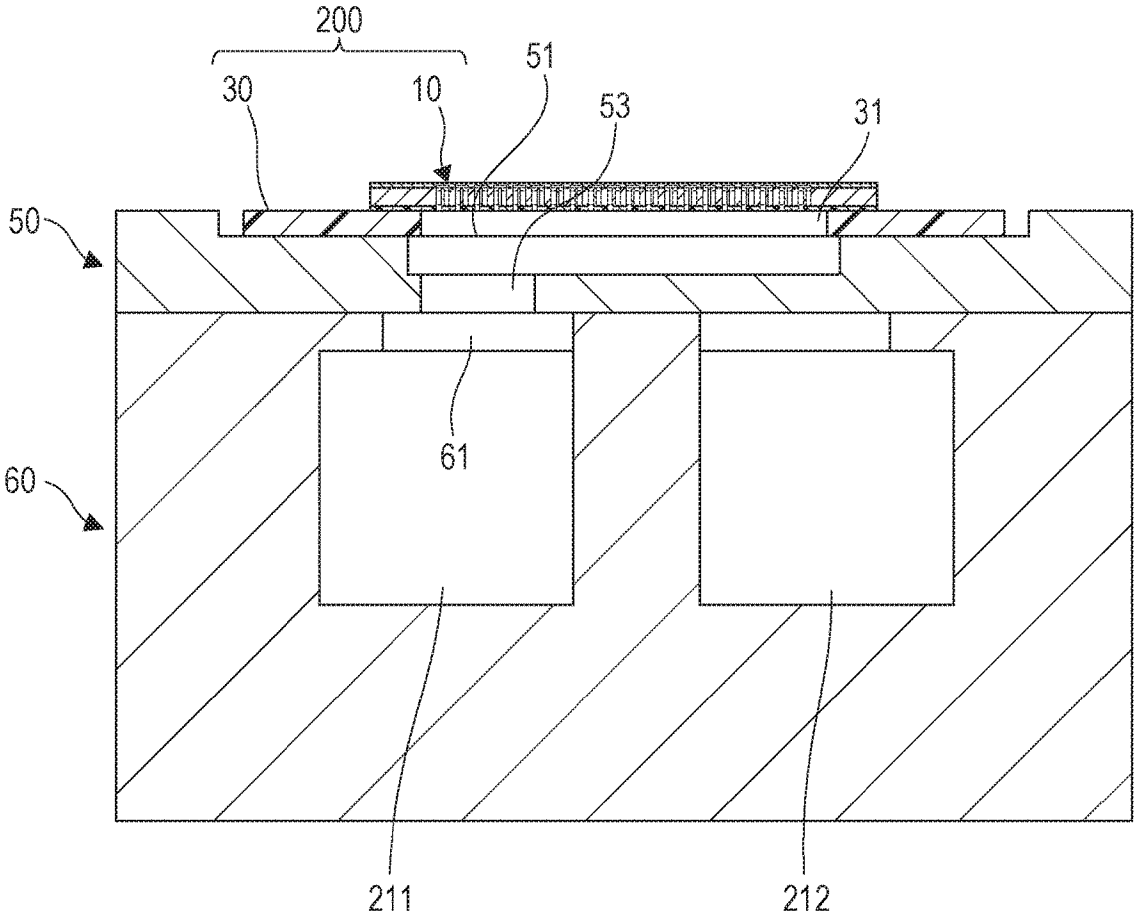
FIG. 18 is a cross-sectional view illustrating the channel members and discharge module.

FIG. 18 is a diagram illustrating a cross-section taken along XVIII-XVIII in FIG. 17. FIG. 18 shows how the common supply channel 211 connects to the discharge module 200 through the communication port 61, individual communication port 53, and communication port 51. Although omitted from illustration in FIG. 18, it can be clearly seen from FIG. 17 that another cross-section would show the common recovery channel 212 connected to the discharge module 200 through a similar path. Channels are formed on the discharge modules 200 and recording element boards 10 to communicate with the pressure chambers 23 where the discharge orifices 13 are formed. Part or all of the supplied liquid recirculates through the pressure chambers 23 corresponding to the discharge orifices 13 that are not performing discharging operations, in the same way as in the first configuration example. The common supply channel 211 is connected to the high-pressure side negative pressure control unit 230, and the common recovery channel 212 to the low-pressure side negative pressure control unit 230, via the liquid supply unit 220, in the same way as in the first configuration example. Accordingly, a flow is generated by the differential pressure generated by the negative pressure control units 230, that flows from the common supply channel 211 through the pressure chambers 23 of the recording element board 10 to the common recovery channel 212.

Description of Discharge Module

Figure 19A:
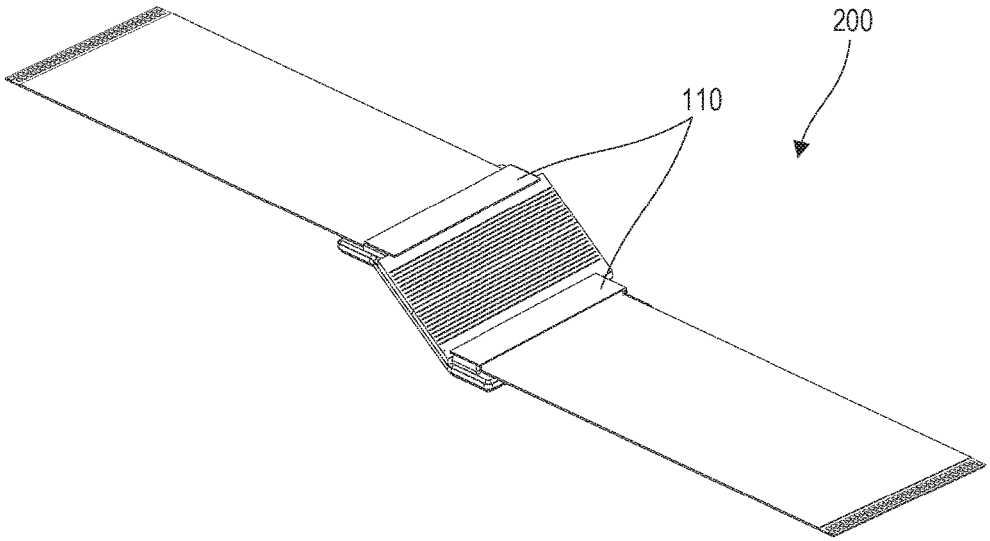
FIGS. 19A and 19B are diagrams describing the discharge module.
Figure 19B:
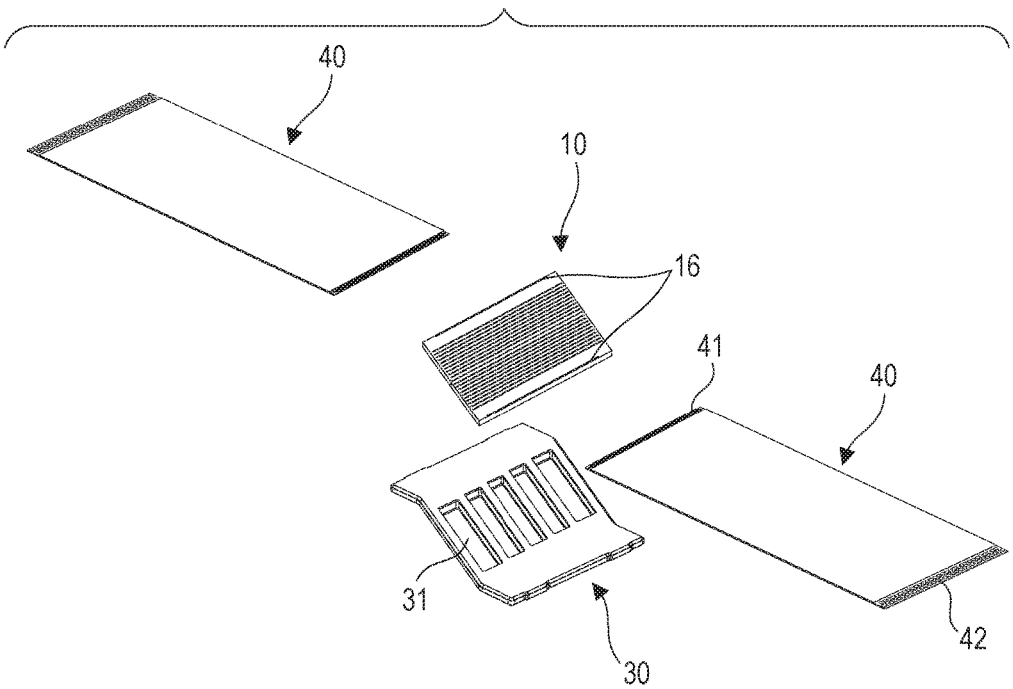

Next, the discharge module 200 according to the second configuration example will be described. FIG. 19A is a perspective view of a discharge module 200, and FIG. 19B is a disassembled view thereof. The difference as to the first configuration example is the point that multiple terminals 16 are disposed arrayed on both sides (the long side portions of the recording element board 10) following the direction of the multiple discharge orifice rows of the recording element board 10. Another point is that two flexible printed circuit boards 40 are provided to one recording element board 10 and are electrically connected to the terminals 16. The reason is that the number of discharge orifice rows provided on the recording element board 10 is 20 rows, which is an increase over the four rows in the first configuration example. That is to say, the object is to keep the maximum distance from the terminals 16 to the recording elements 15 provided corresponding to the discharge orifice row short, thereby reducing voltage drop and signal transmission delay that occurs at wiring portions provided to the recording element board 10. Liquid communication ports 31 of the support member 30 are provided to the recording element board 10, and are opened so as to span all discharge orifice rows. Other points are the same as in the first configuration example.

Description of Structure of Recording Element Board

Figure 20A:
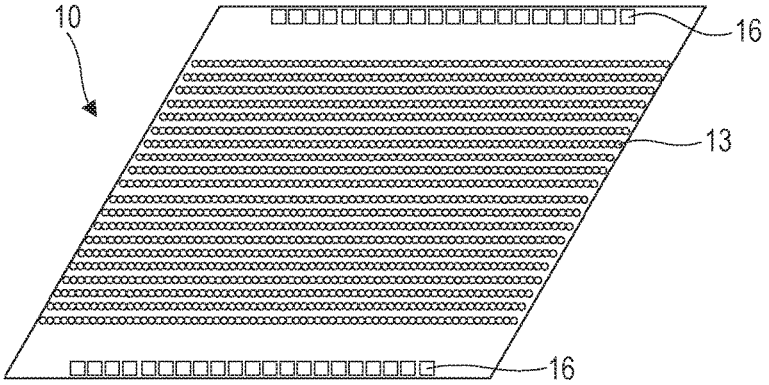
FIGS. 20A through 20C are diagrams illustrating the configuration of the recording element board.
Figure 20B:
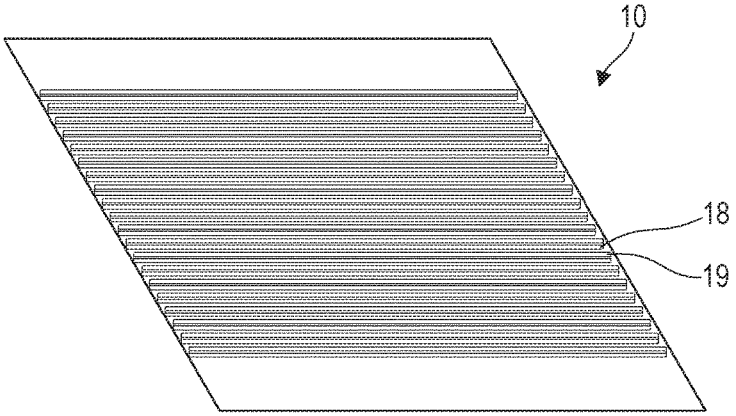
Figure 20C:
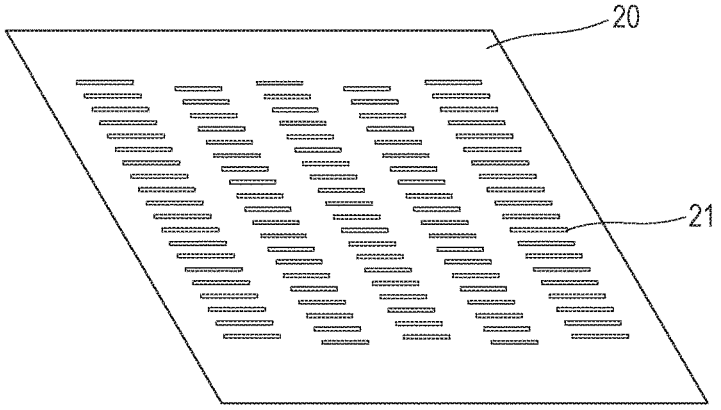

Next, the configuration of the recording element board 10 according to the second configuration example will be described. FIG. 20A is a plan view illustrating the face of the recording element board 10 on the side where the discharge orifices 13 are disposed, FIG. 20B is a diagram illustrating a portion where liquid supply channels 18 and liquid recovery channels 19 are formed, and FIG. 20C is a plan view illustrating the reverse face of that illustrated in FIG. 20A. FIG. 20B is a schematic diagram illustrating the face of the recording element board 10 in a state where the cover 20 provided on the rear face side of the recording element board 10 is removed in FIG. 20C. Liquid supply channels 18 and liquid recovery channels 19 are alternately provided on the rear face of the recording element board 10 following the discharge orifice row direction, as illustrated in FIG. 20B. Despite the number of discharge orifice rows being much greater than that in the first configuration example, a substantial difference from the first configuration example is that the terminals 16 are disposed on both side portions of the recording element board 10 following the discharge orifice row direction, as described above. The basic configuration is the same as that in the first configuration example, such as one set of a liquid supply channel 18 and liquid recovery channel 19 being provided for each discharge orifice row, openings 21 that communicate with the liquid communication ports 31 of the support member 30 being provided to the cover 20, and so forth.

Description of Third Configuration Example

The configuration of an inkjet recording apparatus 1000 and liquid discharge head 3 according to a third configuration example will be described. The liquid discharge head 3 according to the third configuration example is a page-wide head that records a B2 size recording medium sheet with a single scan. The third configuration example is similar to the second configuration example with regard to many points, so points of difference as to the second configuration example will primarily be described below, and portions that are the same as the second configuration example will be omitted from description.

Description of Inkjet Recording Apparatus

Figure 35:
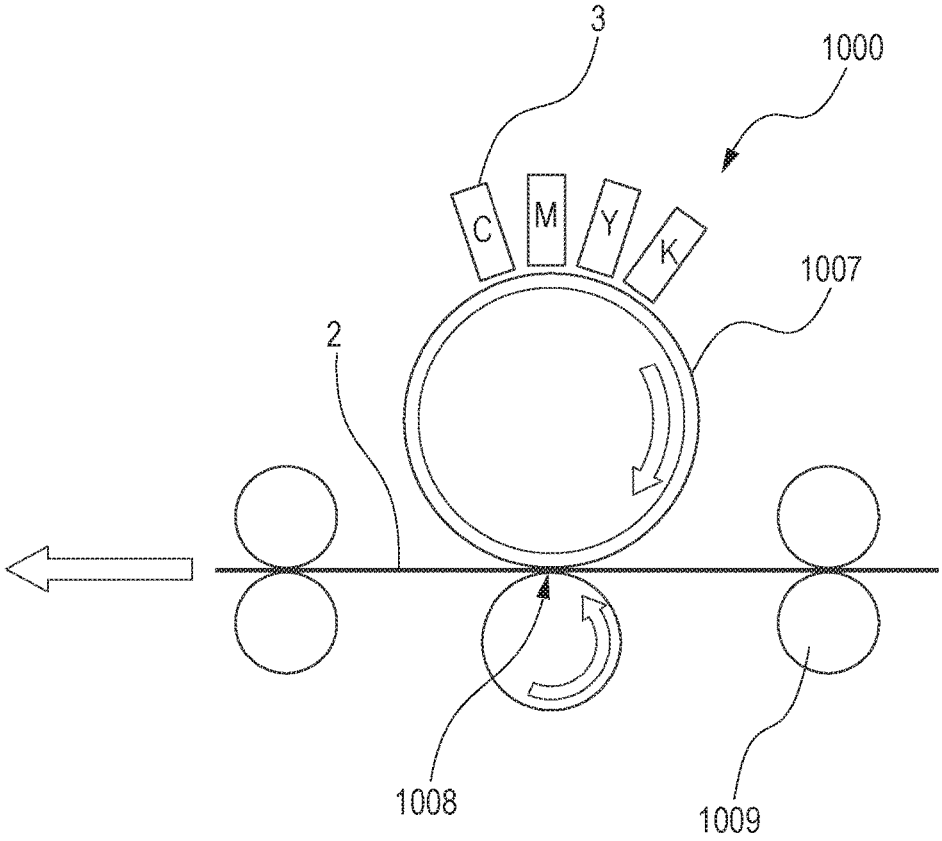
FIG. 35 is a diagram describing a liquid discharge apparatus according to a third configuration example.

FIG. 35 is a schematic diagram of an inkjet recording apparatus according to the present configuration example. The recording apparatus 1000 is of a configuration that does not directly record on the recording medium from the liquid discharge head 3, but rather discharges liquid on an intermediate transfer member (intermediate transfer drum 1007) and forms an image, following which the image is transferred onto the recording medium 2. The recording apparatus 1000 has four monochrome liquid discharge heads 3 corresponding to the four types of ink of CMYK, disposed in an arc following the intermediate transfer drum 1007. Thus, full-color recording is performed on the intermediate transfer member, the recorded image is dried to a suitable state on the intermediate transfer member, and then transferred by a transfer unit 1008 onto the recording medium 2 conveyed by a sheet conveyance roller 1009. Whereas the sheet conveyance system in the second configuration example was horizontal conveyance with the intent of primarily conveying cut sheets, the present configuration example is capable of handling continuous sheets supplied from a main roll (omitted from illustration). This sort of drum conveyance system can easily convey sheets with a certain tension applied, so there is less conveyance jamming when performing high-speed recording. Thus, the reliability of the apparatus improves, and is suitable for application to business printing and the like. The supply system of the recording apparatus 1000, the buffer tank 1003, and the main tank 1006 are connected to the liquid discharge heads 3 by fluid connection, in the same way as in the first and second configuration examples. Each liquid discharge head 3 is also electrically connected to an electric control unit that transmits electric power and discharge control signals to the liquid discharge head 3.

Description of Fourth Circulation Arrangement

Figure 36:
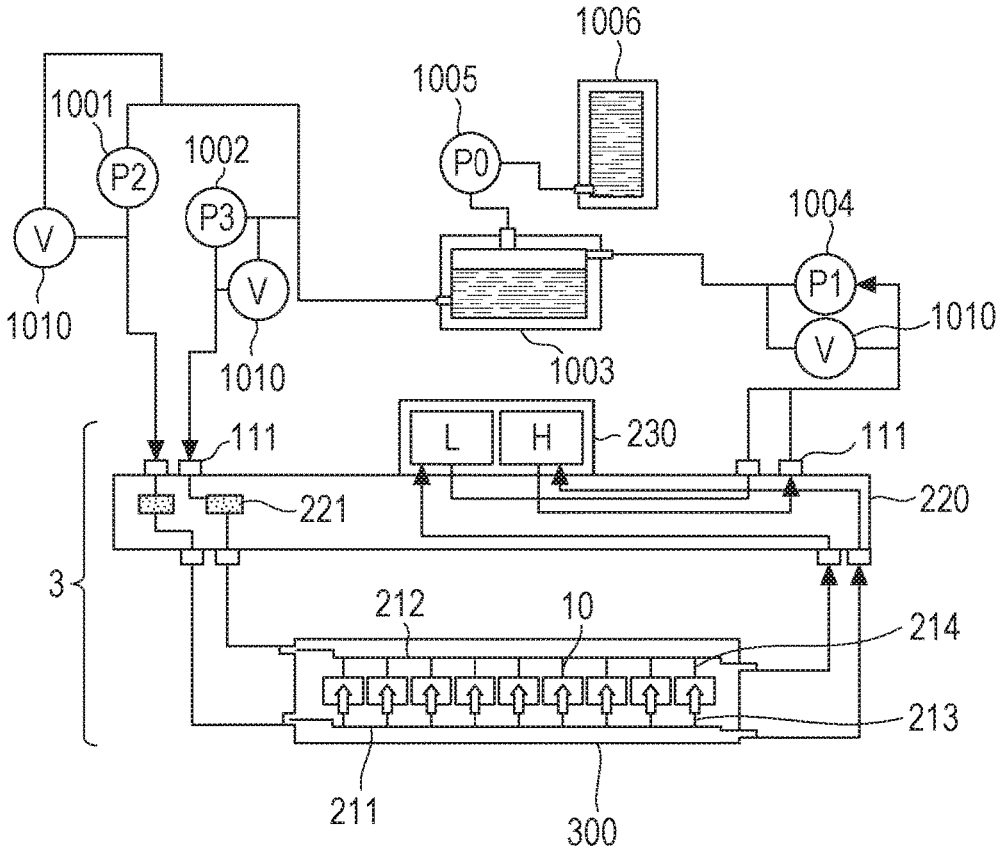
FIG. 36 is a diagram illustrating a fourth circulation arrangement.

Although the first and second circulation arrangements illustrated in FIGS. 2 and 3 between the tanks of the recording apparatus 1000 and the liquid discharge head 3 are applicable as liquid circulation arrangements in the same way as in the second configuration example, a circulation arrangement illustrated in FIG. 36 is suitable. A primary difference as to the second circulation arrangement in FIG. 3 is that bypass valves 1010 are added that communicate with channels of each of the first circulation pumps 1001 and 1002 and the second circulation pump 1004. The bypass valves 1010 function to lower pressure at the upstream side of the bypass valve 1010 (first function), due to the valve opening when pressure exceeds a preset pressure. The bypass valves 1010 also function to open and close valves at a predetermined timing by signals from a control board at the recording apparatus main unit (second function).

According to the first function, excessively large or excessively small pressure can be kept from being applied to the channel at the downstream side of the first circulation pumps 1001 and 1002 and the upstream side of the second circulation pump 1004. For example, in a case where the functions of the first circulation pumps 1001 and 1002 malfunction, excessive flow rate or pressure may be applied to the liquid discharge head 3. This may cause liquid to leak from the discharge orifices 13 of the liquid discharge head 3, or joined portions within the liquid discharge head 3 to be damaged. However, in a case where bypass vales are added to the first circulation pumps 1001 and 1002 as in the present configuration example, opening the bypass valves 1010 releases the liquid path to the upstream side of the circulation pumps, so trouble such as that described above can be suppressed, even if excessive pressure occurs.

Also, due to the second function, when stopping circulation operations, all bypass valves 1010 are quickly opened after the first circulation pumps 1001 and 1002 and second circulation pump 1004 stop, based on control signals from the main unit side. This allows the high negative pressure (e.g., several kPa to several tens of kPa) at the downstream portion of the liquid discharge head 3 (between the negative pressure control unit 230 and the second circulation pump 1004) to be released in a short time. In a case of using a positive-displacement pump such as a diaphragm pump as the circulation pump, a check valve usually is built into the pump. However, opening the bypass valves 1010 enables pressure release at the downstream side of the liquid discharge head 3 to be performed from the downstream buffer tank 1003 side as well. Although pressure release of the downstream side of the liquid discharge head 3 can be performed just from the upstream side as well, there is pressure drop in the channels at the upstream side of the liquid discharge head 3 and the channels within the liquid discharge head 3. Accordingly, there is the concern that pressure discharge may take time, the pressure within the common channel within the liquid discharge head 3 may temporarily drop too far, and the meniscus at the discharge orifices may be destroyed. Opening the bypass valves 1010 at the downstream side of the liquid discharge head 3 promotes pressure discharge at the downstream side of the liquid discharge head 3, so the risk of destruction of the meniscus at the discharge orifices is reduced.

Description of Structure of Liquid Discharge Head

Figure 37A:
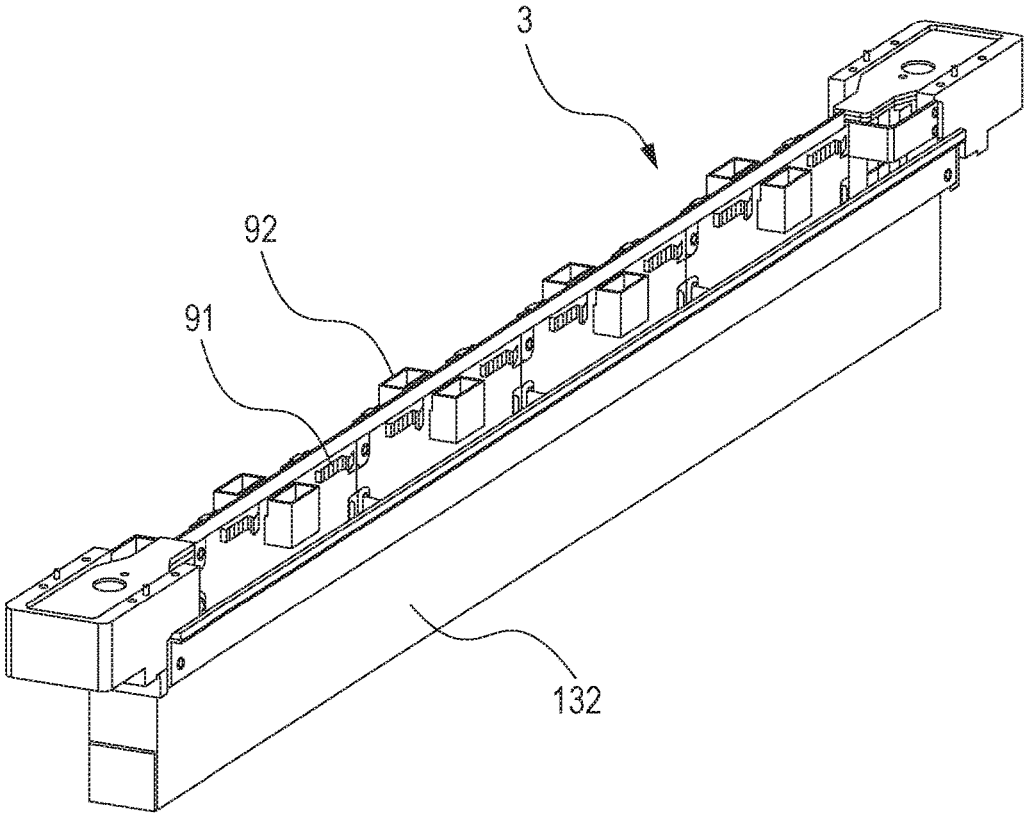
FIGS. 37A and 37B are diagrams describing the liquid discharge head according to the third configuration example.
Figure 37B:
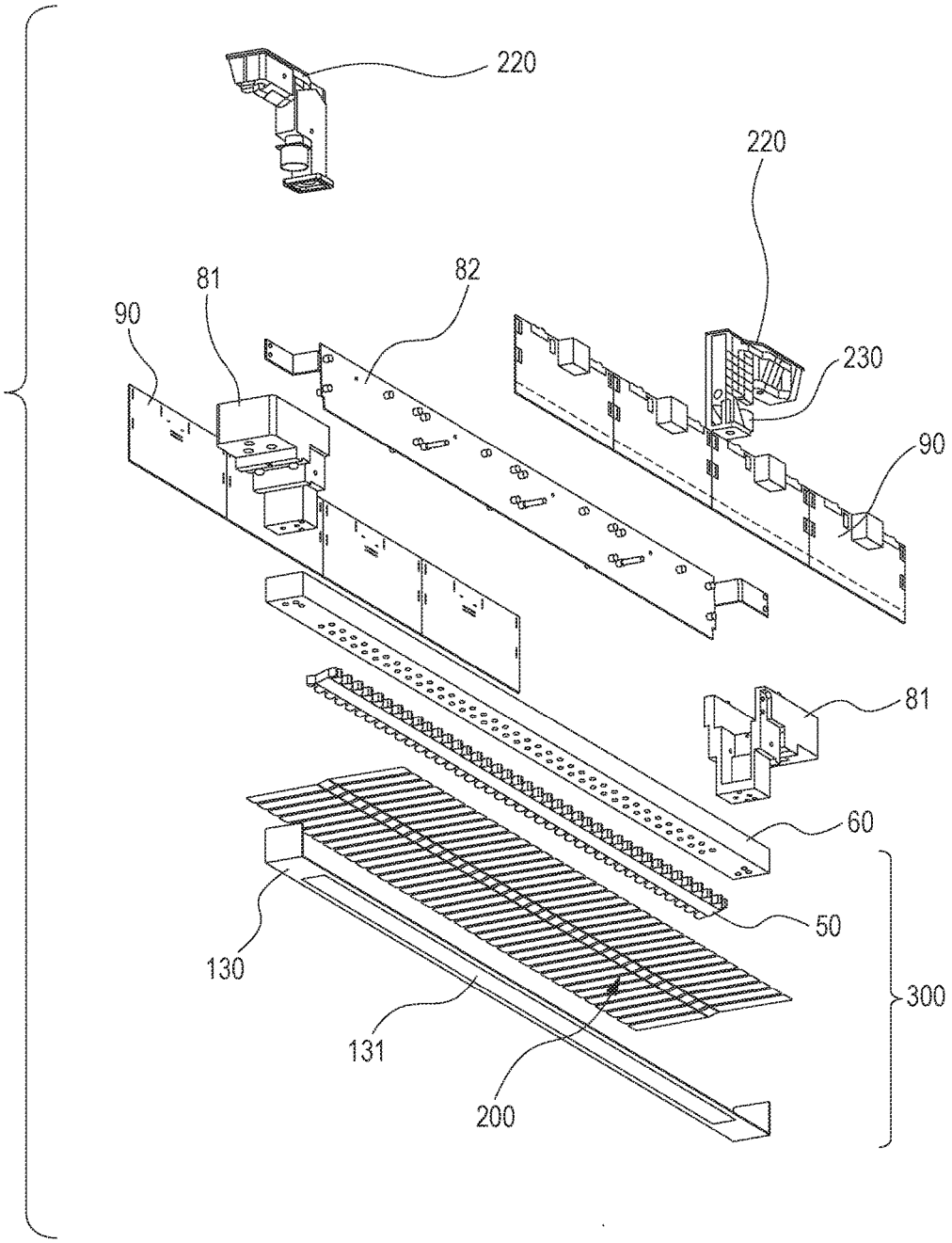

The structure of the liquid discharge head 3 according to the third configuration example of the present invention will be described. FIG. 37A is a perspective view of the liquid discharge head 3 according to the present configuration example, and FIG. 37B is a disassembled perspective view thereof. The liquid discharge head 3 has 36 recording element boards 10 arrayed in a straight line (inline) in the longitudinal direction of the liquid discharge head 3, and is a line type (page-wide) inkjet recording head that records using a single-color liquid. The liquid discharge head 3 has the signal input terminals 91 and power supply terminals 92 in the same way as in the second configuration example, and also is provided with a shield plate 132 to protect the longitudinal side face of the head.

FIG. 37B is a disassembled perspective view of the liquid discharge head 3, illustrating each part or unit making up the liquid discharge head 3 disassembled according to function (the shield plate 132 is omitted from illustration). The roles of the units and members, and the order of liquid flow through the liquid discharge head 3, are basically the same as in the second configuration example. The third configuration example differs from the second configuration example primarily with regard to the points of the electric wiring board 90 being divided into a plurality and disposed, the position of the negative pressure control units 230, and the shape of the first channel member 50. In the case of a liquid discharge head 3 having a length corresponding to a B2 size recording medium for example, as in the case of the present configuration example, eight electric wiring boards 90 are provided since the amount of electric power the liquid discharge head 3 uses is great. Four each of the electric wiring boards 90 are attached to both sides of the slender electric wiring board support member 82 attached to the liquid discharge unit support member 81.

Figure 38A:
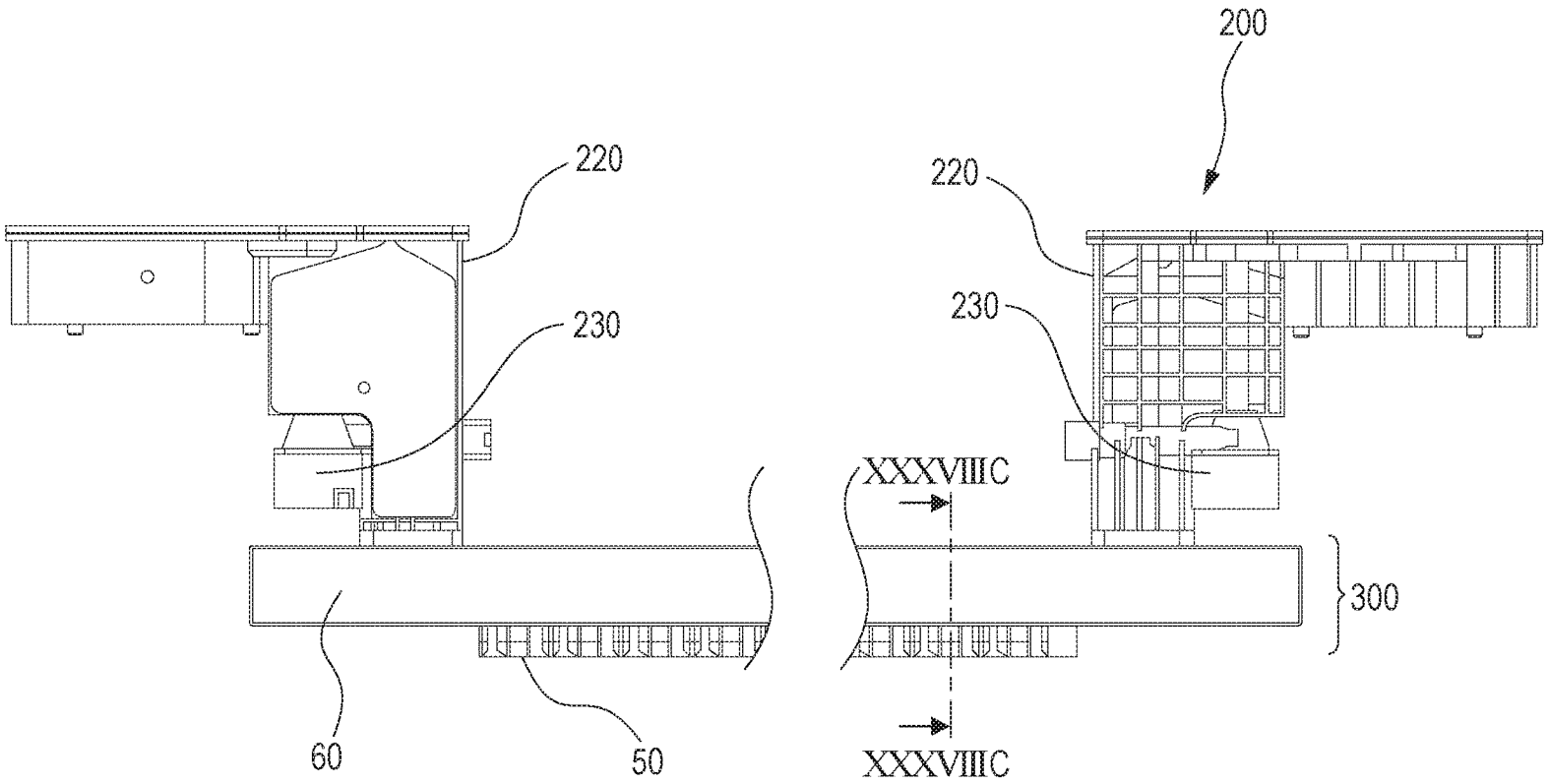
FIGS. 38A through 38C are diagrams describing the liquid discharge head according to the third configuration example.
Figure 38B:
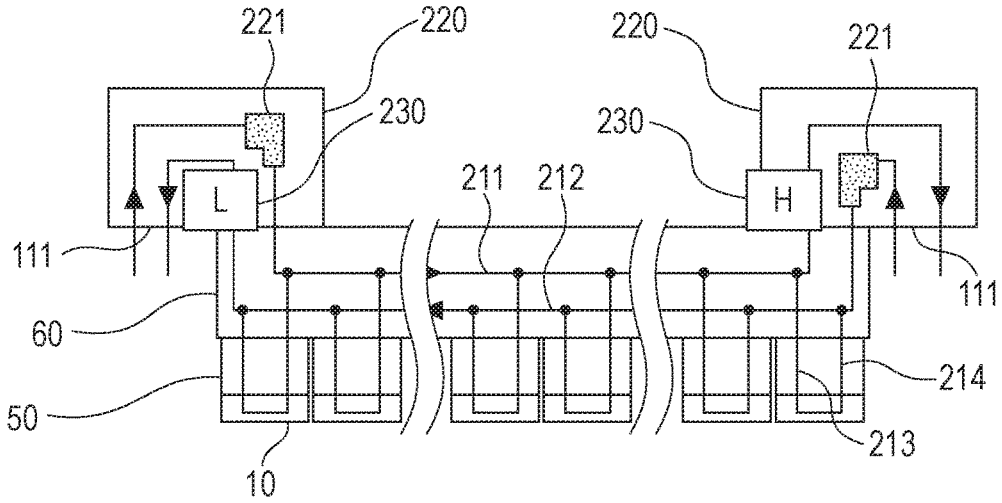
Figure 38C:
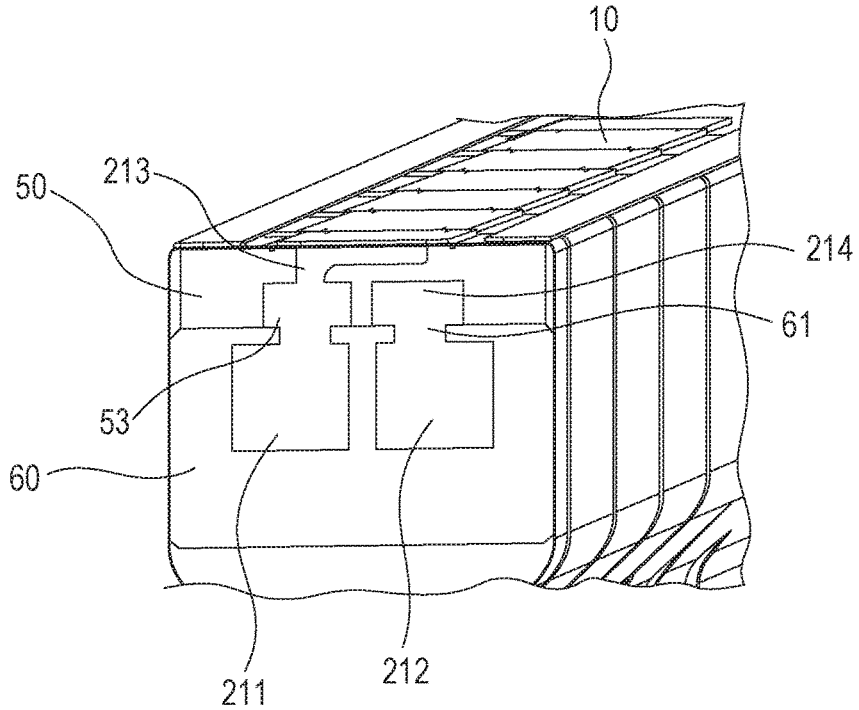

FIG. 38A is a side view of the liquid discharge head 3 that has the liquid discharge unit 300, liquid supply units 220, and negative pressure control units 230, FIG. 38B is a schematic diagram illustrating the flow of liquid, and FIG. 38C is a perspective view illustrating a cross-section taken along line XXXVIIIC-XXXVIIIC in FIG. 38A. Parts of the configuration have been simplified to facilitate understanding.

The liquid connection portions 111 and filters 221 are provided within the liquid supply units 220, with the negative pressure control units 230 being integrally formed beneath the liquid supply units 220. This enables the distance in the height direction between the negative pressure control units 230 and the recording element boards 10 to be reduced as compared to the second configuration example. This configuration reduces the number of channel connection portions within the liquid supply units 220, and is advantageous not only regarding improved reliability regarding leakage of recording liquid, but also in that the number of parts and assembly processes can be reduced.

Also, the water head difference between the negative pressure control units 230 and the face where the discharge orifices are formed is relatively smaller, and accordingly can be suitably applied to a recording apparatus where the inclination angle of the liquid discharge head 3 differs for each liquid discharge head 3, such as illustrated in FIG. 35. The reason is that the reduced water head difference enables the negative pressure difference applied to the discharge orifices of the respective recording element boards 10 can be reduced even if each of the multiple liquid discharge heads 3 is used at a different inclination angle. Reducing the distance from the negative pressure control units 230 to the recording element boards 10 also reduces the pressure drop difference due to fluctuation in flow of the liquid, since the flow resistance is reduced, and is preferable from the point that more stable negative pressure control can be performed.

FIG. 38B is a schematic diagram illustrating the flow of the recording liquid within the liquid discharge head 3. The circuitry is the same as the circulation arrangement illustrated in FIG. 36, but FIG. 38B illustrates the flow of liquid at each component within the actual liquid discharge head 3. A set of the common supply channel 211 and common recovery channel 212 is provided within the slender second channel member 60, extending in the longitudinal direction of the liquid discharge head 3. The common supply channel 211 and common recovery channel 212 are configured so that the liquid flows in mutually opposite directions, with filters 221 disposed at the upstream side of these channels to trap foreign substances intruding from the connection portions 111 or the like. This arrangement where the liquid flows in mutually opposite directions in the common supply channel 211 and common recovery channel 212 is preferable from the point that the temperature gradient in the longitudinal direction within the liquid discharge head 3 is reduced. The flow direction of the common supply channel 211 and common recovery channel 212 is shown as being in the same direction in FIG. 36 to simplify explanation.

A negative pressure control unit 230 is connected at the downstream side of each of the common supply channel 211 and common recovery channel 212. The common supply channel 211 has branching portions to multiple individual supply channels 213 along the way, and the common recovery channel 212 has branching portions to multiple individual recovery channels 214 along the way. The individual supply channels 213 and individual recovery channels 214 are formed within multiple first channel members 50. Each of the individual channels communicates with openings 21 (see FIG. 20C) of the cover 20 provided to the reverse face of the recording element boards 10.

The negative pressure control units 230 indicated by H and L in FIG. 38B are high-pressure side (H) and low-pressure side (L) units. The respective negative pressure control units 230 are back-pressure type pressure adjustment mechanisms, set to control the pressure upstream of the negative pressure control units 230 to relatively high (H) and low (L) negative pressures. The common supply channel 211 is connected to the negative pressure control unit 230 (high-pressure side), and the common recovery channel 212 is connected to the negative pressure control unit 230 (low-pressure side). This generates differential pressure between the common supply channel 211 and common recovery channel 212. This differential pressure causes the liquid to flow from the common supply channel 211, through the individual supply channels 213, discharge orifices 13 (pressure chambers 23) within the recording element boards 10, and the individual recovery channels 214 in that order, and to the common recovery channel 212.

FIG. 38C is a perspective view illustrating a cross-section taken along line XXXVIIIC-XXXVIIIC in FIG. 38A. Each discharge module 200 in the present configuration example is configured including a first channel member 50, recording element boards 10, and flexible printed circuit boards 40. The present configuration example does not have the support member 30 (FIG. 18) described in the second configuration example, with the recording element boards 10 having the cover 20 being directly joined to the first channel member 50. The common supply channel 211 provided to the second channel member 60 supplies liquid from the communication ports 61 provided on the upper face thereof to the individual supply channels 213, via the individual communication ports 53 formed on the lower face of the first channel member 50. Thereafter, the liquid passes through the pressure chambers 23, and is recovered to the common recovery channel 212 via the individual recovery channels 214, individual communication ports 53, and communication ports 61, in that order.

Unlike the arrangement illustrated in the second configuration example illustrated in FIG. 15, the individual communication ports 53 on the lower face of the first channel member 50 (the face toward the second channel member 60) are openings of a sufficient size with regard to the communication ports 61 formed on the upper face of the second channel member 60. According to this configuration, even in a case where there is positional deviation at the time of mounting the discharge module 200 to the second channel member 60, fluid communication can be realized in a sure manner between the first channel member 50 and the second channel member 60, so yield will improve when manufacturing the head, thereby reducing costs.

First Embodiment

Figure 21A:
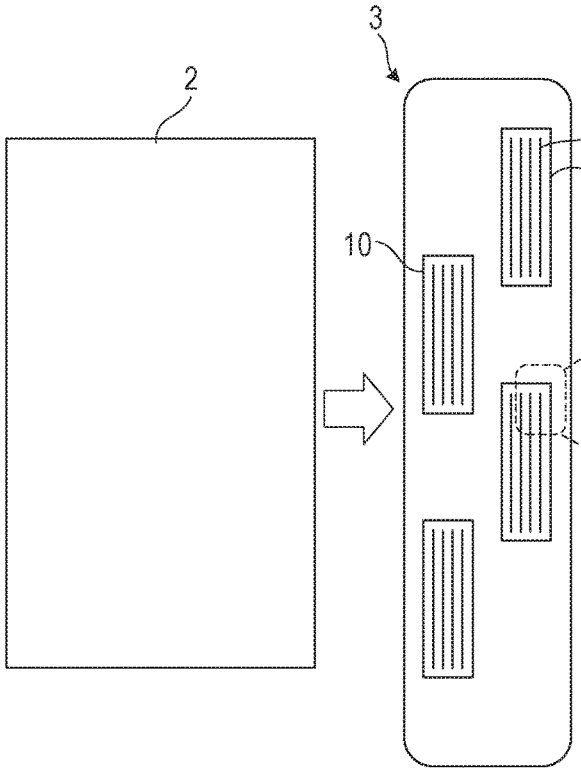
FIGS. 21A and 21B is a diagram describing a liquid discharge head according to a first embodiment of the present invention.
Figure 21B:
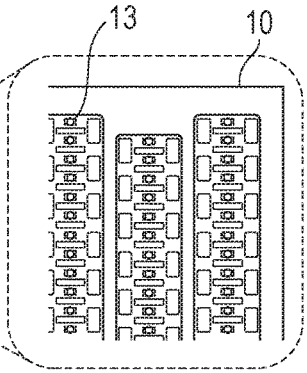
Figure 22A:
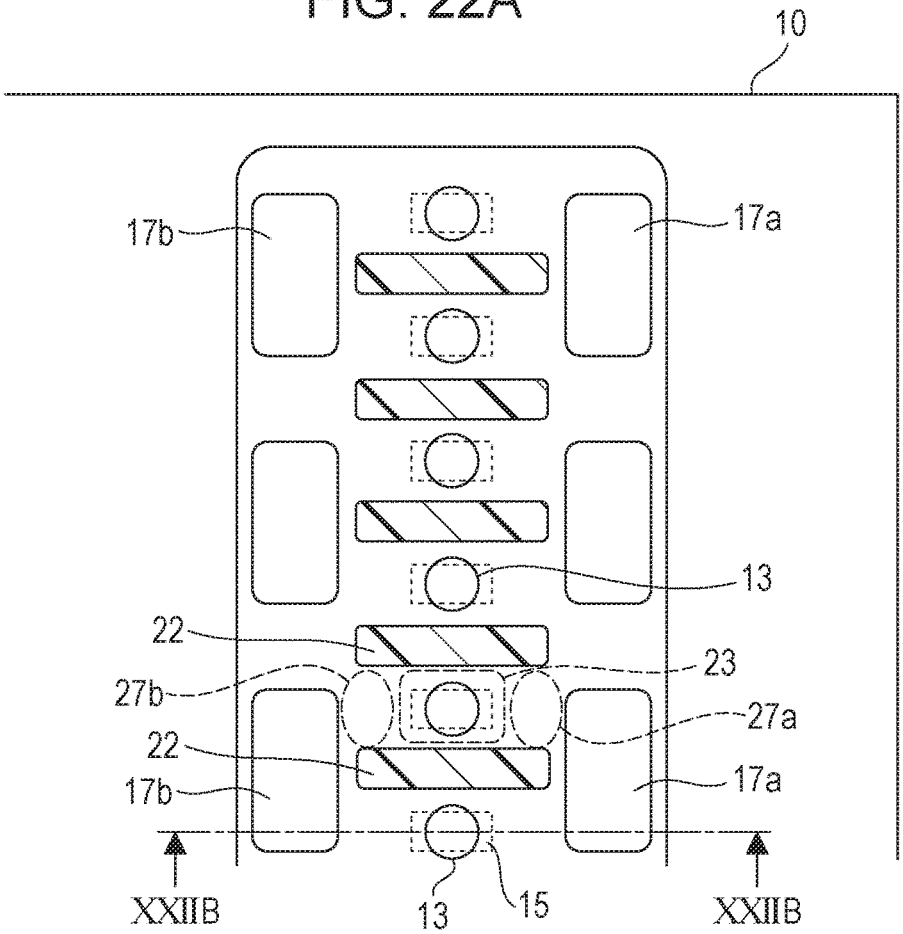
FIGS. 22A and 22B are diagrams describing a recording element board of the liquid discharge head according to the first embodiment.
Figure 22B:
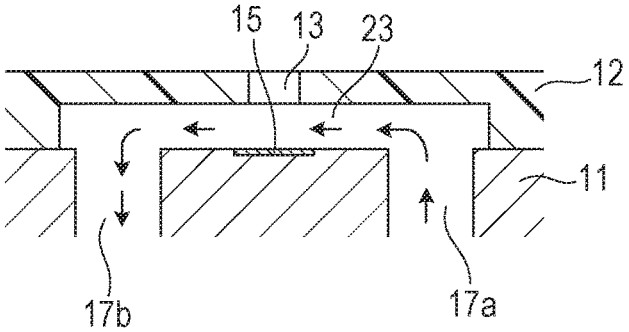

Description will be made below regarding a configuration according to the present invention where replenishing of liquid to pressure chambers can be speedily performed in the liquid discharge apparatus and liquid discharge head such as described above. FIGS. 21A and 21B are diagrams illustrating the configuration of a liquid discharge head according to a first embodiment of the present invention. FIG. 21A illustrates the relationship of the recording medium 2 as to the liquid discharge head 3, and FIG. 21B is an enlarged transparent view of the recording element board 10 at the portion in FIG. 21A indicated by dotted lines. In the liquid discharge head 3 illustrated in FIGS. 21A and 21B, the channel-forming member 210 in the configuration illustrated in FIGS. 1 through 20C is configured as an integrated member having a length equivalent to the total length of the liquid discharge head 3. Four recording element boards 10, on each of which multiple recording elements that generate energy to discharge liquid are disposed in high density, are disposed on the channel-forming member 210 via support members 30 (omitted from illustration in FIGS. 21A and 21B) in the longitudinal direction of the liquid discharge head 3 in a staggered manner in the transverse direction thereof. This makes up one long liquid discharge head 3. There are overlapping regions between two adjacent recording element boards 10, so that discharge orifices are disposed without any gaps as to the recording medium 2 from a recording perspective. Images and the like can be recorded on the recording medium 2 by moving the recording medium 2 relative to the liquid discharge head 3 in a direction orthogonal to the longitudinal direction of the liquid discharge head 3. Although the recording element boards 10 are arrayed in a staggered manner here, the present invention can be applied to a liquid discharge head where multiple recording element boards 10 are arrayed in a straight line, as illustrated in FIGS. 1 through 20C as well. Multiple discharge orifice rows 14 are formed on the surface of the recording element boards 10, and the direction in which the discharge orifice rows 14 extend is the longitudinal direction of the liquid discharge head 3. Liquid supply units and negative pressure control units are provided to this liquid discharge head 3 in the same way as that illustrated in FIGS. 1 through 20C, although not illustrated in FIGS. 21A and 21B FIGS. 22A and 22B are diagrams illustrating the recording element board 10 of the liquid discharge head 3 according to the first embodiment, illustrating in detail a region where discharge orifices 13 and recording elements 15 are formed in particular. FIG. 22A is an enlarged transparent plan view of the recording element board 10, and FIG. 22B is a cross-sectional view taken along line XXIIB-XXIIB in FIG. 22A. The configuration near the end of one discharge orifice row 14 is illustrated here for the sake of description. On one face of the substrate 11 of the recording element board 10, multiple discharge orifices 13 that are through holes are formed in a row in the discharge orifice forming member 12, with recording elements 15 being provided corresponding to the discharge orifices 13, so as to face the discharge orifices 13, in the same way as in FIGS. 1 through 20C. Multiple recording elements 15 are provided on the substrate 11, and between the adjacent recording elements 15 are provided partitions 22 that are longer than the recording elements 15. A space defined by adjacent partitions 22, the face of the substrate 11, and the discharge orifice forming member 12, serves as a channel. The portion of this channel that is between the recording element 15 and discharge orifice 13 is the pressure chamber 23. Accordingly, one pressure chamber 23 corresponds to one recording element 15 and one discharge orifice 13. The recording elements 15 are heaters that generate bubbles by heating the liquid, for example. Liquid such as recording liquid is discharged from the discharge orifices 13 by the impulsive force of bubbles generated by heat applied from the heaters in this liquid discharge head 3, and land on the recording medium 2, whereby recording can be performed.

Multiple pressure chambers 23 are arrayed in a row following the direction of the discharge orifice row 14 in the configuration illustrated in FIG. 22A. Supply ports 17*a* communicating with the liquid supply channel 18 formed on the other face of the substrate 11 are formed in the region to the right side of the row of pressure chamber 23 in FIG. 22A. Recovery ports 17*b* communicating with the liquid recovery channel 19 formed on the other face of the substrate 11 are formed in the region to the left side of the row of pressure chamber 23 in FIG. 22A. The supply ports 17*a* and recovery ports 17*b* are both through channels that pass through the substrate 11, and multiple supply ports 17*a* and recovery ports 17*b* are arrayed in the direction of the discharge orifice row, one each per two pressure chambers 23. Of the channel formed by being surrounded by mutually adjacent partitions 22, the face of the substrate 11, and the discharge orifice forming member 12, the portion toward the supply port 17*a* side from the pressure chamber 23 is denoted by reference numeral 27*a*, and the portion toward the recovery port 17*b* side from the pressure chamber 23 is denoted by reference numeral 27*b* in FIGS. 22A and 22B.

Figure 23A:
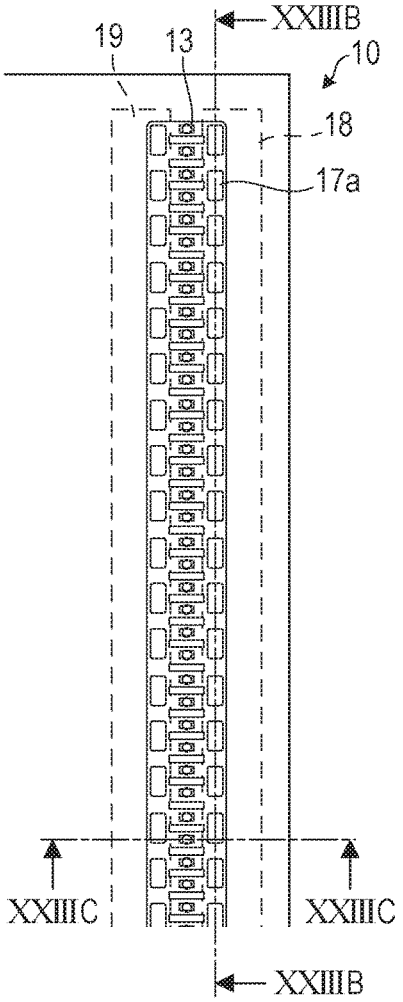
FIGS. 23A through 23C are diagrams describing the recording element board of the liquid discharge head according to the first embodiment.
Figure 23B:
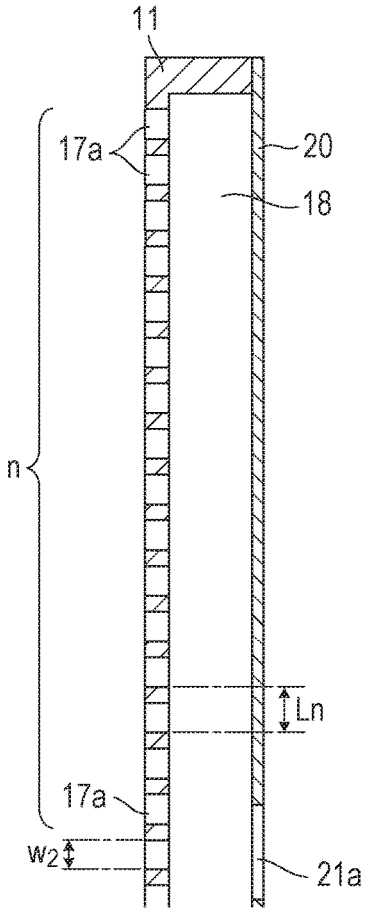
Figure 23C:
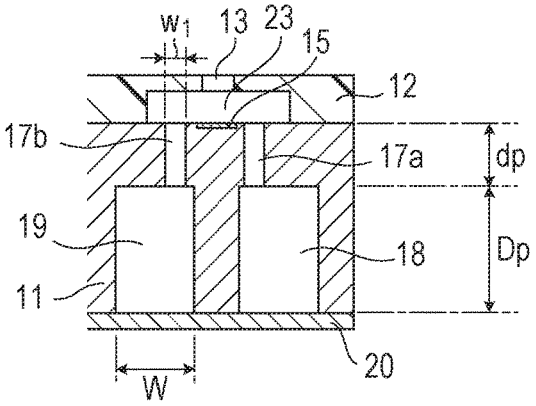
Figure 24A:
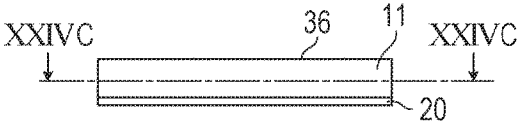
FIGS. 24A through 24D are diagrams describing the recording element board of the liquid discharge head according to the first embodiment.
Figure 24B:
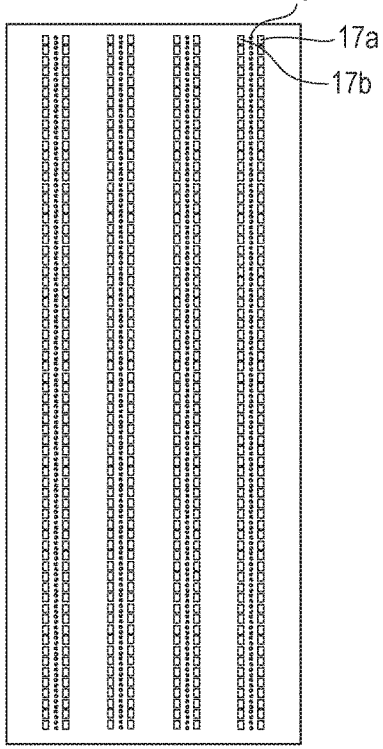
Figure 24C:
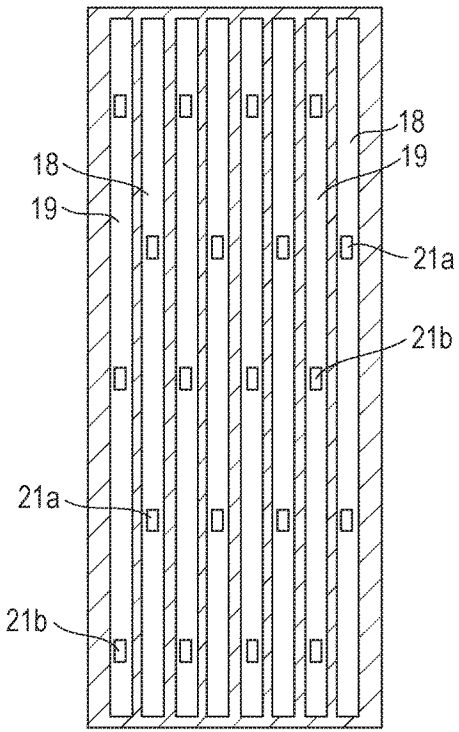
Figure 24D:
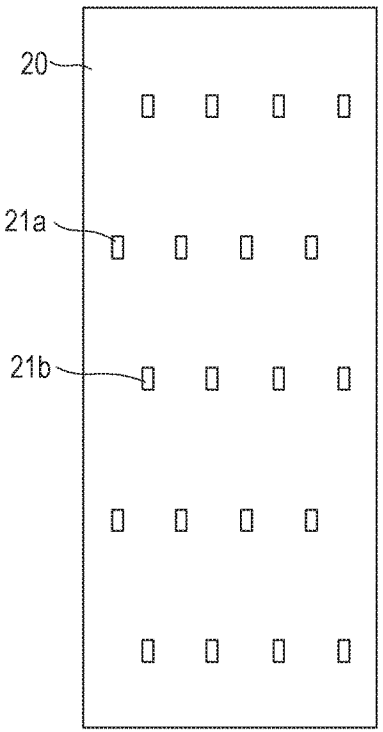

FIGS. 23A through 23C are diagrams for describing the overall configuration of the recording element board 10. FIG. 23A is a transparent plan view of the recording element board 10, FIG. 23B is a cross-sectional view taken along line XXIIIB-XXIIIB in FIG. 23A, and FIG. 23C is a cross-sectional view taken along line XXIIIC-XXIIIC in FIG. 23A. FIGS. 24A through 24D are diagrams for describing the substrate 11 and cover 20. FIG. 24A is a side view of the substrate 11 and cover 20, FIG. 24B is a plan view of a first face of the substrate 11, FIG. 24C is a view along line XXIVC-XXIVC in the direction of the arrow in FIG. 24A, and FIG. 24D is a plan view from the cover 20 side. Note that the discharge orifice forming member 12 is omitted from illustration in FIG. 23B for the sake of description. The liquid supply channels 18 and liquid recovery channels 19 are formed as grooves on the face of the substrate 11 of the recording element board 10 that is the opposite face (second face) from a first face 36 where the recording elements 15 are formed. The liquid supply channels 18 and liquid recovery channels 19 are formed as grooves on the second face of the substrate 11, extending on the direction of the discharge orifice row 14. Further, the cover 20 is attached to the second face of the substrate 11, thereby covering the liquid supply channels 18 and liquid recovery channels 19 in the liquid discharge head 3 according to the present embodiment, in the same way as in the above description. Openings are provided to supply liquid to the liquid supply channels 18 through a support member omitted from illustration, and to recover liquid from the liquid recovery channels 19, in the same way as the arrangement illustrated in FIGS. 1 through 20C. Hereinafter, openings communicating with the liquid supply channels 18 will be referred to as "supply-side openings 21*a*", and openings communicating with the liquid recovery channels 19 will be referred to as "recovery-side openings 21*b*". Multiple supply-side openings 21*a* and recovery-side openings 21*b* are provided to each of the liquid supply channels 18 and liquid recovery channels 19. In the arrangement illustrated here, four rows of recording elements 15 are provided, and four liquid supply channels 18 and four liquid recovery channels 19 are provided accordingly in the substrate 11 in an alternating manner. The number of supply-side openings 21*a* provided to each liquid supply channel 18 is less than the number of supply ports 17*a* communicating with that liquid supply channel 18. In the same way, the number of recovery-side openings 21*b* provided to each liquid recovery channel 19 is less than the number of recovery port 17*b* communicating with that liquid recovery channel 19. The positions of the supply-side openings 21*a* and recovery-side openings 21*b* are both on the inner side of the ends of the liquid supply channels 18 and liquid recovery channels 19 in the discharge orifice row direction, so the size of the recording element board 10 can be suppressed. More specifically, the supply-side openings 21*a* are provided closer to the middle of the liquid supply channel 18 in the discharge orifice row direction from the supply ports 17*a* at the farthest ends on both sides of the liquid supply channel 18 in the longitudinal direction. The same is true for the positions of the recovery-side openings 21*b*.

Next, the flow of liquid such as recording liquid in the liquid discharge head 3 will be described. The common supply channel 211 and common recovery channel 212 are provided in the channel-forming member 210, in the same way as the arrangement illustrated in FIGS. 1 through 20C. Liquid that has branched from the common supply channel 211 enters the liquid supply channel 18 from the liquid communication ports 31 of the support member 30 and through the supply-side openings 21*a*, flows through the liquid supply channel 18 in the discharge orifice row direction, and passes through the supply ports 17*a* that are through channels and channels 27*a* and enter the pressure chambers 23. The number of the supply ports 17*a* is less than the number of the supply-side openings 21*a*, so liquid is supplied to multiple supply ports 17*a* from one supply-side opening 21*a* via the liquid supply channel 18. Liquid that was not discharged from the pressure chambers 23 then enters the liquid recovery channel 19 via the recovery ports 17*b* that are through channels and the recovery-side openings 21*b*. Liquid from multiple recovery ports 17*b* merges in the liquid recovery channel 19 and the merged liquid merges at the common recovery channel 212 via the recovery-side openings 21*b* and liquid communication ports 31. The flow of the liquid is indicated by arrows in FIG. 22B. This liquid discharge head 3 also has a configuration where liquid such as recording liquid is circulated between the liquid discharge apparatus, so thickening of liquid due to vaporization of the medium from the discharge orifices 13 can be suppressed, and deterioration of recording image quality can be prevented.

In a case of continuously discharging from a great number of discharge orifices 13 at one time, a great amount of liquid flows through the liquid supply channels 18 formed on the second face of the substrate 11 in the liquid discharge head 3 such as described above. Accordingly, pressure drop occurs at the liquid supply channel 18 and the supply ports 17*a* that are through channels. Liquid of an amount equivalent to the amount discharged from the discharge orifices 13 should be replenished to the pressure chambers 23 upon having performed discharge, but if the above-described pressure drop is great, the replenishing speed to the pressure chambers 23 will be slow. If the replenishing speed is slow, the volume of the discharged droplets per discharge decreases when continuous discharge is performed, and further, a great many minute droplets are generated, called mist. As a result the concentration of the recording formed on the recording medium 2 may be thin, or the inside of the liquid discharge apparatus may be contaminated by the mist. According to studies made by the Present Inventors, which will be described below, thinning of recording density became markedly visible in cases where images or the like were recorded on the surface of the recording medium 2 by discharging recording liquid in a state where the pressure drop exceeded 5000 Pa. The term pressure drop as used here is pressure drop in a state where there is a flow of recording liquid due to discharging. That is to say, this means pressure drop in a state where the liquid in the liquid supply channel 18 is moving during the process of liquid being replenished to the pressure chambers 23, after having discharged liquid from the discharge orifices 13. More specifically, this is the sum of pressure drop at the liquid supply channel 18 and pressure drop at the supply port 17*a*, i.e., a composited pressure drop. The pressure drop at the liquid supply channel 18 is the pressure drop on the liquid supply channel 18 between a supply-side opening 21*a* formed in the cover 20 to the farthest supply port 17*a* from the openings 21 that is to receive supply therefrom. There are multiple supply-side openings 21*a*, and the composited pressure drop as used here may differ for each supply-side opening 21*a*, but in such cases, the largest of the composited pressure drops will be considered.

Figure 25:
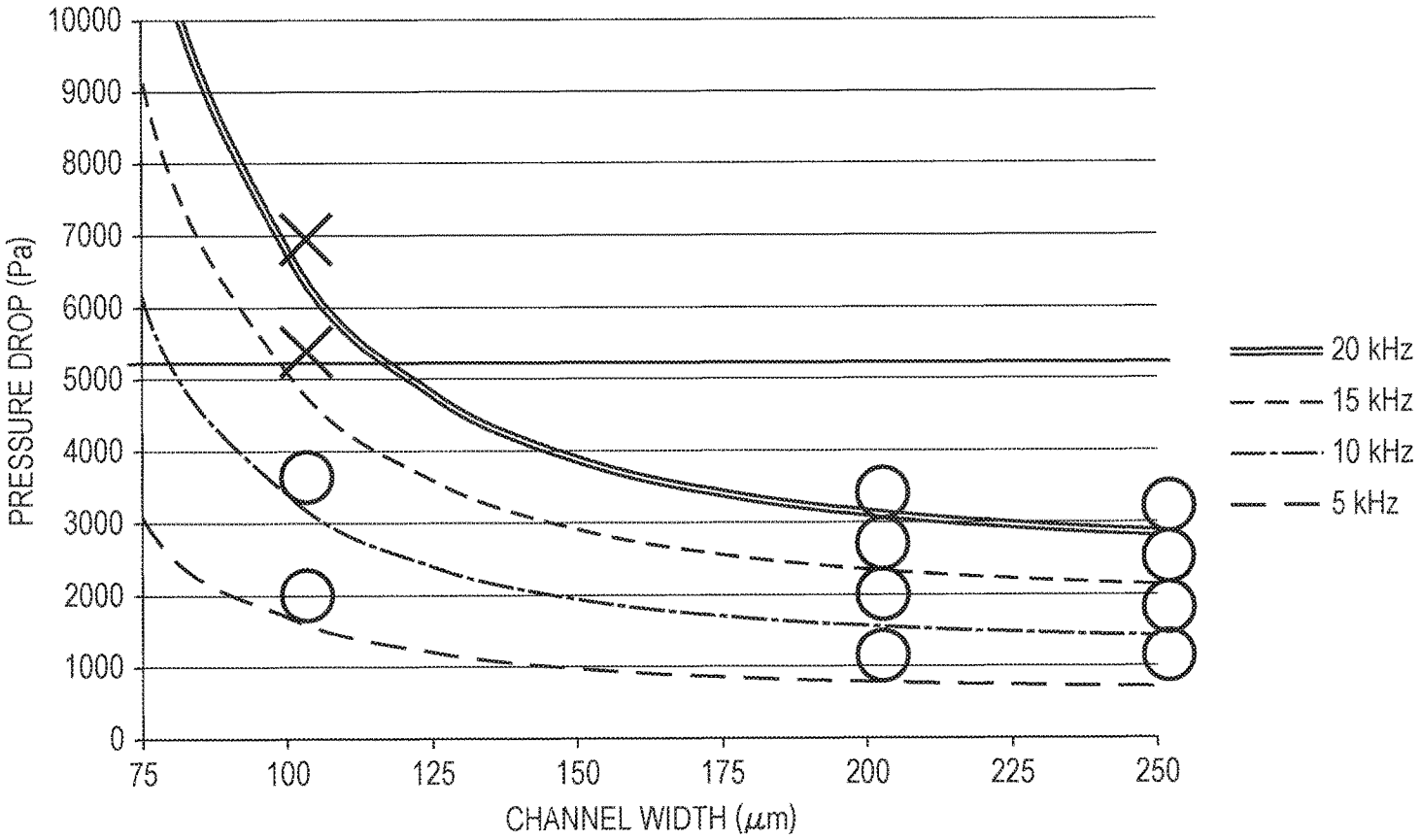
FIG. 25 is a graph illustrating the relationship between pressure drop and recording quality.

The Present Inventors conducted experiments regarding the relationship between composited pressure drop and recording quality. Changing the width of the liquid supply channels 18 formed as grooves in the substrate 11 changes the pressure drop, so multiple kinds of recording element boards 10 with different widths of the liquid supply channel 18 were fabricated, and liquid discharge heads 3 were fabricated using these recording element boards 10. The frequency of discharging droplets by driving the recording elements 15, i.e., the discharge frequency was changed in the using of these liquid discharge heads 3 to form recording on the recording medium 2, and the recording quality was evaluated. The results are shown in FIG. 25. The circles in FIG. 25 indicate conditions where thinning of recording density was inconspicuous, and the crosses indicate conditions where thinning of recording density was marked. It was thus found that thinning of recording density was marked when the composted pressure loss exceeds 5000 Pa, although there was some difference depending on the discharge frequency. Accordingly, the present embodiment is arranged such that the composited pressure drop that is the total of the pressure drop of the liquid supply channel 18 when discharging liquid and the pressure drop of the supply ports 17*a* that are through channels is within 5000 Pa. The pressure drop at the liquid supply channel 18 may change in accordance with the positional relationship between the supply-side openings 21*a* and the supply ports 17*a*. Accordingly, a more specific arrangement is made here, where the sum of pressure drop from any supply-side opening 21*a* to a supply port 17*a* that is at a position removed farthest from that supply-side opening 21*a*, and the pressure drop at the supply port 17*a*, is within 5000 Pa. Accordingly, replenishing of liquid such as recording liquid to the pressure chambers 23 can be speedily performed, and deterioration of recording quality can be prevented. The composited pressure drop preferably is suppressed to 4000 Pa or lower, and further preferably to 3000 Pa or lower.

The composited pressure drop can be suppressed to within 5000 Pa by increasing the cross-sectional area of the liquid supply channel 18 and supply ports 17*a*. However, haphazardly increasing these cross-sectional areas will increase the size of the recording element board 10, and lead to increased costs. Particularly, widening the liquid supply channel 18 makes the width of the recording element board 10 broader in the direction orthogonal to the direction of the discharge orifice rows. Accordingly, the size increase of the board can be suppressed while increasing the cross-sectional area of the liquid supply channel 18 by forming the grooves for the liquid supply channels 18 formed in the substrate 11 deeper. For example, both reduction in pressure drop and suppressed increase in board size can be realized by making the depth of the liquid supply channel 18 to be twice or more the width thereof in at least a partial section of the liquid supply channel 18, for example. To reduce the composited pressure drop, depth Dp of the liquid supply channel 18 in at least a partial section of the liquid supply channel 18 preferably is 300 μm or greater, and a distance Ln between adjacent supply ports 17*a* preferably is 100 μm or less. The thickness of the cover 20 preferably is 0.1 μm or more but 100 μm or less.

Although pressure drop in the liquid discharge head 3 having a configuration where recording liquid circulates has been described, the composited pressure drop for full discharge is to be within 5000 Pa for liquid discharge heads of a configuration in which recording liquid does not circulate, in order to achieve good recording. Also, in the liquid discharge head 3 having the configuration described above where recording liquid circulates, there are cases when, after having discharged recording liquid from the discharge orifices 13, recording liquid is replenished to the pressure chamber 23 from the liquid recovery channel 19 via the recovery ports 17*b*. Accordingly, the sum of pressure drop at the liquid recovery channel 19 and pressure drop at the recovery ports 17*b* also preferably is within 5000 Pa. The pressure drop at the liquid recovery channel 19 is the pressure drop on the liquid recovery channel 19 between a recovery-side opening 21*b* formed in the cover 20 to the farthest recovery port 17*b* from the recovery-side opening 21*b* to which recording liquid is to flow. Also, in a liquid discharge head having the configuration where recording liquid circulates, the total sum of the composited pressure drop when discharging recording liquid as described above, and the composited pressure drop in a standby state where no recording liquid is being discharged, is preferably within 5000 Pa.

As one example where the composited pressure drop of the liquid supply channel 18 and supply ports 17*a* is within 5000 Pa, the arrangement in FIGS. 23A through 24D has a rectangular cross-section for the liquid supply channel 18, and the planar shape of the supply port 17*a* also is rectangular. The liquid recovery channel 19 has the same shape as the liquid supply channel 18, and the recovery ports 17*b* have the same shapes as the supply ports 17*a*. The supply ports 17*a* and recovery ports 17*b* each are disposed at equal intervals at the liquid supply channel 18 and liquid recovery channel 19. The width W of the liquid supply channel 18 is 190 μm, the depth Dp is 425 μm, and the distance Ln to the adjacent supply port 17*a* is 85 μm. The shape of the opening portion of the supply port 17*a* formed as a through channel has a width $w_1$ in one direction of 40 μm, and a width $w_2$ in the other direction of 45 μm, and the length dp thereof is 160 μm. The viscosity η of the recording liquid that is the liquid to be discharged is 6 mPa·s, and the flow rate Q that flows through the supply ports 17*a* when continuous discharge is performed from all discharge orifices is 90,000 pl/s. The maximum number n of supply ports 17*a* included in a section from a supply-side opening 21*a* formed in the cover 20 to the supply port 17*a* farthest from that supply-side opening 21*a* is 92. The supply port 17*a* farthest from any supply-side opening 21*a* formed in the cover 20 is the supply port 17*a* formed at an end of the recording element board 10 in the discharge orifice row direction. At this time, the composited pressure drop ΔP when the flow rate of recording liquid is Q is determined by Expression (1).

$$\Delta P = \frac{n^2 RQ}{2} + rQ \tag{1}$$

The first term in the right side in Expression (1) is the pressure drop from the supply-side opening 21*a* to the farthest supply port 17*a*, and the second term in the right side is the pressure drop at the supply port 17*a*. R represents the viscous resistance of the liquid flowing through the liquid supply channel 18 between adjacent supply ports 17*a*, and is obtained by Expression (2), while r represents the viscous resistance at the supply port 17*a*, and is obtained by Expression (3). Expressions (2) and (3) are expressions that generally hold regarding fluid channels where the cross-section is rectangular.

$$R = 12 \times \left\{0.33 + 1.02 \times \left[\frac{D}{W} + \frac{W}{D}\right]\right\} \frac{\eta L}{(DW)^2} \tag{2}$$

$$r = 12 \times \left\{0.33 + 1.02 \times \left[\frac{w_1}{w_2} + \frac{w_2}{w_1}\right]\right\} \frac{\eta d}{(w_1 w_2)^2} \tag{3}$$

In the example described here, when the flow rate Q generated by discharge is 90,000 pl/s, the pressure drop from any supply-side opening 21*a* of the cover 20 to the farthest supply port 17*a* is approximately 2000 Pa. This value is smaller than 5000 Pa, so image quality can be maintained even if discharge is continued from all discharge orifices 13. The recording liquid also continues to flow through the liquid supply channel 18 and supply ports 17*a* even when not discharging, in the liquid discharge head 3 illustrated here. Now, with the flow rate Q flowing at the supply port 17*a* when not discharging as 4800 pl/s, the composited pressure drop ΔP is approximately 100 Pa. At this time, the difference in pressure drop between not discharging and full discharge is within 5000 Pa, and the sum of pressure drop when not discharging and full discharge also is within 5000 Pa, so image quality can be maintained even if continuous discharge is performed from all discharge orifices 13. Although the liquid being discharged from the liquid discharge head 3 is described in this example as being recording liquid here, it is needless to say that the present invention is applicable in cases of discharging liquid other than recording liquid.

In the example described above, the supply ports 17*a* and recovery ports 17*b* are disposed uniformly as to the liquid supply channel 18 and liquid recovery channel 19, but an arrangement may be made where the supply ports 17*a* and recovery ports 17*b* are disposed non-uniformly. In this case, the distance between an i'th supply port 17*a* from the supply-side opening 21*a* of the cover 20 and an i+1'th supply port 17*a* is represented by $Ln_i$. The flow rate of the recording liquid flowing at the supply-side opening 21*a* is represented by q. At this time, the composted pressure drop ΔP is represented by Expression (1a) instead of Expression (1).

$$\Delta P = \left(\sum_{i=0}^{n} R_i(q - iQ)\right) + rQ \tag{1a}$$

where $$R_i = 12 \times \left\{0.33 + 1.02 \times \left[\frac{D}{W} + \frac{W}{D}\right]\right\} \frac{\eta L_i}{(DW)^2} \tag{2a}$$

$R_i$ in Expression (1a) is the viscous resistance of liquid at the liquid supply channel 18 in a section between the i'th supply port 17*a* from the supply-side opening 21*a* of the cover 20 and the i+1'th supply port 17*a* (distance $L_i$), as shown in Expression (2a). Even in a case where the supply ports 17*a* are disposed non-uniformly, setting the composited pressure drop ΔP indicated by Expression (1a) to be 5000 Pa enables replenishing of the pressure chambers 23 with recording liquid to be performed speedily, and deterioration of recording quality can be prevented.

Second Embodiment

The configuration of the liquid discharge head 3 to which the present invention is applied is not restricted to that illustrated in the first embodiment. Replenishing recording liquid to the pressure chambers 23 can be speedily performed and deterioration in recording quality can be prevented as long as the composited pressure drop ΔP is within 5000 Pa, even of the dimensions of the liquid supply channel 18 and supply ports 17*a* are changed. As a specific example thereof, a liquid discharge head 3 according to a second embodiment has same basic configuration as the first embodiment, with the width W of the liquid supply channel 18 being 100 μm, the depth 625 μm, and the distance Ln between adjacent supply ports 17*a* being 85 μm. The shape of the opening of the supply port 17*a* is a square where each side is 35 μm (i.e., $w_1$=35 μm, $w_2$=35 μm). The length Dp of the supply port 17*a* that is a through channel is 100 μm. The viscosity η of the recording liquid that is the liquid to be discharged is 6 mPa·s, and the flow rate Q that flows through the supply ports 17*a* when continuous discharge is performed from all discharge orifices is 90,000 pl/s. The maximum number n of supply ports 17*a* included in a section from a supply-side opening 21*a* formed in the cover 20 to the supply port 17*a* farthest from that supply-side opening 21*a* (the supply port 17*a* at the end of the recording element board 10) is 92. The composited pressure drop ΔP is approximately 4500 Pa, which is lower than 5000 Pa, so the liquid discharge head 3 according to the second embodiment also enables recording quality to be maintained in a case where discharge is continuously performed from all discharge orifices 13. This configuration enables the size of the recording element board 10 to be reduced more, since the width of the liquid supply channel 18 is narrower as compared to the first embodiment.

Third Embodiment

Figure 26A:
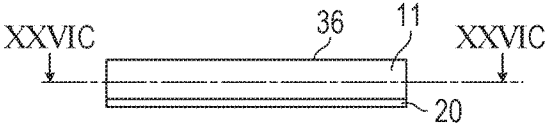
FIGS. 26A through 26D are diagrams describing a recording element board of a liquid discharge head according to a third embodiment.
Figure 26B:
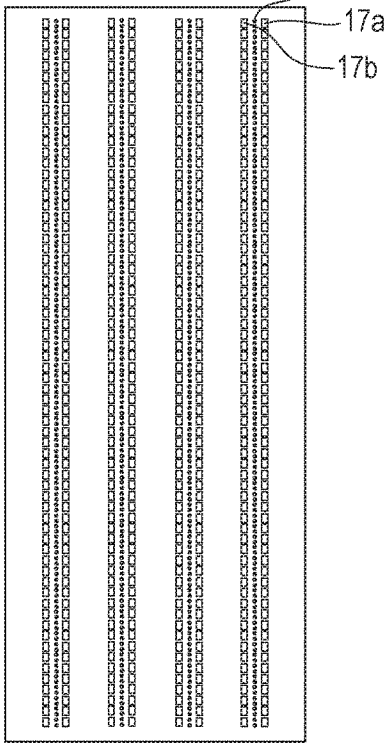
Figure 26C:
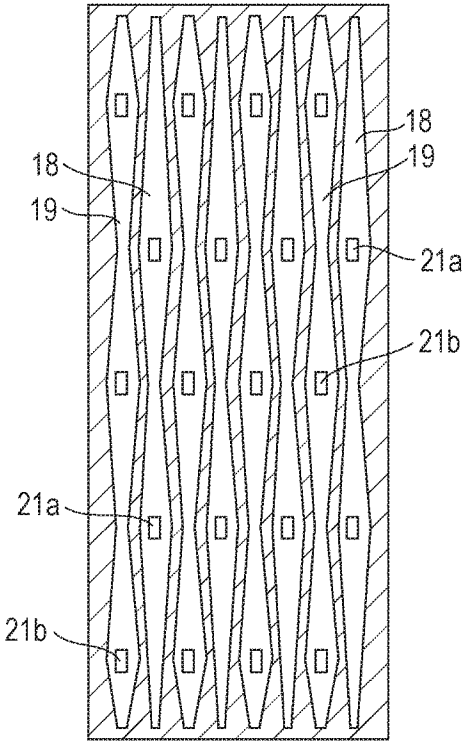
Figure 26D:
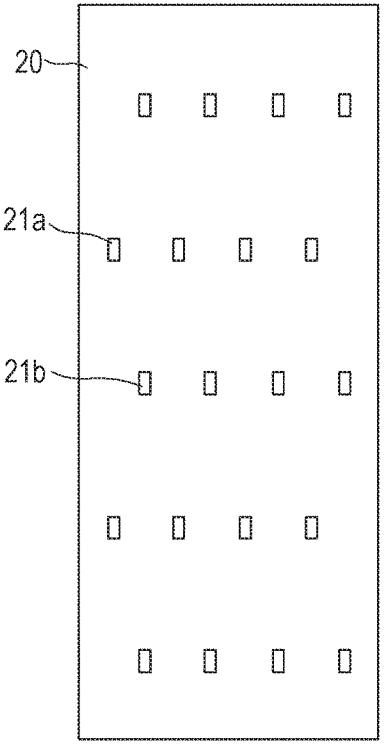

FIGS. 26A through 26D illustrate the configuration of the recording element board 10 in a liquid discharge head 3 according to a third embodiment. FIG. 26A is a side view of the substrate 11 and cover 20, FIG. 26B is a plan view from the first face of the substrate 11, and FIG. 26C is a view along line XXVIC-XXVIC in the direction of the arrow in FIG. 26A, and FIG. 26D is a plan view from the cover 20 side. The liquid discharge head 3 according to the present embodiment is similar to that in the first embodiment, but differs from the first embodiment with regard to the point that the widths W of the liquid supply channel 18 and liquid recovery channel 19 change in the discharge orifice row direction. In full discharge when all discharge orifices 13 are discharging, recording liquid of an equal flow rate flows at all supply ports 17*a*. Accordingly, the number of supply-side openings 21*a* of the cover 20 is smaller than the number of supply ports 17*a*, so the closer the position is to a supply-side opening 21*a*, the greater the flow rate of the recording liquid flowing through the liquid supply channel 18 is. If the cross-sectional area of channels is the same, the greater the flow rate is, the greater the pressure drop is, so the width of the liquid supply channel 18 is widened at positions where the flow rate is great in the present embodiment by increasing the cross-sectional area of the channel, thereby suppressing pressure drop. On the other hand, the flow rate at a position away from a supply-side opening 21*a* is relatively small, so narrowing the liquid supply channel 18 does not readily lead to increase in pressure drop. The supply-side openings 21*a* and recovery-side openings 21*b* are staggered in the cover 20 in the present embodiment, so that the liquid supply channels 18 are wider at positions where there are supply-side openings 21*a*, and gradually narrow away therefrom. The width of the liquid recovery channels 19 also are widened at the position of the recovery-side openings 21*b*, and gradually narrow away therefrom. The cross-sectional area of the liquid supply channels 18 is greatest at the positions of the supply-side openings 21*a*, and gradually narrow away from the positions of the supply-side openings 21*a* in this configuration.

As one example, a configuration is made where the width of the liquid supply channel 18 near a supply-side opening 21*a* is 220 μm, the width thereof at a position farthest from a supply-side opening 21*a* is 128 μm, and the width of the liquid supply channel 18 linearly varies between these. As for other dimensions, the depth Dp of the liquid supply channel 18 is 425 μm, the distance Ln to the adjacent supply port 17*a* is 85 μm, the width $w_1$ in one direction of the opening of the supply port 17*a* is 40 μm, the width $w_2$ in the other direction is 45 μm, and the length dp of the supply port 17*a* is 160 μm. The viscosity η of the recording liquid that is the liquid to be discharged is 6 mPa·s, and the flow rate Q that flows through the through channels when continuous discharge is performed from all discharge orifices is 90,000 pl/s, and the maximum number n of through channels included in a section to the supply port 17*a* farthest from the supply-side opening 21*a* (the supply port 17*a* at the end of the recording element board 10) is 92. In this case, the greatest value of pressure drop from the supply-side opening 21*a* to the supply port 17*a* is approximately 1900 Pa, so even taking pressure drop at the supply port 17*a* into consideration, the composited pressure drop is below 5000 Pa, so recording quality can be maintained even when continuously discharging from all discharge orifices 13. Staggering the supply-side openings 21*a* and recovery-side openings 21*b* in the present embodiment enables a low pressure drop to be maintained even if the width of the recording element board 10 is narrowed.

Fourth Embodiment

Figure 27A:
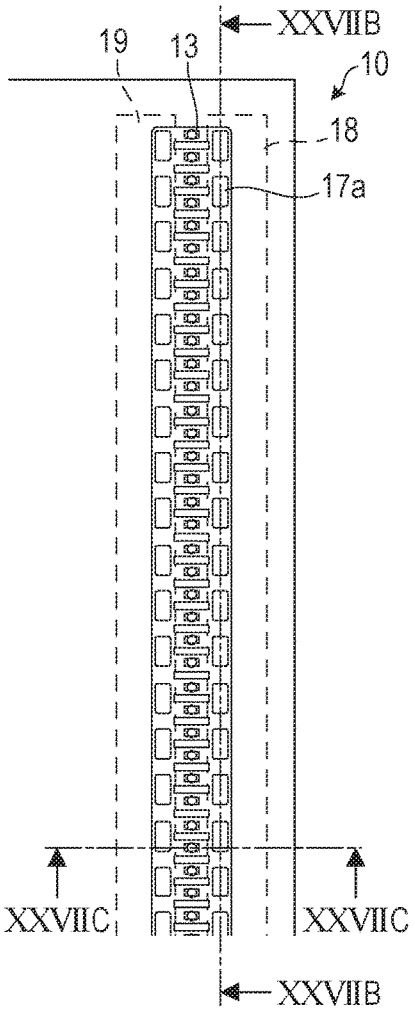
FIGS. 27A through 27C are diagrams describing a recording element board of a liquid discharge head according to a fourth embodiment.
Figure 27B:
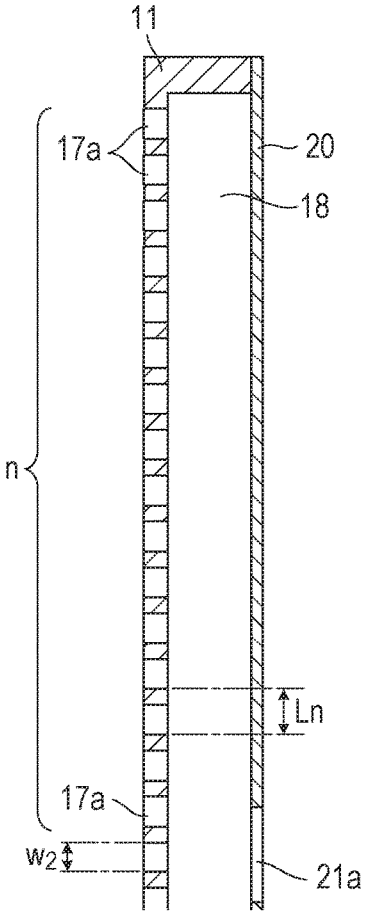
Figure 27C:
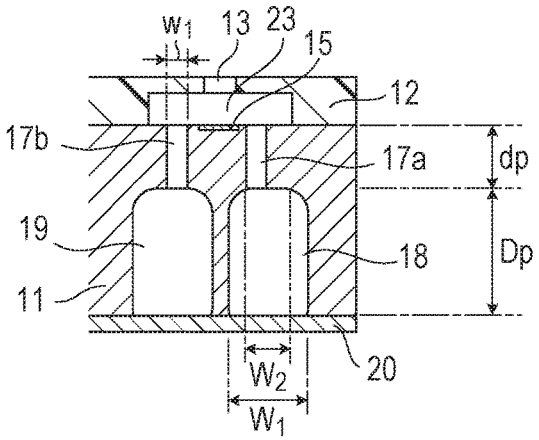

Although the cross-sectional shape of the liquid supply channel 18 has been described as being rectangular in the above embodiments, the cross-sectional shape of the liquid supply channel 18 is not restricted to being rectangular. FIGS. 27A through 27C are diagrams for describing the overall configuration of the recording element board 10 of a liquid discharge head 3 according to a fourth embodiment. FIG. 27A is a transparent plan view of the recording element board 10, FIG. 27B is a cross-sectional view taken along line XXVIIB-XXVIIB in FIG. 27A, and FIG. 27C is a cross-sectional view taken along line XXVIIC-XXVIIC in FIG. 27A. The cross-sectional shape of the liquid supply channel 18 and liquid recovery channel 19 in the fourth embodiment is the rectangle in the first embodiment, but with a portion of the corners rounded, as illustrated in FIG. 27C. The cross-sectional shapes and dimensions are the same for the liquid supply channel 18 and liquid recovery channel 19. For example, the width $W_1$ at the upper side of the liquid supply channel 18 (the side in contact with the cover 20) is 200 μm, the width $W_2$ on the bottom side (supply port 17*a* side) is 180 μm, and the depth Dp of the liquid supply channel 18 is 425 μm. The corner where the bottom of the liquid supply channel 18 and the side wall meet is round shape, so the width $W_2$ of the bottom side only represents the width of the flat portion not including the rounded portions. The distance between adjacent supply ports 17*a* is 85 μm, the opening of the supply port 17*a* has a width $w_1$ in one direction of 40 μm, and a width $w_2$ in the other direction of 45 μm, and the length dp thereof is 160 μm. The viscosity η of the recording liquid that is the liquid to be discharged is 6 mPa·s, the flow rate Q that flows through the through channels when continuous discharge is performed from all discharge orifices is 90,000 pl/s, and the maximum number n of through channels included in a section to the supply port 17*a* farthest from the supply-side opening 21*a* (the supply port 17*a* at the end of the recording element board 10) is 92. In this case, the greatest value of pressure drop from the supply-side opening 21*a* to the supply port 17*a* is approximately 2000 Pa, so even taking pressure drop at the supply port 17*a* into consideration, the composited pressure drop is below 5000 Pa, so recording quality can be maintained even when continuously discharging from all discharge orifices 13. The base side of partitions sectioning the adjacent liquid supply channels 18 and liquid recovery channels 19 is thicker in the substrate 11 according to the present embodiment, which is advantageous in that the strength of the recording element board 10 is improved.

Fifth Embodiment

Figure 28A:
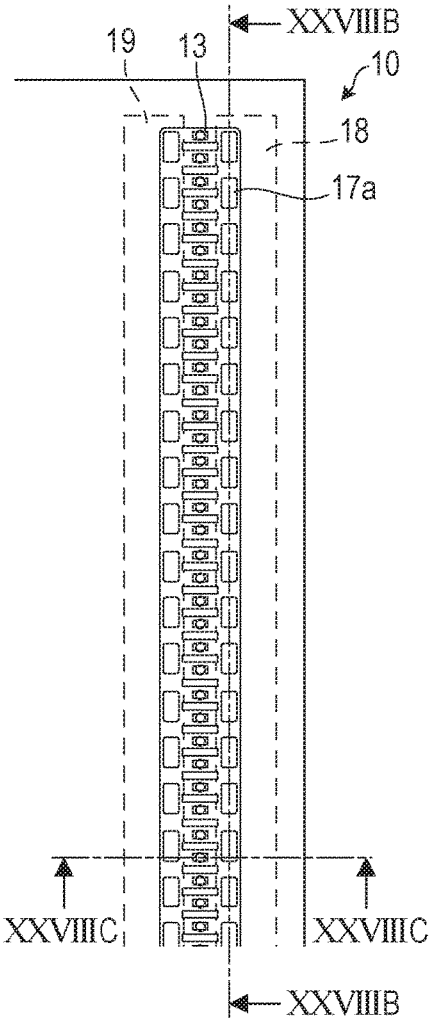
FIGS. 28A through 28C are diagrams describing a recording element board of a liquid discharge head according to a fifth embodiment.
Figure 28B:
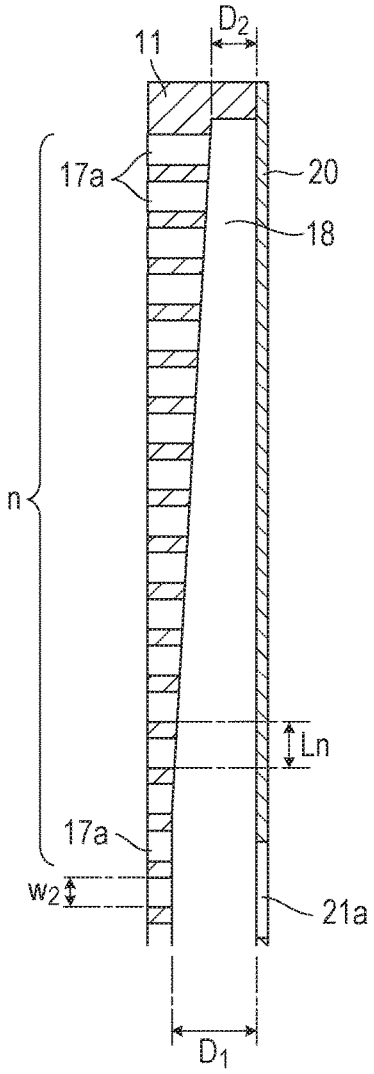
Figure 28C:
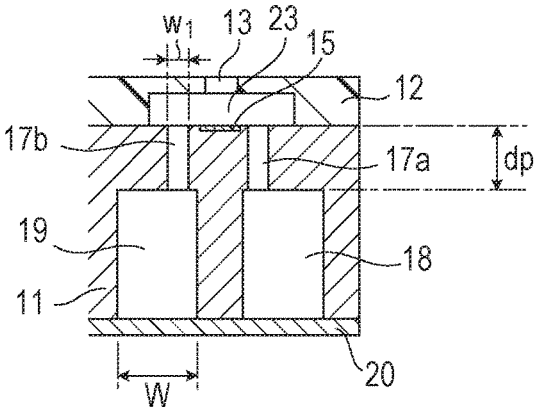

Although the depth Dp of the liquid supply channel 18 has been described as being constant in the above embodiments, there is no need for the depth of the liquid supply channel 18 to be constant. FIGS. 28A through 28C are diagrams for describing the overall configuration of the recording element board 10 of a liquid discharge head 3 according to a fifth embodiment. FIG. 28A is a transparent plan view of the recording element board 10, FIG. 28B is a cross-sectional view taken along line XXVIIIB-XXVIIIB in FIG. 28A, and FIG. 28C is a cross-sectional view taken along line XXVIIIC-XXVIIIC in FIG. 28A. The depth Dp of the liquid supply channel 18 is not constant in the present embodiment, but rather the depth Dp of the liquid supply channel decreases the farther away from a supply-side opening 21*a* formed in the cover 20, meaning that the liquid supply channel 18 which is a groove becomes shallower. Accordingly, the farther away from the position of the supply-side opening 21*a*, the smaller the cross-sectional area of the liquid supply channel 18 becomes. For example, the depth $Dp_1$ of the liquid supply channel 18 at a position where the supply-side opening 21*a* is formed is 425 μm, and the depth $Dp_2$ of the liquid supply channel 18 at a position where the supply port 17*a* farthest from the supply-side opening 21*a* is formed (the supply port 17*a* at the end of the recording element board 10) is 333 μm. The bottom of the liquid supply channel 18 approaches the top side thereof at a constant incline. The width W of the liquid supply channel 18 is 190 μm, the width $w_1$ of one side of the opening of the supply port 17*a* is 40 μm, and the width $W_2$ on the other side is 45 μm. The viscosity η of the recording liquid that is the liquid to be discharged is 6 mPa·s, the flow rate Q that flows through the through channels when continuous discharge is performed from all discharge orifices is 90,000 pl/s, and the maximum number n of through channels included in a section to the supply port 17*a* farthest from that supply-side opening 21*a* (the supply port 17*a* at the end of the recording element board 10) is 92. The length of the supply port 17*a* serving as a through channel is a value obtained by subtracting the depth of the liquid supply channel 18 from the thickness of the substrate 11. Accordingly, the length $dp_1$ of the supply port 17*a* in the depth direction is 160 μm near the position where the supply-side opening 21*a* is formed, and the length the supply port 17*a* in the depth direction is 333 μm near the supply port 17*a* at the end of the recording element board 10. In this case, the greatest value of pressure drop from the supply-side opening 21*a* to the supply port 17*a* at the position farthest removed is approximately 3000 Pa, so even taking pressure drop at the supply port 17*a* into consideration, the composited pressure drop is below 5000 Pa, so recording quality can be maintained even when continuously discharging from all discharge orifices 13. The liquid supply channel 18 is formed shallower toward the ends of the recording element board 10, which is advantageous in that the strength of the recording element board 10 is improved.

Figure 29A:
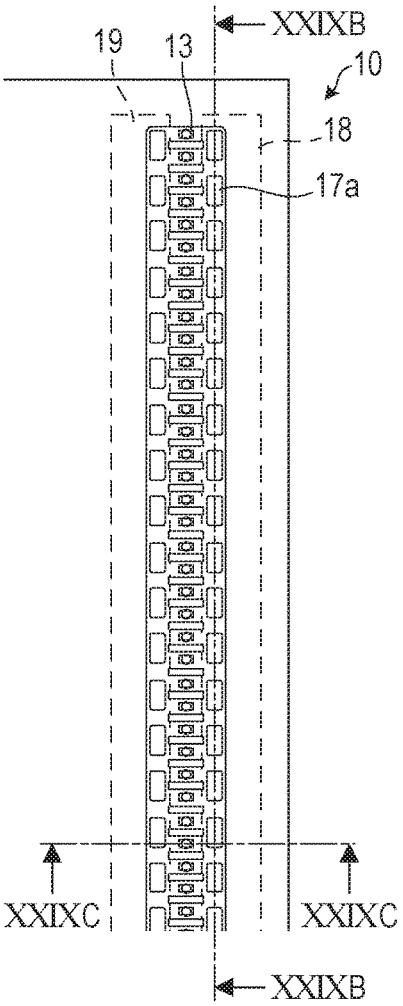
FIGS. 29A through 29C are diagrams describing a recording element board of a liquid discharge head according to a fifth embodiment.
Figure 29B:
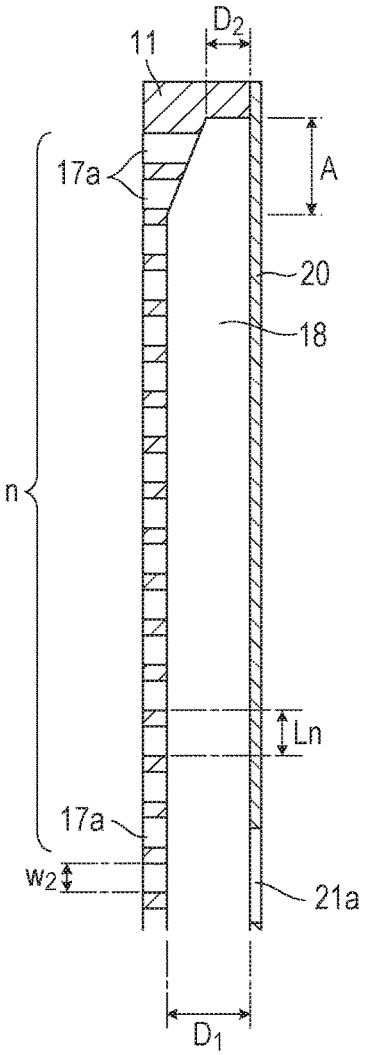
Figure 29C:
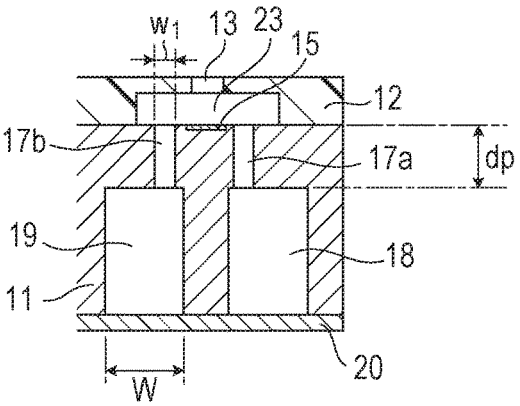

FIGS. 29A through 29C are diagrams for describing the overall configuration of the recording element board 10 of another example of the liquid discharge head 3 according to the fifth embodiment. FIG. 29A is a transparent plan view of the recording element board 10, FIG. 29B is a cross-sectional view taken along line XXIXB-XXIXB in FIG. 28A, and FIG. 29C is a cross-sectional view taken along line XXIXC-XXIXC in FIG. 29A. the arrangement illustrated in FIGS. 29A through 29C differs from the arrangement illustrated in FIGS. 28A through 28C in that the depth of the liquid supply channel 18 only changes at the end portion in the discharge orifice row direction. For example, the depth $Dp_2$ of the liquid supply channel 18 at the end portion is 380 μm, the depth of the liquid supply channel 18 linearly changes to a range of a distance A 200 μm from the end for example, and the depth $Dp_1$ is constant at 425 μm from the position of distance A on the supply-side opening 21*a*. The actual thickness of the substrate 11 also increases at the end portion in the discharge orifice row direction in this case as well, so improved strength of the recording element board 10 can be expected.

According to the present invention, the size of recording element boards having multiple recording elements can be reduced, and also replenishing of liquid to pressure chambers can be speedily performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002953, filed Jan. 8, 2016 and No. 2016-231038 filed Nov. 29, 2016, which are hereby incorporated by reference herein in their entirety.

What is claimed is:

1. A liquid discharge head comprising:

a recording element board having a first side having a first face on which a plurality of recording elements configured to generate energy to discharge liquid are provided;

discharge orifices provided corresponding to the plurality of recording elements;

pressure chambers, wherein the plurality of recording elements is within the pressure chambers;

a discharge orifice row extending in a first direction, wherein the discharge orifices are arrayed in the discharge orifice row;

a liquid supply channel extending in the first direction and provided as a groove to a second face of the recording element board that is on a second side of the recording element board that is opposite of the first side, wherein the liquid supply channel is configured to supply liquid to the pressure chambers;

a plurality of supply ports to communicate between the first face and the liquid supply channel, and configured to supply liquid to the pressure chambers from the liquid supply channel;

a cover provided on the second face, wherein the cover covers the liquid supply channel; and a plurality of supply-side openings, provided to the cover and provided along the liquid supply channel, wherein the plurality of supply-side openings is configured to supply liquid to the liquid supply channel, wherein, in a process of liquid being replenished to the pressure chambers after having discharged liquid from the discharge orifices, a pressure drop sum P1 of (i) pressure drop of liquid on the liquid supply channel from any supply-side opening to a supply port that communicates with the supply-side opening and is at a farthest removed position from the supply-side opening, and (ii) pressure drop of liquid at the supply port at the farthest removed position, is 5000 Pa or less.

2. The liquid discharge head according to claim 1, wherein a composited pressure drop ΔP is 5000 Pa or less when $$\Delta P = \left(\sum_{i=0}^{n} R_i(q - iQ)\right) + rQ$$

where $R_i$ represents viscous resistance of the liquid flowing through the liquid supply channel between an i'th supply port from a position of the supply-side opening to an i+1'th supply port, r represents viscous resistance of the liquid flowing through the supply port, Q represents a flow rate of liquid flowing through each of the plurality of supply ports, q represents an amount of liquid flowing through the supply-side opening, and n represents the number of the plurality of supply ports included in a section from the supply-side opening to the supply port at the farthest removed position from the supply-side opening.

3. The liquid discharge head according to claim 1, wherein a plurality of the plurality of supply ports is arrayed, and wherein a composited pressure drop ΔP is 5000 Pa or less when $$\Delta P = \frac{n^2 RQ}{2} + rQ$$

where R represents viscous resistance of the liquid flowing through the liquid supply channel communicating between mutually adjacent supply ports, r represents viscous resistance of the liquid flowing through the supply port, Q represents a flow rate of liquid flowing through each of the plurality of supply ports, and n represents the number of the plurality of supply ports included in a section from the supply-side opening to the supply port at the farthest removed position from the supply-side opening.

4. The liquid discharge head according to claim 1, wherein a cross-section of the liquid supply channel in a direction orthogonal to a direction of flow of the liquid is rectangular in shape, and the depth of the liquid supply channel is twice or more a width of the liquid supply channel in at least one section of the liquid supply channel.

5. The liquid discharge head according to claim 1, wherein the liquid discharge head includes a plurality of discharge orifice rows, wherein the discharge orifices are arrayed in the plurality of discharge orifice rows.

6. The liquid discharge head according to claim 1, wherein the liquid supply channel is provided parallel to a direction in which the discharge orifice row extends.

7. The liquid discharge head according to claim 1, further comprising:

a liquid recovery channel provided as a groove on the second face and configured to recover liquid from the plurality of pressure chamber;

a plurality of recovery ports to communicate between the first face and the liquid recovery channel, and configured to recover liquid from the pressure chambers to the liquid recovery channel; and a recovery-side opening provided to the cover and configured to recover liquid from the liquid recovery channel.

8. The liquid discharge head according to claim 7, wherein, in a process of liquid being replenished to the pressure chambers after having discharged liquid from the discharge orifices, (A) a sum P2 of (iii) pressure drop of liquid on the liquid return channel from any recovery-side opening to a recovery port that communicates with the recovery-side opening and is at a farthest removed position from the recovery-side opening, and (iv) pressure drop of liquid at the recovery port at the farthest removed position, and (B) the pressure drop sum P1, both are 5000 Pa or less.

9. The liquid discharge head according to claim 7, wherein a sum of (A) a sum, in a process of liquid being replenished to the pressure chambers after having discharged liquid from the discharge orifices, of (1) pressure drop of liquid on the liquid supply channel from any supply-side opening to a supply port that communicates with the supply-side opening and is at a farthest removed position from the supply-side opening, and (2) pressure drop of liquid at the supply port at the farthest removed position, and (B) a sum, in a standby state where liquid is not discharged from the discharge orifices, of (1) pressure drop of liquid on the liquid supply channel from any supply-side opening to a supply port that communicates with the supply-side opening and is at a farthest removed position from the supply-side opening, and (2) pressure drop of liquid at the recovery port at the farthest removed position, is 5000 Pa or less.

10. The liquid discharge head according to claim 7, wherein a sum of (A) a sum, in a process of liquid being replenished to the pressure chambers after having discharged liquid from the discharge orifices, of (1) pressure drop of liquid on the liquid recovery channel from any recovery-side opening to a recovery port that communicates with the recovery-side opening and is at a farthest removed position from the recovery-side opening, and (2) pressure drop of liquid at the recovery port at the farthest removed position, and (B) a sum, in a standby state where liquid is not discharged from the discharge orifices, of (1) pressure drop of liquid on the liquid recovery channel from any recovery-side opening to a recovery port that communicates with the recovery-side opening and is at a farthest removed position from the recovery-side opening, and (2) pressure drop of liquid at the recovery port at the farthest removed position, is 5000 Pa or less.

11. The liquid discharge head according to claim 1, wherein the cover is made of a resin film having photosensitivity.

12. The liquid discharge head according to claim 1, further comprising:

a recording element board row on which the plurality of recording elements is arranged; and a support member configured to support the recording element board row, wherein the liquid discharge head is a page-wide liquid discharge head.

13. The liquid discharge head according to claim 12, wherein the support member includes:

a common supply channel configured to supply liquid to the recording element boards row, and a common recovery channel configured to recover liquid from the recording element boards.

14. The liquid discharge head according to claim 1, wherein the pressure chambers have an inside and an outside, and wherein the liquid within the pressure chambers is circulated between the inside of the pressure chambers and the outside of the pressure chambers.

15. A liquid discharge apparatus comprising:

a liquid discharge head including:

a recording element board having a first side having a first face on which a plurality of recording elements configured to generate energy to discharge liquid are provided, discharge orifices provided corresponding to the plurality of recording elements, pressure chambers, wherein the plurality of recording elements is within the pressure chambers, a discharge orifice row extending in a first direction, wherein the discharge orifices are arrayed in the discharge orifice row, a liquid supply channel extending in the first direction and provided as a groove to a second face of the recording element board that is on a second side of the recording element board that is opposite of the first side, wherein the liquid supply channel is configured to supply liquid to the pressure chambers, a plurality of supply ports to communicate between the first face and the liquid supply channel, and configured to supply liquid to the pressure chambers from the liquid supply channel, a cover provided on the second face, wherein the cover covers the liquid supply channel, a plurality of supply-side openings, provided to the cover and provided along the liquid supply channel, wherein the plurality of supply-side openings is configured to supply liquid to the liquid supply channel, a storage unit configured to store the liquid, and a supply unit configured to supply the liquid from the storage unit to the liquid supply channel via the plurality of supply-side openings, wherein, in a process of liquid being replenished to the pressure chambers after having discharged liquid from the discharge orifices, a pressure drop sum P1 of (i) pressure drop of liquid on the liquid supply channel from any supply-side opening to a supply port that communicates with the supply-side opening and is at a farthest removed position from the supply-side opening, and (ii) pressure drop of liquid at the supply port at the farthest removed position, is 5000 Pa or less.

* * * * *